US006286798B1

(12) United States Patent
Chun

(10) Patent No.: US 6,286,798 B1
(45) Date of Patent: Sep. 11, 2001

(54) VERSATILE BEVERAGE CONTAINER HOLDER

(76) Inventor: Carol Ann Chun, P.O. Box 61958, Honolulu, HI (US) 96839

( * ) Notice: Subject to any disclaimer, the term of this patent is extended or adjusted under 35 U.S.C. 154(b) by 0 days.

(21) Appl. No.: 09/443,257

(22) Filed: Nov. 18, 1999

Related U.S. Application Data

(60) Provisional application No. 60/162,934, filed on Nov. 1, 1999, provisional application No. 60/120,217, filed on Feb. 12, 1999, and provisional application No. 60/109,355, filed on Nov. 19, 1998.

(51) Int. Cl.[7] ..... B65D 23/08

(52) U.S. Cl. ..... 248/311.2; 206/218; 220/737; 220/907

(58) Field of Search ..... 248/311.2, 314, 248/318, 205.2; 206/206, 217, 218; 211/72, 73; 220/907, 737, 738; D7/619, 620

(56) References Cited

U.S. PATENT DOCUMENTS 3,561,670 * 2/1971 Segal ..... 229/53
4,418,733 * 12/1983 Kallman ..... 383/11
4,682,691 * 7/1987 Spiering ..... 206/373
4,802,602 * 2/1989 Evans et al. ..... 220/85
4,838,466 * 6/1989 Holmstrom ..... 224/250
4,848,625 * 7/1989 Lucia ..... 224/250
4,860,896 * 8/1989 Snider ..... 206/427
4,928,873 * 5/1990 Johnson ..... 229/1.5 H
5,065,879 * 11/1991 King ..... 220/739
5,325,991 * 7/1994 Williams ..... 220/739
5,425,539 * 6/1995 Steffes ..... 273/189 A
5,477,978 * 12/1995 Lo ..... 220/710
5,743,406 * 4/1998 Wright ..... 206/565
5,746,372 * 5/1998 Spence ..... 229/403
5,775,570 * 7/1998 Kim ..... 229/4.5
5,873,486 * 2/1999 Morgan ..... 220/739
6,138,902 * 10/2000 Welch ..... 229/103.11

* cited by examiner

*Primary Examiner*—Ramon O. Ramirez
*Assistant Examiner*—Jon Szumny
(74) *Attorney, Agent, or Firm*—Martin E. Hsia

(57) ABSTRACT

A beverage container holder (2000) that can be attached to horizontal or vertical members, that can be compacted and that can accept cylindrical and frustoconical beverage containers and mugs. Preferably a strap (130) is wrapped in the middle of the beverage container holder (2000) when it is rolled up.

33 Claims, 32 Drawing Sheets

FIG. 1
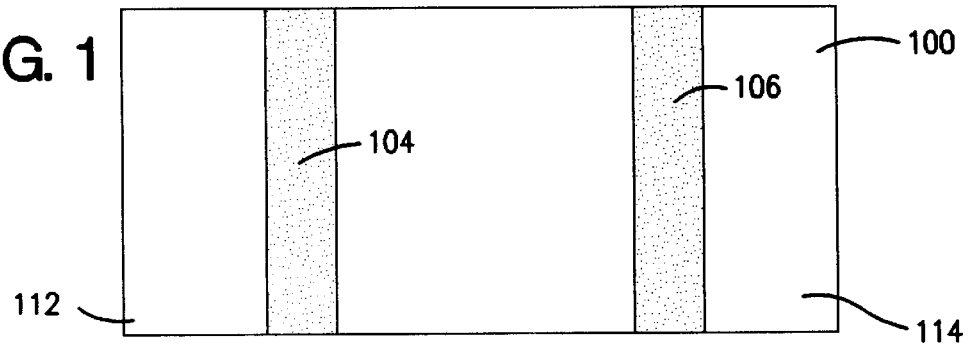
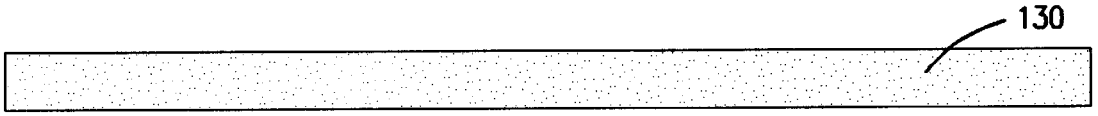
FIG. 2
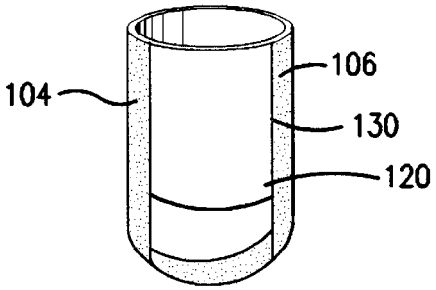
FIG. 6
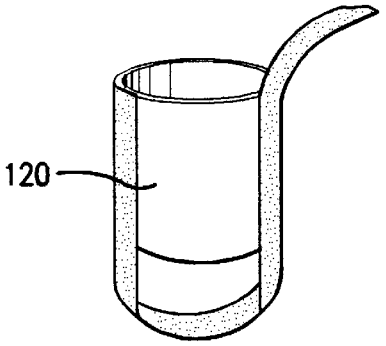
FIG. 7

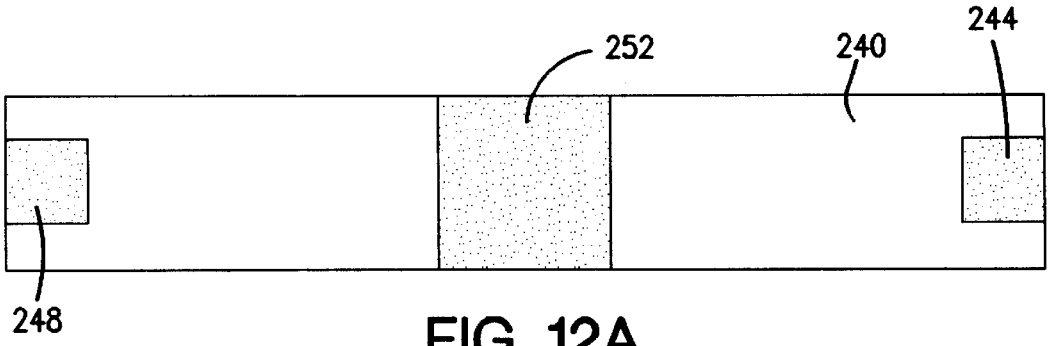
FIG. 12A
FIG. 13
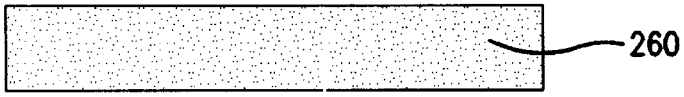
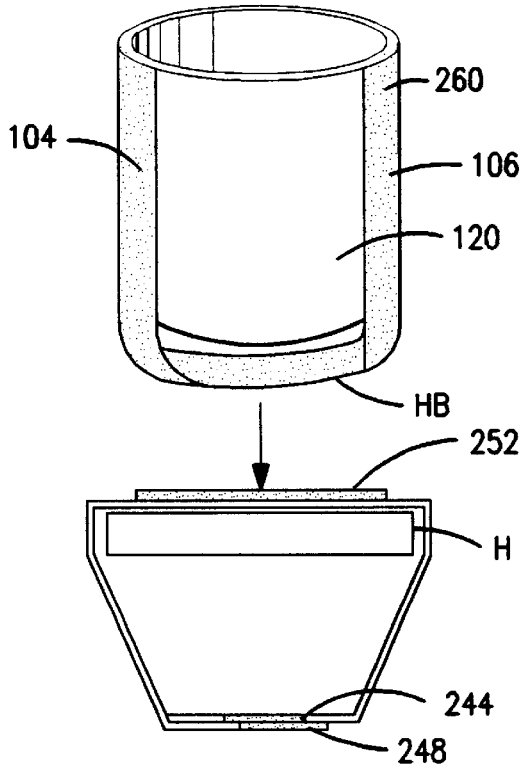
FIG. 14
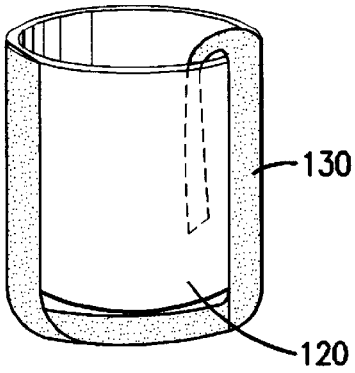
FIG. 15

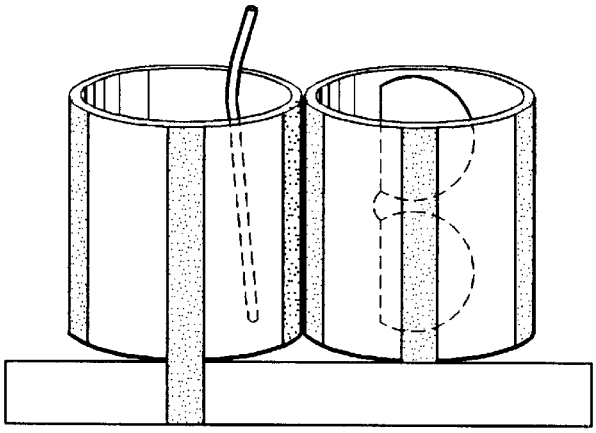
FIG. 44
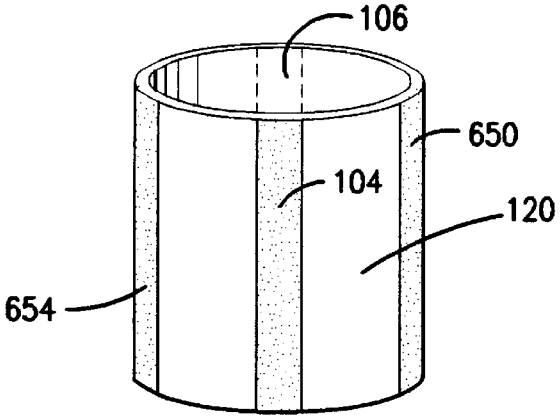
FIG. 45
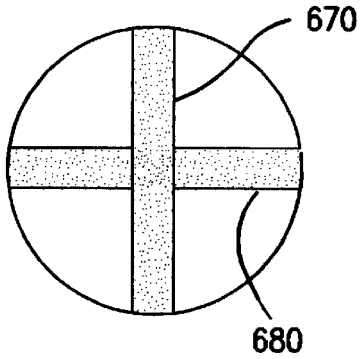
FIG. 47
FIG. 46
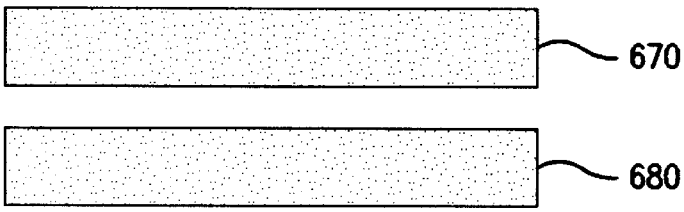
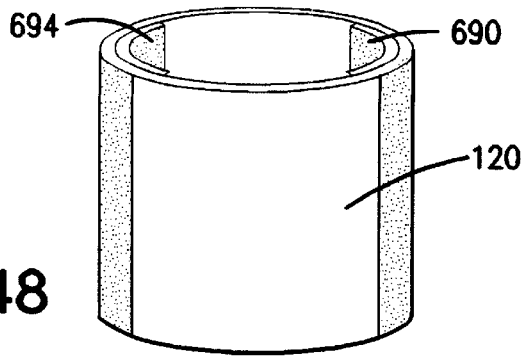
FIG. 48

VERSATILE BEVERAGE CONTAINER HOLDER

This application claims the benefit of U.S. provisional patent applications 60/109355, filed Nov. 19, 1998; U.S. Pat. No. 60/120217, filed Feb. 12, 1999; and U.S. Pat. No. 60/162934 filed Nov. 1, 1999.

TECHNICAL FIELD

According to an article in the *Medical & Healthcare Marketplace Guide*, 1998, there are approximately 1.3 million U.S. wheelchair users with about 700,500 wheelchair users who are under the age of 65. Further, the user population is increasing at a rate of 3% per year due in part to an aging population and also an increased interest by disabled persons to stay mobile and maintain their quality of life.

This invention relates to a beverage container holder that attaches to the arms of wheelchairs and other members.

Wheelchair-bound persons, particularly those who have limited or no use of their arms, have a need for a device to hold their beverages, e.g. soda cans, to their wheelchairs. Without such devices, their beverages slip off the wheelchair arm, someone has to hold the can while they drink, or they choose not to drink and go thirsty. The object of this invention was to provide a beverage holding device for wheelchairs. Another object of the invention was to provide a device that was light and easily transportable. Wheelchair bound persons are limited in what they can carry, often getting around with just a waist pouch, commonly known as a fanny pack. This invention can be compacted to carry in a fanny pack. Additionally, this holder may be used to hold the beverages of the person pushing the wheelchair.

By meeting the above-mentioned objectives, this invention would be particularly useful for wheelchair-bound persons and for those who attend to wheelchair-bound persons. With this invention, a wheelchair-bound person may drink on his own without another person standing by holding the drink and waiting for the wheelchair-bound person to finish drinking. It seems that this would be particularly desirable for the wheelchair-bound person in that he or she would no longer feel rushed to finish drinking and to drink at his or her own leisure. He or she would also have an additional measure of privacy while drinking.

There are other advantages of this invention for wheelchair-bound persons. Most prior art beverage holders that attach to wheelchairs do not elevate the beverage container enough to allow drinking with a standard straw. Furthermore, most necessitate lifting the beverage unless a long straw is available. This invention may attach a beverage container to the top of wheelchair arms. By doing so, this invention elevates the container such that wheelchair-bound persons may easily bend over and drink with the use of a standard straw. Many wheelchair bound persons have upper-extremity weaknesses that make difficult the lifting of a beverage out of its holder in order to drink. This invention eliminates the need for such lifting. Furthermore, because the beverage container is elevated, a wheelchair-bound person would not need to carry an extra long straw.

The top surfaces of most wheelchair arms are cushioned and slightly convex (due to the cushioning). Surprisingly, the holder according to this invention may be attached very securely to a cushioned, convex surface such that the holder will stay in place without slipping or sliding. Being bottomless and allowing direct contact between the beverage container and the wheelchair arm, the holder attached to the wheelchair arm is very stable.

Note also that the holder according to the invention can be adjusted to fit snugly around a beverage container, a feature that is lacking in prior art for wheelchairs. Having a beverage container in a holder that is too big for it can be very annoying to the person using the holder. Further, having a holder which fits too tightly makes it difficult for a person to lift the beverage out, particularly for persons with weak upper extremities. With the holder of the invention, a person may adjust the holder to fit the beverage container to his or her liking.

For persons not desiring to attach their drinks to the tops of their wheelchair arms, this invention may instead attach to non-horizontal members on wheelchairs. For such persons, using a long straw or tube for sipping may be necessary, particularly when due to their disability, they are unable to lift the beverage out of its holder or they are unable to bend over in order to drink from a standard straw. However, a problem with using such long straws or sipping tubes is that the tube tends to slip out of the beverage container when a person sips. With this invention, the tube may be held in place, i.e. in the beverage container, while the person sips. Further, this invention allows for storing the sipping tube when not in use.

Notably, the majority of beverage holders for wheelchairs attach by means of spring clips that clip onto the tubular posts of wheelchairs. As a result, these holders cannot attach to members that are not tube-shaped or members that have tubular diameters too large for the clips to clip to. The holder according to this present invention, on the other hand, may attach to members of differing shapes and sizes. Further, it may attach to members of various orientations, be it horizontal, vertical or diagonal.

Also, the vast majority, if not all, beverage container holders for wheelchairs are made of hard plastic and metal. This invention, due to its compactibility, flexibility and light weight is much easier and less expensive than existing beverage holders to ship and distribute; the invention would not need to be padded for transit and its light weight reduces shipping costs.

This invention also relates to a beverage container holder that attaches to the arm of office chairs. Spilling drinks on office desks, particularly cluttered ones, can be a problem. Additionally, the clutter on some person's desks often prevents them from even having drinks on their desks. This invention solves that problem by allowing a person to secure a drink on the arm or seat of his or her office chair by attaching the holder to the chair arm or seat post. Alternatively, this invention allows a person to comfortably secure his or her drink to his or her leg when no other attaching member exists on his or her chair.

This invention also may be used to attach beverages, such as baby bottles or cups, to baby carriages or strollers. Parents often have their hands full when toting around their infants and toddlers. Having a device to attach baby bottles or other beverages to strollers would free their hands and lessen their load. Additionally, it would make the bottles readily available instead of having to search for them in a hand or tote bag. Also, parents may use the invention to hold their own beverages and not just the baby's beverage.

This invention also relates to a beverage container holder for passengers on airplanes, boats, trains, autos, buses, or other vehicles. Persons traveling on airplanes are often inconvenienced when desiring to drink because they have to pull out eating trays on which to place their drinks. This can be especially inconvenient, awkward, and uncomfortable when they need to go to the lavatory, when they are of such large size that their trays push uncomfortably against their bodies, or when there is turbulence and the drinks are bumping and sliding on their trays. The invention solves that problem by securing their drinks to their passenger-seat arms. The compactability and portability make this invention particularly suitable to travelers. Another advantage of this invention regarding its use on airplanes is that it may reduce the use of plastic cups, thus being ecologically or environmentally responsible.

This invention also relates to a beverage container holder that can be attached to the arms of car doors. Many automobiles do not have beverage holders for back-seat passengers. This invention solves that problem by allowing for attachment of the holder's sides to the handles on car doors.

This invention can also be used to attach to the front of mopeds and motorcycles.

Thus this invention may be used to attach beverage containers to the arms or posts of any variety of chairs besides wheelchairs, e.g. airplane seats, tour bus seats, auto seats, boat seats, train seats, theatre seats, beach chairs and office chairs. Basically, it may be attached to the top or underside of any horizontal member to which a person desires to place a beverage container and vertically along any vertical member (including a person's body) to which a person desires to secure a beverage container. Furthermore, it may be hung from any member conducive to the hanging feature of the holder.

This invention also relates to a beverage container holder that hangs from a stationary object such as the coat/purse hook on lavatory doors. Many people do not like to put their beverages on the floor of public lavatories because they are unclean. This invention would be useful to such persons because it would allow them to hang their beverages on the coat hook or locks of the stall doors. The hanging feature of this invention would also be useful to persons pushing wheelchairs or strollers wanting to hang their beverages on the handles of the wheelchair or stroller while pushing. In addition, this invention would be very useful to gardeners or yardmen who often become thirsty when mowing lawns in the heat of day because with this invention, they could transport their drinks wherever they mow by hanging this invention from the handlebars of their lawnmowers. Alternatively, a woman may hang the holder over her shoulder and carry her beverage as she would carry her handbag.

This invention also relates to a beverage container holder that can hang around a person's neck. Wheelchair bound persons may not have use of their hands. Also, some persons, although not wheelchair bound, may be disabled in the use of their arms. And some persons are without arms. This invention could hang around a person's neck and allow him or her to drink from a beverage container with the use of a standard straw by bending his or her neck forward.

This invention also relates to a beverage container holder that can be attached to a clipboard sitting on the lap of a person in a wheelchair.

This invention also relates to a miscellaneous small item holder for passengers on airplanes, boats, trains, autos, buses, or other vehicles. This would be particularly useful for passengers on airplanes where personal space is limited. In particular, passengers using reading glasses or pens have no secure place in which to place their glasses when going to the lavatory or walking around. They must either bend over to put the items back in their carry-on bags or leave them on their seats. When returning to their seats, they may forget to pick up their glasses and instead sit on them, thereby crushing or deforming them. This invention solves that problem by allowing a passenger to place the glasses securely and safely in the holder attached to the top of the passenger-seat arm. The invention may also be used to hold cups or packages of various snacks such as chips, cookies, pretzels, etc. This eliminates the need for a person, such as an airline passenger, to pull out their tray just to hold his or her snacks.

This invention can be practiced in a modular embodiment that allows the carrying of multiple drinks or other items at the same time. This may be useful for hikers wanting to take multiple drinks on their hikes. After they finish each drink, they can compact the holder that is no longer being used and place it in their waist pouch or pocket. Or they can attach it to the strap holding their remaining drinks.

BACKGROUND ART

Existing beverage container holders lack the seven-fold functionality of: (1) attaching to the tops of horizontal surfaces; (2) attaching to the underside of horizontal surfaces; (3) attaching to vertical objects or posts; (4) hanging; (5) stand-alone usability and transportability; (6) attaching more than one holder at a time; and (7) having the ability to be and maintained in the compacted state.

U.S. Pat. No. 4,802,602 issued to Evans, Campbell and Blair discloses an insulating device for a beverage container including a flexible sleeve, a cover and a strap. However, Evans does not provide a means to compact the device and retain it in the compacted configuration. It also does not provide for attachment to a vertical member (such as the post of a chair arm) or a horizontal member (such as the top surface of a wheelchair arm).

U.S. Pat. No. 5,325,991 to Williams discloses a beverage container holder including an insulating blanket and a vertical bendable support. Williams does not provide a way to compact the device and retain it in the compacted configuration. Furthermore, although a means is provided for attaching to a vertical surface, such surface needs to be flat and a releasable bonding member must be mounted to that vertical surface. This may be a problem when desiring to attach the holder to public or non-personal property. A disadvantage of this holder is that it would not attach well to rounded surfaces, such as the rounded vertical posts of chair arms.

U.S. Pat. No. 5,065,879 to King describes a compactable beverage container holder. However, King does not provide a means for attaching to horizontal or vertical objects.

U.S. Pat. No. 5,667,180 to Duckworth discloses a beverage holder that is not compactable and does not allow for attaching to vertical objects.

Additionally, existing beverage container holders cannot be hung from a person's neck in a manner that would allow a person to drink while it is hung around the neck. This invention makes such drinking possible. Furthermore, existing beverage container holders are not modular and cannot secure two or more holders together as a single unit.

Also, existing beverage container holders cannot accommodate both frustoconical and cylindrical beverage containers. Furthermore, existing beverage container holders cannot well accommodate various sizes of containers including containers ranging in size from the standard 12 ounce (355 ml) to 16 ounce (473 ml) soda cups to standard 12 ounce (355 ml) soda cans to standard 16 ounce (473 ml) water bottles.

While beverage holders made of a flexible insulating materials(such as neoprene) exist for cylindrical beverage containers (such as soda cans), holders for frustoconical containers (such as the common soda-fountain drink cups) may not. Further, for many persons, holding these soda-fountain cold drinks is problematic because the condensation on the outside of the container gets their hands wet and also is cold to the touch. Such persons would appreciate a holder that would insulate their drink, be a barrier to the ice coldness and also keep their hands dry.

Importantly, the holder according to this present invention is very versatile. In fact, the versatility of this holder is a key feature of this invention. It is the versatility of the holder, with its ability to attach to members of various shapes, sizes and orientations, to hold various shapes and sizes of beverage containers, to neatly compact and stay compacted, as well as the host of other abilities discussed in the preceding text, that distinguishes it from prior art; prior art beverage holders cannot inclusively do all that the holder according to this invention can.

DISCLOSURE OF INVENTION

This invention contemplates a rectangular blank made of flexible material, such as leather or neoprene. End surface fasteners (such as hook and loop fasteners or zippers) are preferably provided across two opposing ends of the blank on opposite surfaces of the blank (preferably configured as spaced apart parallel strips). Surface fasteners are fasteners in which two complementary surfaces may be detachably fastened when brought in contact with each other, regardless of orientation. The strips preferably span the entire width but alternatively can span a portion or portions of the width. Preferably the end surface fasteners can be detachably joined so that the blank forms a hollow shape, preferably a cylindrical sleeve, with the top and bottom of the cylinder formed by the sides of the blank. The end surface fasteners may also be detachably joined at an angular offset so the blank forms a truncated conical (frustoconical) sleeve. The circumference of the hollow shape is preferably approximately at least as great as the minimum circumference of the beverage container. In this manner, if the blank comprises a stretchable material, even though the circumference of the hollow shape may be slightly less than the minimum circumference of the beverage container, the hollow shape can still be configured to receive the beverage container. Thus, a circumference that is approximately at least as large as the minimum circumference of the beverage container shall include a circumference that is slightly less than the minimum circumference of the beverage container, so as to encompass the use of stretchable materials. Henceforward, "sleeve" will refer to a cylindrical or frustoconical sleeve. Alternatively, the ends of the blank may be permanently attached such as by being sewn together to form a permanent sleeve.

Preferably at least two strap surface fasteners are provided on the blank so that they will be on the exterior surface of the sleeve when it is formed. Preferably the strap surface fasteners are diametrically opposite each other and outwardly facing. Preferably, one of these strap surface fasteners is at an end of the blank on the opposite surface from one of the end surface fasteners.

Regardless of whether the ends are permanently or detachably joined, the beverage container can be received by the sleeve so formed. The sleeve is preferably placed on the top of the wheelchair arm or other horizontal member on which a person wants to place the beverage container. After the beverage container is placed in the sleeve, a long (preferably completely detachable) strap, the "holder strap", which preferably, though not necessarily, has a holder surface fastener on at least one entire surface, attaches to one of the strap surface fasteners on one side of the sleeve, loops under the wheelchair arm or other horizontal member, and then attaches to the strap surface fastener on the opposite side of the sleeve. In this manner, the beverage container is securely attached to the top of the wheelchair arm or any other horizontal member. Henceforward, "holder" will refer to a sleeve (or the blank that formed the sleeve) with a holder strap.

When not in use, the holder is easily dismantled by separating surface fasteners that are keeping the holder together. The holder may then be rolled up and wrapped by the holder strap which may fasten to the strap surface fasteners on the holder. In this manner, the holder is compacted, maintained in its compacted state, and conveniently stored or carried until its use is desired. Alternatively, the holder may be rolled up (after detaching the ends) in a jellyroll manner with the holder strap in the center of the "roll." Further, the holder can be maintained in its rolled-up compacted state by attaching an end surface fastener to a strap surface fastener that is complementary to that end surface fastener and on the surface opposite to that end surface fastener.

It is also contemplated that the sleeve, by itself, may be used to hold a beverage container. Though not essential, rubber strips or other friction enhancing materials may be placed on the inside of the sleeve to increase frictional grip. In this embodiment, end surface fasteners are preferably provided across two opposing ends of a preferably rectangular blank on opposite surfaces of the blank (preferably configured as spaced apart parallel strips). A strap surface fastener is placed intermediate between the two ends of the blank. Preferably the strap surface fastener is complementary to the end surface fastener on the surface opposite to the strap surface fastener. Preferably the end surface fasteners can be detachably joined to form either a cylindrical sleeve or a frustoconical sleeve. When the sleeve is not being used, the ends may be detached and the blank that formed the sleeve rolled up in a jellyroll manner. The end surface fastener on one surface of the blank then may attach to the strap surface fastener on the opposite surface of the blank to retain the blank in a compacted state. The manner in which this holder is compacted and maintained in a compacted state is a unique and valuable feature of this invention which existing beverage holders do not possess. Due to this feature, the Ider may be easily transported, easily stored and readily available for use; a user could easily keep the holder in a pocket or purse until he or she needs to use it. It should be noted that without the strap surface fastener on the sleeve to which the end surface fastener can attach, the blank that formed the sleeve would tend to unroll, be more bulky, and be more difficult to transport and store.

Although it is possible to use the holder with a single strap surface fastener exterior to the holder, it is preferable to have two strap surface fasteners exterior to the holder and diametrically opposed to each other. First of all, the strap surface fasteners, particularly if they are hook surface fasteners, provide an easy gripping surface for a person's hand. Secondly, this allows a person the option of using the holder with a holder strap with which the holder may be hung or detachably attached to a member. Thirdly, the strap surface fasteners would have a marketing benefit; they may be affixed to the holder in various shapes and colors to decorate the holder or to display a company's logo.

This invention also contemplates that the holder strap may be permanently joined to the sleeve. In this embodiment, a first end surface fastener is placed at an end of a preferably rectangular blank. A first end of a holder strap is preferably permanently placed at the opposite end and on the same surface of the blank. A second end surface fastener which is preferably complementary to first end surface fastener is placed at the same end of the blank where the holder strap is placed but on the surface opposite to the holder strap. A strap surface fastener is placed on the blank between the first end surface fastener and the first end of the holder strap. Preferably the holder surface fastener on the distal end of the holder strap is complementary to the strap surface fastener. Preferably the strap surface fastener is complementary to the end surface fastener on the surface opposite to the strap surface fastener. Preferably the end surface fasteners can be detachably joined to form either a cylindrical sleeve or a frustoconical sleeve. The sleeve may then be secured to a horizontal member by extending the holder strap around the member and attaching the second end of the holder strap to the strap surface fastener. Alternatively, a loop may be formed to hang the sleeve, such as around a person's shoulder, by first extending the holder strap across the bottom of the sleeve (thus forming a holder bottom). The holder strap then attaches to the strap surface fastener and lastly attaches to the first end surface fastener to close the loop. When the sleeve is not being used, the ends may be detached and the blank that formed the sleeve rolled up in a jellyroll manner. The end surface fastener on the surface opposite to the strap surface may then attach to the strap surface fastener to retain the blank in a compacted state. Further, the holder strap may be neatly compacted and stored by threading the holder strap through the center of the "roll" and attaching it to the strap surface fastener. Because the holder strap is permanently attached to one end of the blank, only one strap surface fastener needs to be joined to the blank. This would reduce the materials cost of the invention. Another advantage of this embodiment is that the holder strap would not be lost because it is permanently joined to the sleeve.

With respect to the "jellyroll" embodiments, this invention contemplates that the holder may be compacted and stored in a manner that nicely displays prints, logos, appliques, or advertising indicia in spite of the presence of the holder strap. When the holder strap is stored in the center of the roll or threaded through the center of the roll, a person may avoid covering such displays.

This invention contemplates four embodiments that would keep the end of an extra long sipping tube from slipping out of the beverage container. First, at least one auxiliary loop, preferably formed with a flexible, stretchable material, may be attached to the exterior of the holder ,by sewing or by using surface fasteners. The loop would function to hold the tube securely in place as it passes from the beverage container to the person sipping. Using a flexible, stretchable material would allow sipping tubes of various diameters to fit through and be secured by the loop. Second, at least two apertures, through which the tube can pass, may be cut in the sleeve of the holder. Passing the tube through the apertures would secure the tube in place and not allow the end of the tube to slip out of the beverage container. Third, one or more loops may be formed with the holder strap when it attaches to a strap surface fastener on the exterior of the holder. When the holder strap attaches to a strap surface fastener on the holder, a small middle portion of the holder strap may be left unattached to the strap surface fastener to form a loop through which the sipping tube may pass. The size of this loop may be adjusted to fit snugly around various diameters of sipping tubes by increasing or decreasing the size of that unattached middle portion. Fourth, a surface fastener may be joined to the sipping tube which could then detachably attach to a strap surface fastener on the sleeve.

This invention also contemplates that a pouch may be formed on the exterior or interior of the holder to conveniently store the sipping tube when not in use.

This invention also contemplates that when the sleeve is constructed of a stretchable flexible material, such a neoprene, and the sides are permanently joined, such as by sewing, both a cylindrical and a frustoconical beverage container may fit snugly in the sleeve.

It is also contemplated that the holder may be used to hold containers with non-circular cross sections, such as milk cartons with rectangular cross sections.

It is contemplated that a single holder according to the invention may accommodate a range of circumferences of beverage containers including those of a standard 12 ounce (355 ml) or 16 ounce (473 ml) soda cup, a 12 ounce (355 ml) soda can, and a 16 ounce (473 ml) water bottle. This feature of the invention would be especially useful to travelers in foreign countries such as Japan where the dimensions of standard beverage cans and cups are different than those seen in the United States. It would also be easier and less expensive to market the invention internationally because the same manufacturing specifications could be used for different countries.

This invention also contemplates that a bottom for the holder, a "holder bottom", may be formed by permanently or detachably joining one end of a bottom strip of preferably thin flexible material to one portion of an edge of the blank (preferably where the edge intersects an end of the blank). The other end of the strip is joined to another portion of the same edge of the blank, preferably at the center of the blank. The bottom strip forms a holder bottom when the ends of the blank are joined together to form the sleeve. Preferably the length of the strip is approximately the diameter of the bottom of the beverage container to be held. It is preferred that the ends of the bottom strip are detachably joined to the blank (such as by using surface fasteners), but one or both ends can be permanently joined. Henceforward, "holder bottom" will refer to a bottom formed permanently or detachably for the holder.

Another method of forming a holder bottom is by attaching the end portions of a long strip of strap surface fastener to the cylinder or frustoconical sleeve of the holder so that a middle portion of the strip is left unattached to the sleeve, spans the bottom of the sleeve, and forms a holder bottom. Preferably the length of this middle portion is approximately the diameter of the bottom of the beverage container to be held. It is preferred that the ends of this strip of strap surface fastener are detachably joined to the blank, but one or both ends can be permanently joined.

This invention also contemplates an embodiment in which the entire surface of the blank that forms the exterior of the sleeve is a surface fastener, such as a loop element surface fastener. A strip of the complementary surface fastener, such as a hook element surface fastener, is joined to the opposite surface of the blank at one end of the blank, or can cover that entire opposite surface. This strip attaches to the other end of the blank to form a sleeve. Because the entire exterior surface of the sleeve is a surface fastener, it is not necessary to attach separate strap surface fasteners to the blank to provide areas to which the holder strap may attach; the holder strap may attach anywhere to the exterior surface of the sleeve. Furthermore, it is contemplated that this embodiment would save on material and labor costs because no separate strap surface fasteners need to be attached to the surface of the blank that will form the exterior of the sleeve; other embodiments of this invention require such joining.

This invention also contemplates embodiments in which the entire surface of any sections or panels of the blank that forms the sleeve may be a surface fastener. Furthermore, a person of ordinary skill in the art would be able to construct such embodiments in accordance with this invention.

The holder strap may be cut just long enough to line up evenly at the top of the holder or it may be longer to allow for hanging the holder.

The holder strap may also be used to form a holder bottom to hold the beverage in the holder without attaching the holder to anything. Thus a person may use the holder to secure it to the top of a chair arm or post and still be able to use it to insulate his or her beverage if he or she needs to get up from their chair and move somewhere else. This is done by detaching one end of the holder strap from the holder, removing the holder from the member to which it is attached, and then forming a holder bottom by reattaching the detached end back to the sleeve. The excess holder strap may be tucked in the interior of the holder between the holder and the beverage container.

This invention contemplates an alternative way to secure beverages to horizontal surfaces. In this method, two straps are used. The first strap, a holder strap forms a holder bottom. This holder strap has surface fasteners on both sides. A second strap, the "base strap", is provided. The base strap is preferably a wide strip of strong fabric, such as nylon, with a surface fastener on at least part of one surface to attach to the beverage holder. The holder is configured so that the holder strap forms a holder bottom with a surface fastener facing downward. The base strap is wrapped around the arm of the chair (or other member to which the beverage container will be attached) with a surface fastener that is complementary to the downward facing surface fastener of the holder bottom, facing upward. The beverage in its holder is then placed on the base strap with the downward facing fastener on the holder bottom attaching to the upward facing fastener on the base strap. If the downward facing fastener on the holder bottom is identical to (and therefore not complementary to) the upward facing fastener on the base strap, a separate mating pad having the complementary surface fastener on both surfaces can be provided. The base strap preferably has a buckle or some other means (such as a surface fastener placed at each end of the strap) to adjust its length to tighten it around the member on which the holder will be placed. This base strap may be wrapped once or several times around the horizontal member depending on the circumference or perimeter length of the member. When not in use, the base strap may be folded and retained by the holder.

The above method may also be used to secure beverages to vertical posts or surfaces by wrapping the base strap around a vertical post or surface. A fastener on the side of the holder is then attached to a complementary fastener on the base strap. The base strap may be used as a belt around a person's waist to which the holder can be attached.

This invention also contemplates securing a beverage to an object by placing a magnet or adhesive on the back of a piece or strip of mounting surface fastener, which is complementary to a strap surface fastener or the holder strap which formed a holder bottom. The piece or strip of mounting surface fastener is then mounted to the object and the holder strap or a strap surface fastener then may attach to the mounting surface fastener. For example, a mounting surface fastener could be mounted onto a clipboard sitting on the lap of a person in a wheelchair. The person could then secure the holder bottom to his or her clipboard without worrying about the beverage slipping off their lap. Also, the side of the holder may be secured to a vertical surface, such as a filing cabinet or belt clip, by attaching the strap surface fastener or holder strap on the exterior of the sleeve to a mounting surface fastener mounted to the vertical surface.

This invention contemplates three methods of hanging. One method is to place an interior surface fastener on the interior of the sleeve, and preferably but not necessarily aligned with a first strap surface fastener on the exterior of the sleeve. A second strap surface fastener is placed on the exterior of the sleeve, preferably diametrically opposite to the first strap surface fastener. The holder strap first attaches to the second strap surface fastener, then loops under to form a holder bottom, then attaches to the complementary first strap surface fastener and finally is tucked in and secured to the complementary interior surface fastener. This forms a secure single loop on one side of the holder for hanging.

The second method of hanging involves forming a loop with the holder strap by attaching one end of the holder strap to a complementary strap surface fastener on one side of a sleeve. After looping under the bottom of the sleeve, the holder strap attaches to a complementary fastener on the opposite side of the sleeve and then attaches again where the holder strap was initially attached. This method allows for either loose hanging or tightly securing the holder to the underside of a horizontal surface. This holder strap may be an entirely single or double-sided surface fastener or it may be a flexible strip of material with surface fasteners at the ends.

The third method of hanging is to use a holder strap to form a holder bottom. A second holder strap, preferably with surface fasteners at each end or itself being a single or double-sided surface fastener, is fastened to two complementary strap surface fasteners at the top of the holder. This forms a loop from which the holder can be hung from a person's shoulder or neck. Either the first or the second holder strap may be used to wrap, compact and maintain the holder in its compacted state.

It is preferable to use a hook and loop fastener to attach to the sides of the sleeve to form a holder bottom. It is also preferable to use the hook portion for the strap surface fasteners on the sleeve and to use the loop portion for the holder strap. However, these positions may be reversed.

The holder strap may be single-sided with the strap having a fastener on just one side or it may be double-sided with a fastener on both sides. It may also be partially single-sided or partially doublesided.

Furthermore, this invention contemplates that when hook and loop elements are used as surface fasteners, both hook and loop elements may be interspersed with each other on the same side.

The holder strap may be permanently secured at one end to the holder, thus making it necessary to join only one strap surface fastener to the exterior of the cylinder and also making it less likely that a person would lose the holder strap. However, when fashioned in this manner, the holder is not as neatly compacted as when the holder strap can be completely detached and then used to wrap the holder. It is therefore preferable to have a completely detachable holder strap.

The holder may also rest on the seat of the wheelchair and be attached to a side post of the wheelchair or other chair.

This is particularly useful for chairs without armrests or with armrests too narrow to support the beverage container. Also, some persons may prefer not having their drink on the armrest. The attachment is made by wrapping a holder strap horizontally, once around or in a spiral fashion, around the holder and the post to which the holder will be attached. The attachment of the holder strap to a complementary fastener on the holder secures the holder to the member. If the holder is placed on a seat or horizontal surface and attached to a vertical post, the seat or horizontal surface functions as a holder bottom. If, however, there is no horizontal surface to provide a holder bottom, a first holder strap can be used to form a holder bottom and a second holder strap can be used to secure the holder to the vertical member.

This invention may also be constructed with a non-flexible material, although it would lose compactability.

This invention also can accept hollow conical shapes such as frustoconically or conicallyshaped beverage containers, like styrofoam or paperboard coffee cups, or ice cream cones or conical shaved ice containers.

This invention also contemplates constructing the holder using disposable materials such as cardboard or plastic to form the sleeves, and straps using contact adhesives to join surfaces together. Contact adhesives are preferably two part (binary) adhesives in which the individual parts do not adhere to most materials, but adhere strongly to each other. Further, it would be within the skill of a person of ordinary skill in the art to be able to construct the embodiments of this invention out of disposable materials.

This invention also contemplates that the sleeve may be integrally formed and seamless.

This invention also contemplates forming the blank from two or more rectangular pieces of insulating or non-insulating material with one or more end surface fasteners placed at or near the ends of each piece. The pieces are joined to each other to form a rectangular blank, whose ends can be attached as described above to form a cylinder. The pieces can also be joined to each other at an angular displacement so that, when the ends are attached, a frustoconically-shaped sleeve is formed. A strap surface fastener is also preferably placed along the center of each rectangle. The holder strap attaches to complementary strap surface fasteners on each side of the sleeve.

This invention also contemplates forming a beverage sleeve to accommodate a mug handle. The sleeve may be a permanently formed cylinder of a flexible material, such as neoprene, with one or more cutouts to receive the mug handle. A person would slip the cylinder over the mug so the mug handle projects through the cutout. The sleeve may also be formed using a rectangular blank with end surface fasteners placed at or near the ends of the blank. The ends would attach to each other to form a cylinder leaving one or more cutouts to accommodate protrusion of the mug handle. Alternatively, a detachable piece of surface fastener that fits through the mug handle may be used to attach the ends of the blank. The sleeve may also consist of multiple horizontal panels joined permanently or detachably such that it could be compacted to fit through the mug handle.

This invention also contemplates placing more than two strap surface fasteners on the exterior of the holder and using more than one holder strap to form a holder bottom. This increases the surface area that attaches to the complementary fastener on a base strap.

This invention also contemplates that many holders may be joined together at the sides as modules by attaching complementary surface fasteners on either the sleeves of the holders or the holder straps to each other. For example, if one unit has a hook element on its exterior, it could be joined to another holder with a loop element on its exterior. Joining units together would allow a person to carry more than one beverage or other item at the same time. Furthermore, a person could attach more than one holder at a time to a horizontal or vertical member.

This invention contemplates that if it is desired to attach two or more units together and the units both have the hook elements on the exteriors, a mating piece of double-sided loop material can be inserted between the units. This would allow the two hook elements to be attached to either side of the loop elements on the double-sided mating piece. Also, if two units both have loop elements on the exteriors, a mating piece of double-sided hook material may be provided to allow the attachment of units.

This invention also contemplates joining one or more horizontal end surface fasteners or strap surface fasteners to the exterior of the sleeve instead of or in addition to the vertical end surface fasteners or strap surface fasteners.

This invention also contemplates placing one or more vertical, horizontal, diagonal or variably angled strips of surface fasteners on the interior of the holder to accept and secure loose ends of the holder strap(s).

This invention also contemplates placing complementary interior surface fasteners on opposite sides of the top of the interior of the holder. This would allow a person to close the holder at its top. This would be useful to persons using the holder to carry snacks, cellular phones or other miscellaneous items.

This invention contemplates joining multiple panels horizontally, diagonally, vertically, or variably angled to form the blank. The multiple panels are preferably of contrasting colors. It also contemplates placing the surface fasteners on the sleeve in horizontal, diagonal, vertical, spiral or other variably angled orientations and it contemplates that the surface fasteners may be of various numbers of shapes or sizes to create a myriad of designs on the sleeve. It also contemplates cutouts of various numbers of shapes or sizes in the sleeve. Further, it contemplates appliques of various numbers of shapes or sizes on the sleeve. For example, a sleeve may be personalized to display a person's initials through the use of cutouts, multiple panels, embroidery or applique.

This invention also contemplates that with regard to the surface fasteners, the holder strap may be entirely single-sided or double-sided or may be partially single or partially double-sided. Furthermore, the holder straps may be padded to provide comfort to a person who is hanging the holder around his or her neck and shoulder. It is also contemplated that logos and advertising indicia may be placed on the holder straps.

This invention also contemplates using the holder with a belt clip on which a surface fastener is mounted.

This invention also contemplates that the holder may be sold in piecemeal fashion to enable a user to mix and match colors and designs. It also contemplates that the sleeve may be sold without the holder straps for those who already have holder straps from prior purchases of the complete holder. Furthermore, in particular regard to disposable embodiments of the invention, it is contemplated that holder straps with surface fasteners on each end, particularly those with adhesive backings, may be sold separately from the holder of this embodiment. In addition, the holder straps may be used to provide an attachment means for any holders without such means of attachment.

This invention contemplates an embodiment in which either the top or the bottom surface of a single blank may form an exterior surface of the holder. In other words, two different exterior surfaces may be formed from the same blank by moving a first end clockwise or counterclockwise with respect to a second end until the ends are joined. This invention further contemplates that the blank used to construct the hollow sleeve of the holder may contain colors, prints, logos, appliques, advertising indicia or other creative designs on both surfaces. This would allow a user to vary the look of the holder much as a person may wear a shirt inside out for a different look.

This invention contemplates that when the sleeve is formed of an insulating material such as neoprene, holding a cold beverage such as a soda can or fountain-drink cup becomes much more comfortable to hold; a person's hands would not feel the ice-coldness of the drink. Furthermore, the sleeve serves as a barrier between the condensation on the container and the person, thus keeping a person's hands dry.

It is also contemplated that this invention would be particularly beneficial to men who, unlike women, do not have handbags in which to put their belongings. Because of this invention's light weight and compactability, men could handily keep the invention in their shirt or pants pocket, ready for use at anytime.

BRIEF DESCRIPTION OF DRAWINGS

FIG. 1 is a top plan view of a blank for a holder according to the present invention before the ends are sewn together to form a cylinder.

FIG. 2 is a top plan view of a holder strap for use with the cylinder of FIG. 1.

FIG. 6 is a side elevational view of the holder with the holder strap of FIG. 2 attached to form a loop at the bottom end of the cylinder.

FIG. 7 is a side elevational view of the cylinder with the holder strap of FIG. 2 extending beyond the top of the cylinder.

FIG. 12A is a top plan view of a base strap that is used to wrap around a horizontal member for use as illustrated in FIG. 14.

FIG. 13 is a top plan view of a double-sided holder strap, with surface fasteners on both the top and bottom surface, for use with the holder according to the present invention and as shown in FIG. 14.

FIG. 14 illustrates a method by which the holder bottom according to the present invention attaches to a base strap in order to secure the holder to a horizontal member.

FIG. 15 illustrates how a loose end of a holder strap may be tucked inside the holder according to the present invention.

FIG. 35 differs from FIG. 33 in that in FIG. 35, a bottom for the holder is formed before the holder is attached to the vertical member. In FIG. 33, the cylinder is attached before the holder bottom is formed.

FIG. 44 shows two holders attached to a horizontal member and joined together to hold a beverage and a pair of eyeglasses according to the present invention.

FIG. 45 is a front elevational view of the cylinder with four strap surface fasteners joined vertically to the cylinder.

FIG. 46 is a top plan view of two holder straps for use with the cylinder of FIG. 45.

FIG. 47 is a bottom plan view of the holder according to the present invention, after the holder straps of FIG. 46 were attached to the cylinder of FIG. 45.

FIG. 48 is a side elevational view of the cylinder of FIG. 3 with surface fasteners placed at the top of the interior of the cylinder.

FIG. 93 is a front elevational view of the blank of FIG. 90 after the ends were joined together to form a truncated-conical (frustoconical) sleeve.

FIG. 94 is a holder strap which is complementary to the surface fastener on the blank of FIG. 90.

FIG. 95 is an elevational view of the cylinder of FIG. 92 attached to a horizontal member by means of the holder strap of FIG. 94. It should be noted that the holder strap may attach anywhere to the exterior surface of the holder.

FIG. 96 is an elevational view of the frustoconical sleeve of FIG. 93 attached to a vertical member by means of a complementary mounting surface fastener mounted to the vertical member. It should be noted that the complementary mounting surface fastener may attach anywhere to the exterior surface of the holder.

FIG. 97 is an elevational view of the frustoconical sleeve of FIG. 93 attached to a vertical member by means of the holder strap of FIG. 94 horizontally wrapped around it. It should be noted that the strap may attach anywhere to the exterior surface of the holder.

FIG. 98 is a top plan view of a blank according to the present invention before being joined at the ends to form a cylinder or a frustoconical sleeve.

FIG. 99 is a bottom plan view of the blank of FIG. 98.

FIG. 100 is a front elevational view of FIG. 98 after the end surface fasteners were joined together to form a cylindrical sleeve.

FIG. 101 is a side elevational view of FIG. 100.

FIG. 102 is a front elevational view of the blank of FIG. 98 after the end surface fasteners were joined together frustoconical sleeve.

FIG. 103 is a side elevational view of FIG. 102.

FIG. 104 is a plan view of a blank according to the present invention before being joined at the ends to form a cylinder or a frustoconical sleeve.

Figure 104:
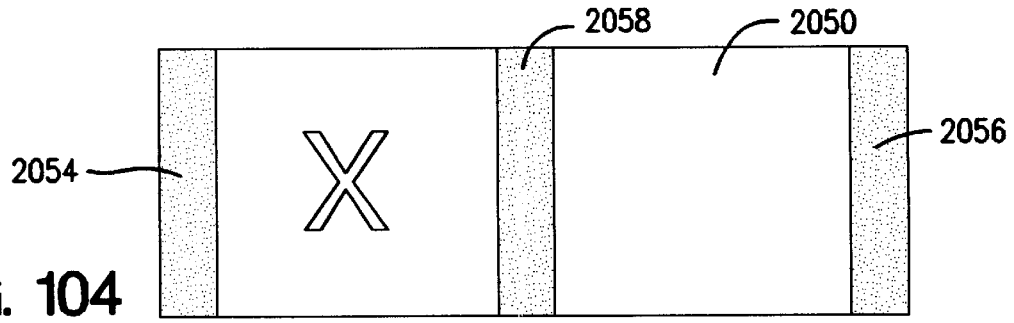
Figure 105:
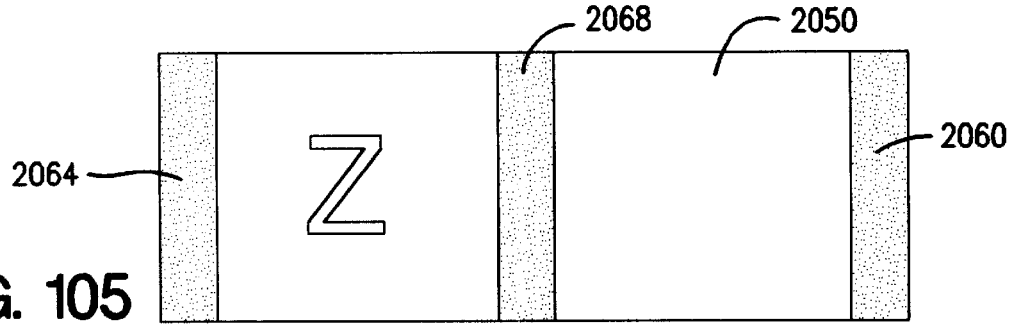

FIG. 105 is a bottom plan view of the blank of FIG. 104.

Figure 106:
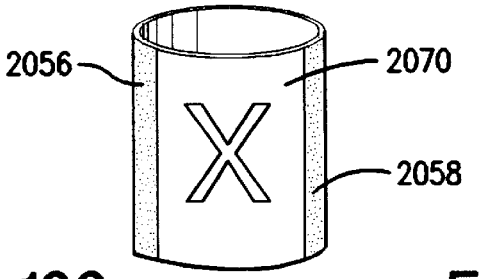

FIG. 106 is a front elevational view of the blank of FIGS. 104 and 105 after the end surface fasteners were joined together to form a cylindrical sleeve with the front surface of the blank as shown in FIG. 104 forming the exterior of the sleeve.

Figure 107:
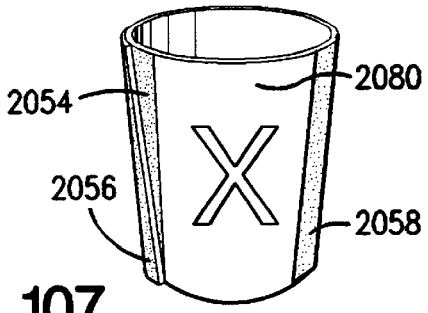

FIG. 107 is a front elevational view of the blank of FIGS. 104 and 105 after the surface fasteners were joined together to form a frustoconical sleeve with the front surface of the blank as shown in FIG. 104 forming the exterior of the sleeve.

Figure 108:
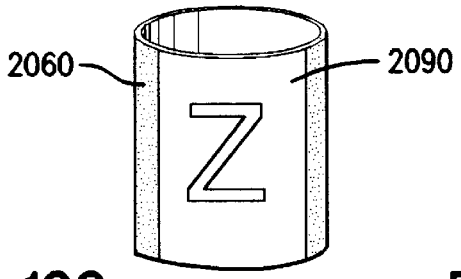

FIG. 108 is a front elevational view of the blank of FIGS. 104 and 105 after the end surface fasteners were joined together to form a cylindrical sleeve with the bottom surface of the blank as shown in FIG. 105 forming the exterior of the sleeve.

Figure 109:
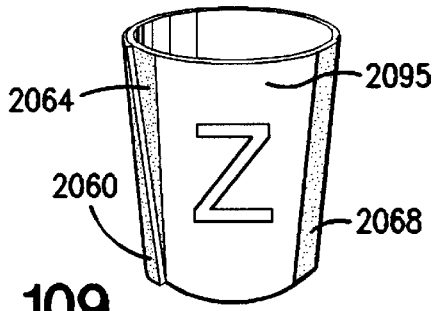

FIG. 109 is a front elevational view of the blank of FIGS. 104 and 105 after the end surface fasteners were joined together to form a frustoconical sleeve with the bottom surface of the blank as shown in FIG. 105 forming the exterior of the sleeve.

FIGS. 104–109 illustrate an embodiment in which either the top or the bottom surface of a blank may form the exterior surface of the sleeve, thus allowing for two different exterior surfaces from the same blank.

Figure 110:
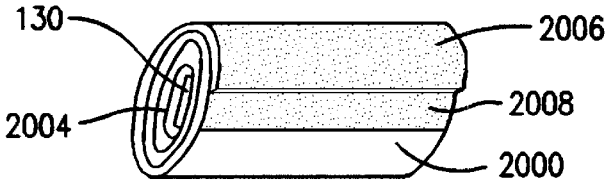

FIG. 110 illustrates the holder according to this present invention rolled and compacted in a jellyroll-like fashion with the holder strap contained in the middle of the "roll." The attachment of an end surface fastener to a strap surface fastener placed between the ends of the blank provide the means by which the holder is maintained in a compacted state. Note that the end surface fastener and the strap surface fastener that attaches to it are on opposite surfaces of the blank.

Figure 111:
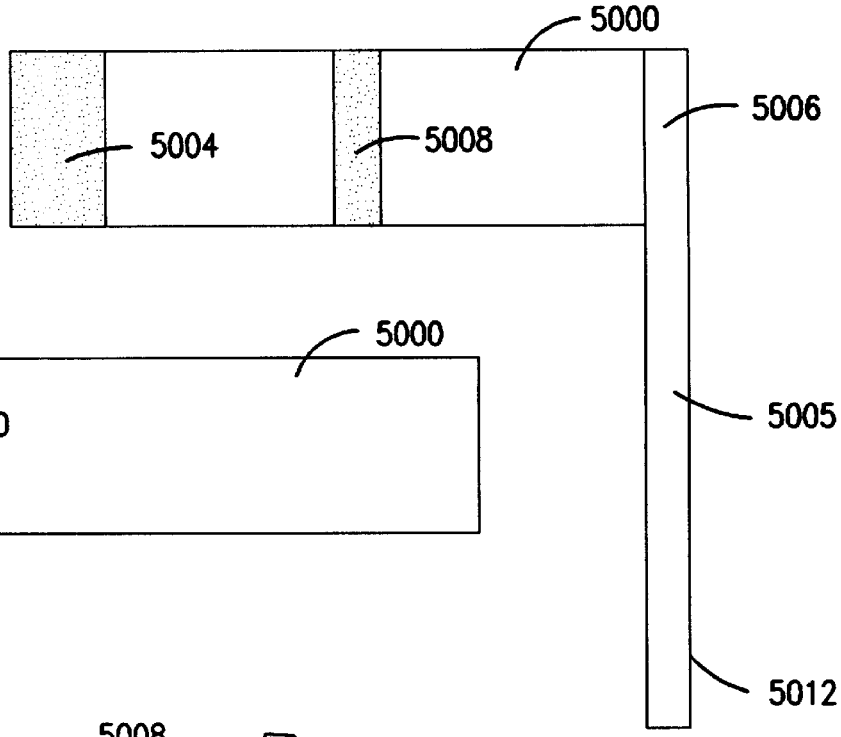

FIG. 111 is a top plan view of a blank according to the present invention before being joined at the ends to form a cylinder or a frustoconical sleeve.

Figure 112:
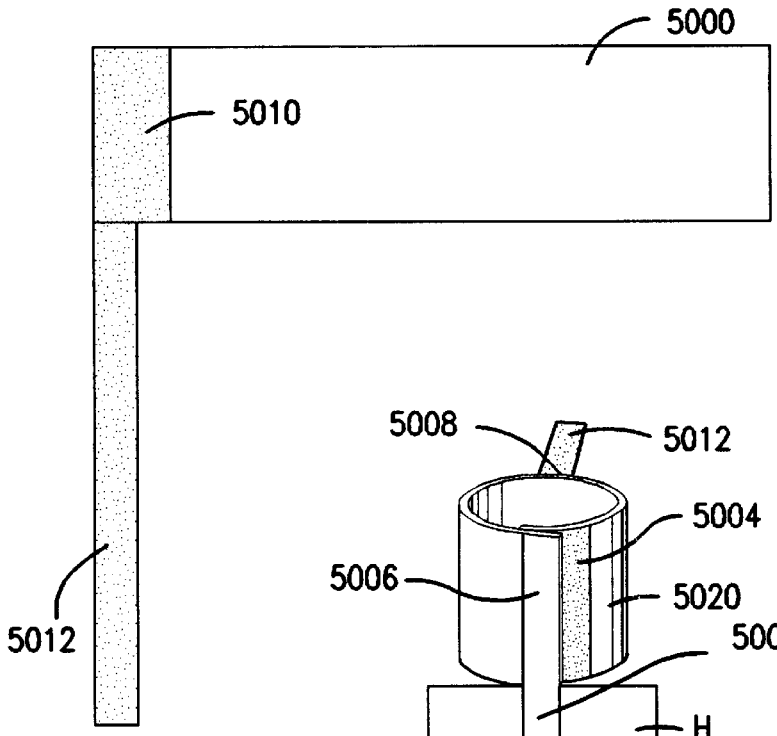

FIG. 112 is a bottom plan view of the blank of FIG. 111.

Figure 113:
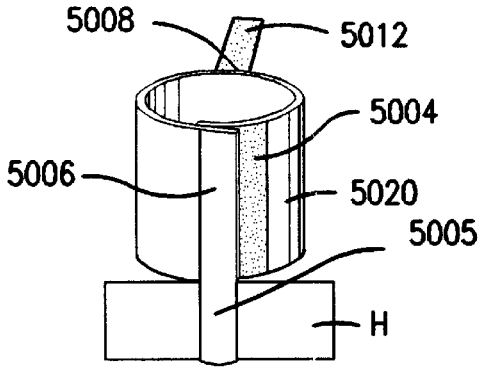

FIG. 113 is a side elevational view of FIG. 111 after the end surface fasteners were joined together to form cylindrical sleeve and the sleeve is then attached to a horizontal member.

Figure 114:
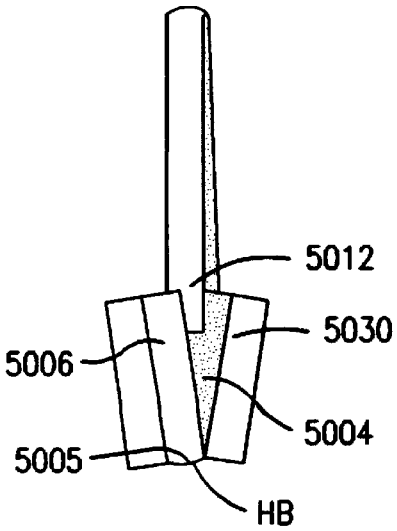

FIG. 114 is a side elevational view of the blank of FIG. 111 after the end surface fasteners were joined together to form a frustoconical sleeve and a loop is formed with the holder strap attached to the sleeve.

Figure 115:
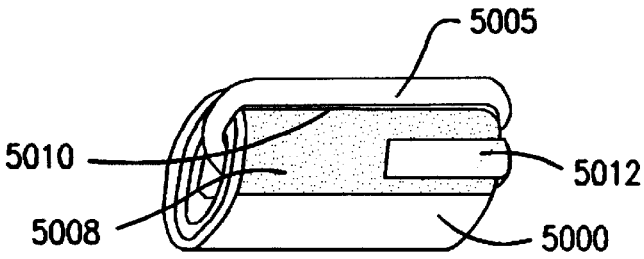

FIG. 115 illustrates the holder according to this present invention rolled and compacted in a jellyroll-like fashion with the holder strap contained in the middle of the "roll." The attachment of an end surface fastener to a strap surface fastener placed between the ends of the blank provide the means by which the holder is maintained in a compacted state.

BEST MODES FOR CARRYING OUT INVENTION

The presently preferred best modes for carrying out the present invention are illustrated by way of example in FIGS. 1 to 115.

Figure 3:
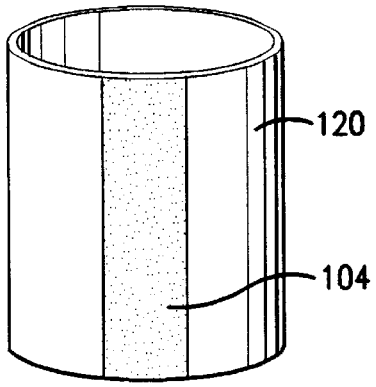
FIG. 3 is a front elevational view of the blank of FIG. 1 after being sewn together.
Figure 4:
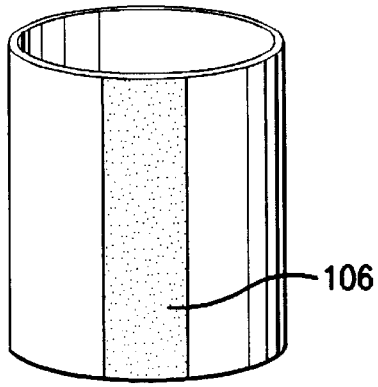
FIG. 4 is a rear elevational view of the blank of FIG. 1 after being sewn together.

Referring to FIG. 1, shown is a top plan view of a blank 100, preferably made of an insulating or non-insulating material, such as rubber, leather or neoprene. Two strap surface fasteners 104 and 106 are preferably permanently attached across the width of the blank 100 and spaced apart by approximately half the length of the blank. Preferably, the blank has a width of approximately 4¼" (10.8 cm) and length of approximately 9¼" (23.5 cm). The ends 112 and 114 are preferably permanently joined together to form a cylinder 120, as shown in FIGS. 3 and 4. Preferably, the strap surface fasteners 104 and 106 have widths of approximately 1" (2.54 cm).

Referring to FIG. 2, shown is a top plan view of a holder strap 130 of which the entire surface is a surface fastener, which is complementary to strap surface fasteners, 104 and 106 of FIG. 1.

Figure 5:
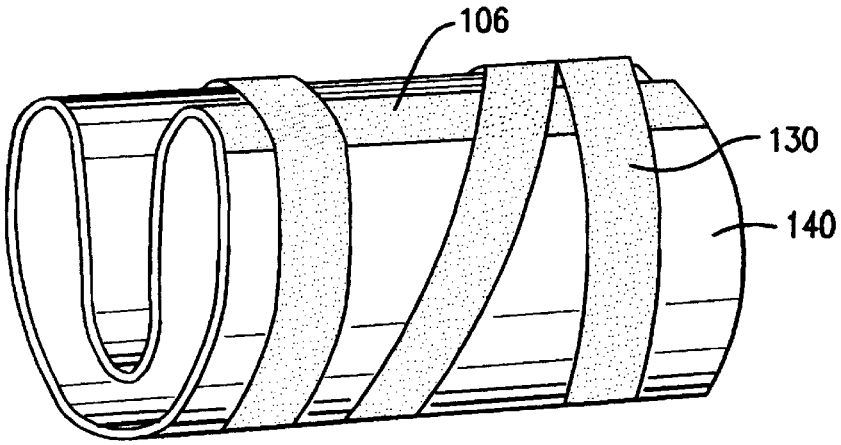
FIG. 5 is a front perspective view of a holder according to the present invention, compacted and retained in the compacted configuration by the holder strap of FIG. 2.

Referring to FIG. 5, the cylinder 120 of FIGS. 3 and 4 is compacted and retained in the compacted configuration 140 by the holder strap 130 of FIG. 2.

Figure 1A:
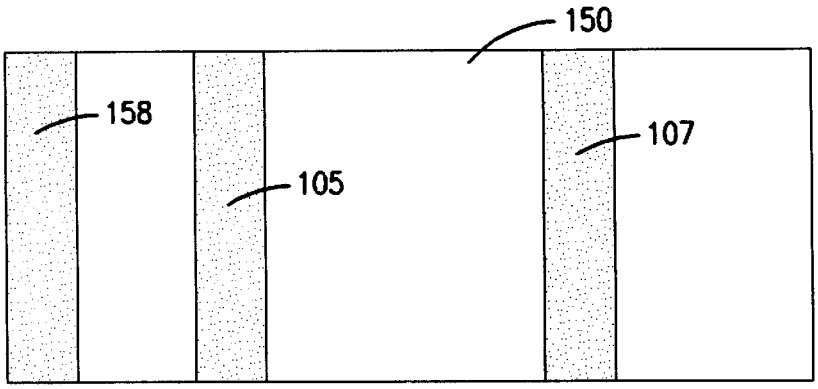
FIG. 1A is a to plan view of a blank according to another embodiment of the present invention with detachably attachable ends before being joined at the ends to form a cylinder.

Referring to FIG. 1A, shown is a top plan view of a blank 150, preferably made of an insulating or non-insulating material, such as rubber, leather or neoprene. Two strap surface fasteners 105 and 107 are preferably permanently attached across the width of the blank 100 and spaced apart by approximately half the length of the blank. An end surface fastener 158 is preferably permanently attached at one end and across the width of the blank 150.

Figure 1B:
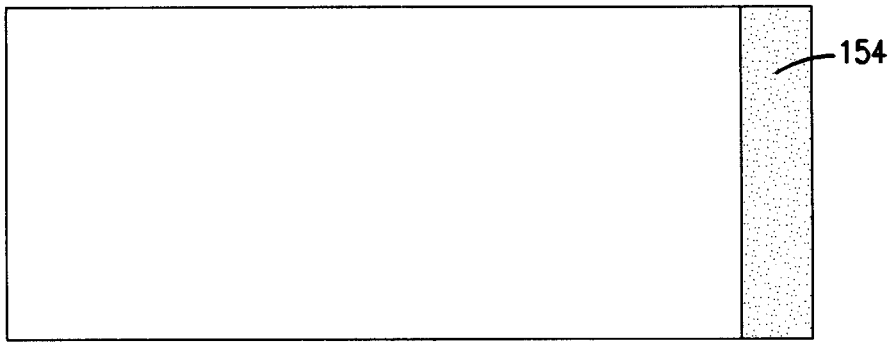
FIG. 1B is a bottom plan view of the blank of FIG. 1A before being joined at the ends to form a cylinder.
Figure 1C:
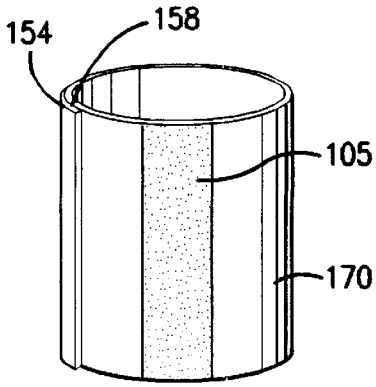
FIG. 1C is a front elevational view of the blank of FIG. 1A after the end surface fasteners are joined together.

Referring to FIG. 1B, shown is a bottom plan view of blank 150. An end surface fastener 154 is preferably permanently attached at the end opposite from end surface fastener 158 and across the width of blank 150. Preferably, end surface fastener 154 is complementary to end surface fastener 158. Preferably, the blank has a width of approximately 4¼" (10.8 cm) and length of approximately 10¼" (26 cm). Preferably, end surface fasteners 158 and 154 and strap surface fasteners 105 and 107 have widths of approximately 1" (2.54 cm). The end surface fasteners 154 of FIG. 1B and 158 of FIG. 1A are joined together to form a cylinder 170 as shown in FIG. 1C.

Figure 4A:
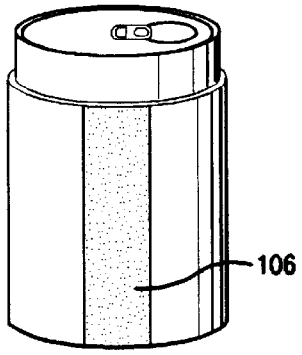
FIG. 4A illustrates a cylindrical beverage container fitting snugly in the sleeve of FIG. 4. The sleeve is made of a flexible stretchable material.

FIG. 4A illustrates a cylindrical beverage container fitting snugly in the sleeve of FIG. 4. The sleeve is made of a flexible stretchable material.

Figure 4B:
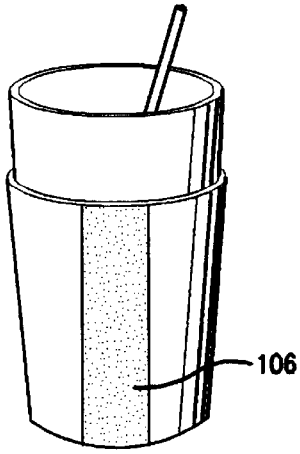
FIG. 4B illustrates a truncated-conical (frustoconical) beverage container fitting snugly in the sleeve of FIG. 4. The sleeve is made of a flexible stretchable material.

FIG. 4B illustrates a truncated-conical (frustoconical) beverage container fitting snugly in the sleeve of FIG. 4. The sleeve is made of a flexible stretchable material.

Referring to FIG. 6, shown is a side elevational view of a cylinder 120 of FIGS. 3 and 4 with a holder strap 130 of FIG. 2 attached to complementary strap surface fasteners 104 and 106 to form a loop under the bottom of the cylinder. The loop is formed to attach the cylinder 120 to horizontal members between the bottom of the cylinder and the bottom of the loop. The holder strap 130 may extend beyond the top of the cylinder 120, as shown in FIG. 7, to allow for hanging the holder or it may be cut to a level even with the top of the cylinder as shown in FIG. 6.

Figure 8:
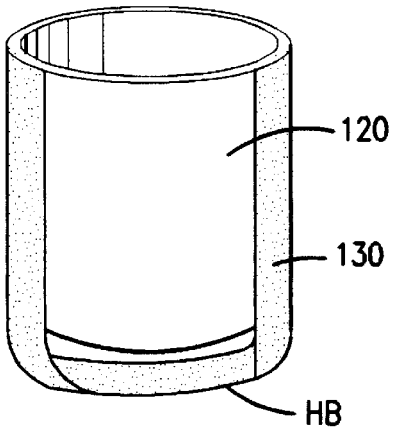
FIG. 8 is a side elevational view of the cylinder with the holder strap of FIG. 2 forming a holder bottom for the cylinder to hold a beverage container.

Referring to FIG. 8, shown is a side elevational view of a cylinder 120 of FIGS. 3 and 4, with a holder strap 130 of FIG. 2 forming a holder bottom HB for the cylinder 120.

Figure 9:
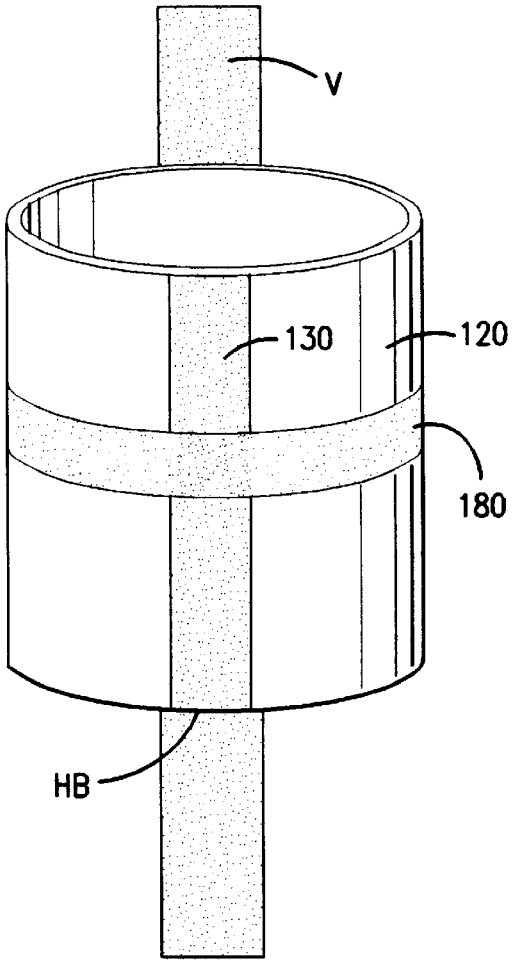
FIG. 9 is a front elevational view of a holder according to the present invention, secured to a vertical member.

Referring to FIG. 9, shown is a front elevational view a cylinder 120 of FIGS. 3 and 4 attached to a vertical member V. A first holder strap 130 of FIG. 2 forms a holder bottom HB for the cylinder. A second holder strap 180 of FIG. 9A, attaches to complementary first holder strap 130 and wraps horizontally around the cylinder 120 and the vertical member V. It is preferable that first holder strap 130 is double-sided to allow attachment to both the cylinder 120 and second holder strap 180. It is also preferable that second holder strap 180 be double-sided so that one end 184 may attach to a complementary surface fastener on the other end 188 after wrapping around the vertical member V.

Figure 9A:
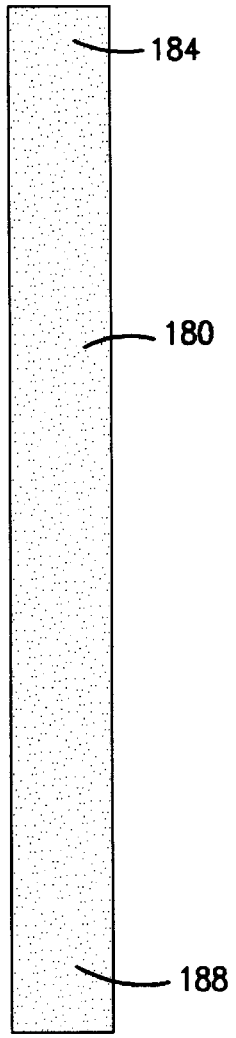
FIG. 9A is a top plan view of a holder strap for use with the holder of FIG. 9, to secure the holder to a vertical member.
Figure 9B:
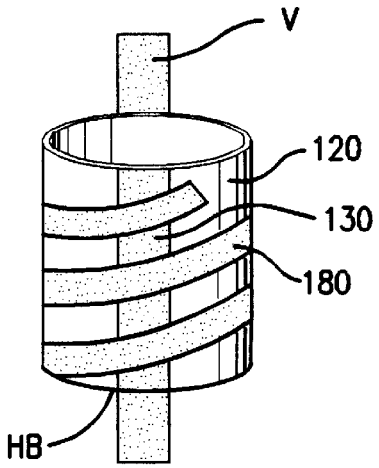
FIG. 9B illustrates the holder according to the present invention, attached to a vertical member with a holder strap wrapped around the holder and the vertical member in a spiral fashion.

Referring to FIG. 9B, shown is a front elevational view a cylinder 120 of FIGS. 3 and 4 attached to a vertical member V. A first holder strap 130 of FIG. 2 forms a holder bottom HB for the cylinder. A second holder strap 180 of FIG. 9A, attaches to complementary first holder strap 130 and wraps spirally around the cylinder 120 and the vertical member V. It is preferable that first holder strap 130 is double-sided to allow attachment to both the cylinder 120 and second holder strap 180.

Figure 10:
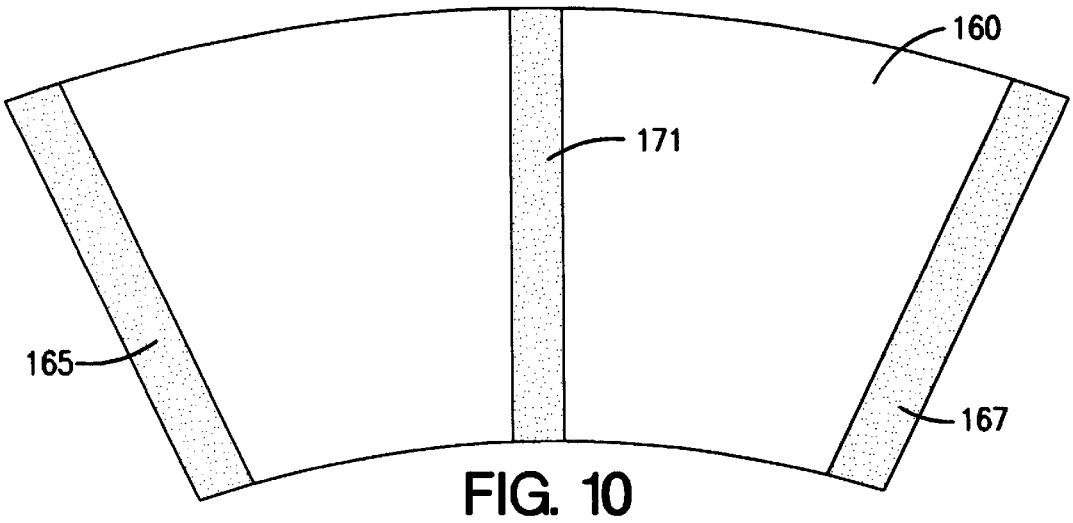
FIG. 10 is a top plan view of a blank according to the present invention before joined together by surface fasteners to form the truncated conical sleeve in FIG. 10B.

Referring to FIG. 10, shown is a top plan view of a blank 160, preferably made of an insulating or non-insulating material, such as rubber, leather or neoprene. A first end surface fastener 165 is preferably permanently attached at an end and across the width of the blank 160. A first strap surface fastener 167 is preferably permanently attached at the opposite end and across the width of the blank 160. A second strap surface fastener 171 is preferably permanently attached at approximately the center and across the width of the blank 160.

Figure 10A:
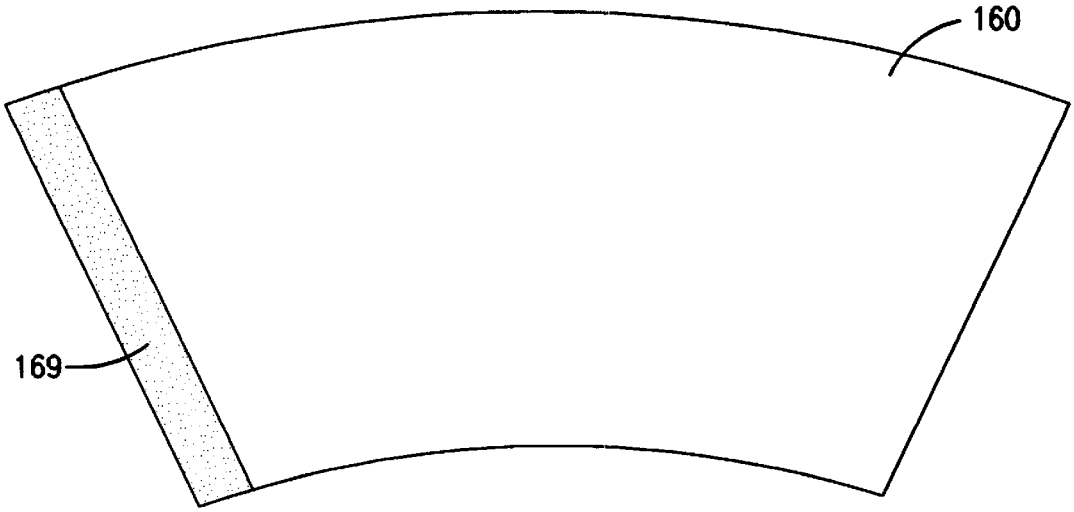
FIG. 10A is a bottom plan view of the blank of FIG. 10 before being joined together by surface fasteners to form the truncated conical sleeve in FIG. 10B.

FIG. 10A shows a bottom plan view of the blank 160 of FIG. 10. A second end surface fastener 169 is placed at the same end but on the opposite surface from first strap surface fastener 167. Preferably second end surface fastener 169 is complementary to first end surface fastener 165.

Figure 10B:
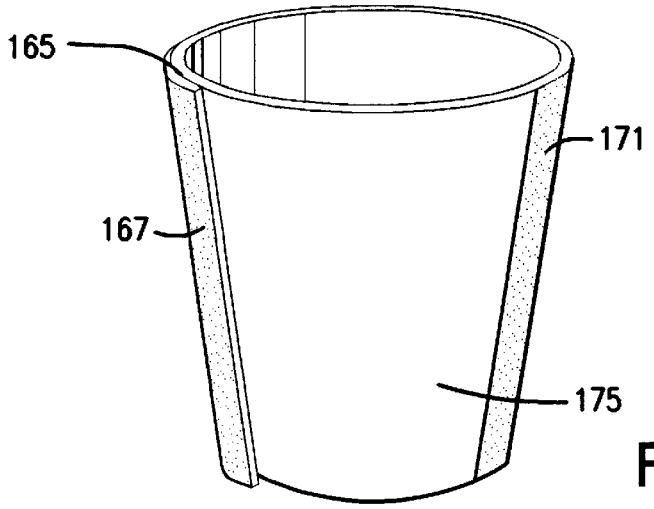
FIG. 10B is a front elevational view of an embodiment of the present invention with a truncated conical shape.

Referring to FIG. 10B, the end surface fasteners 165 and 169 of FIGS. 10 and 10A are joined together to form a frustoconical sleeve 175.

Figure 11:
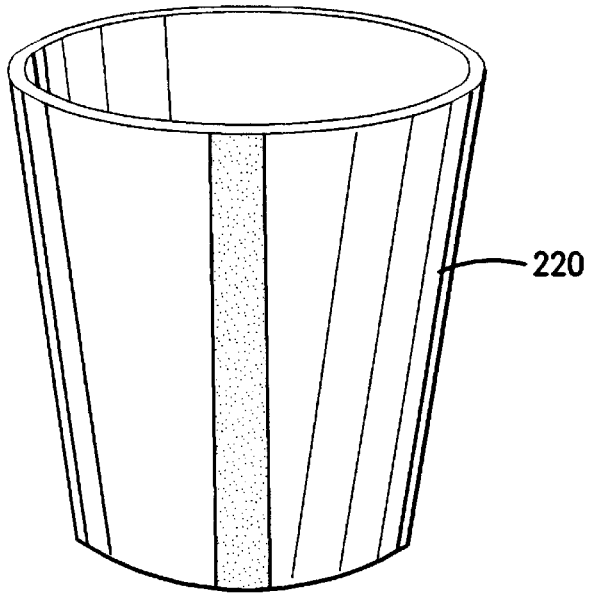
FIG. 11 is a front elevational view of an embodiment of the present invention with a truncated conical shape.
Figure 12:
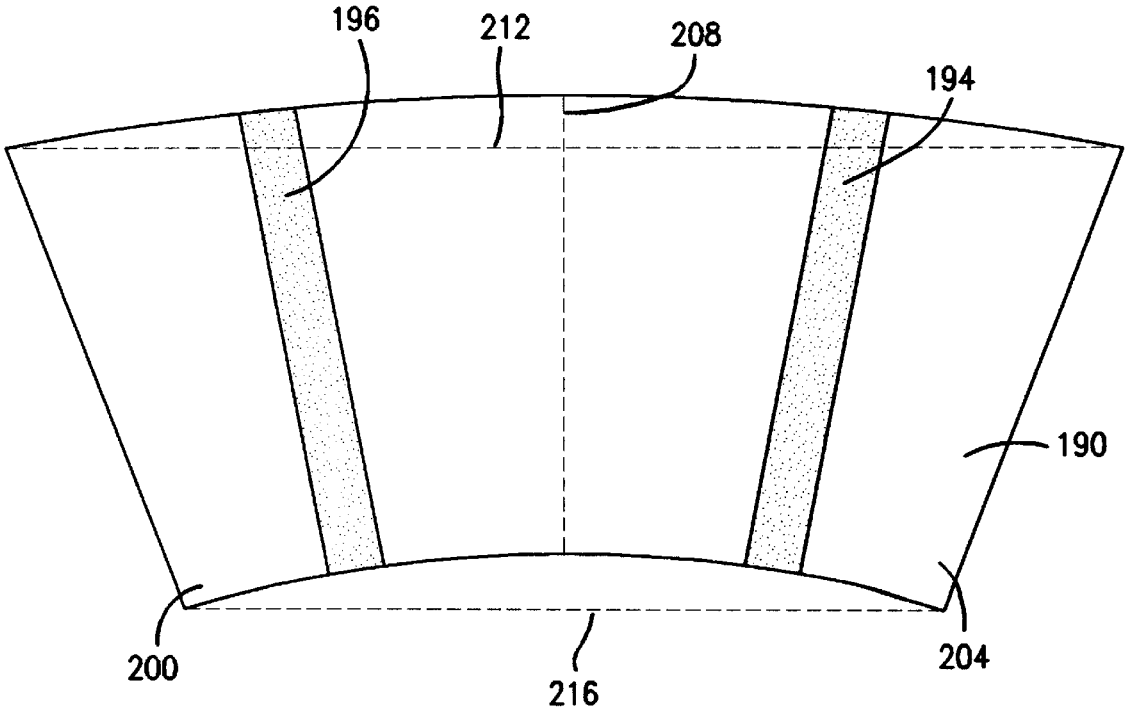
FIG. 12 is a top plan view of a blank according to the present invention before being sewn or joined together by surface fasteners to form the truncated conical sleeve in FIG. 11.

Referring to FIG. 11, shown is a frustoconical sleeve 220 formed by the blank 190 of FIG. 12 after the ends 200 and 204 are preferably permanently joined together.

Referring to FIG. 12, shown is a top plan view of a blank 190, preferably made of an insulating or non-insulating material, such as rubber, leather or neoprene. Two strap surface fasteners 196 and 194 are preferably permanently attached across the blank 190, preferably equidistant from the center 208 of the blank and the blank's edges 200 and 204. Preferably, the blank has a top width 212 of approximately 10¼" (26 cm), a bottom width 216 of approximately 7" (17.8 cm) and a height 208 of approximately 4½" (11.4 cm). The ends 200 and 204 are preferably permanently joined together to form a frustoconical sleeve 220, as shown in FIG. 11.

Referring to FIG. 12A, shown is a top plan view of a base strap 240 preferably made of a strip of strong fabric (such as nylon) for use in cooperation with a holder. Two surface fasteners 244 and 248 are preferably permanently attached at each end of the base strap. Preferably, a rectangular surface fastener 252 is preferably permanently attached at the approximate center of the base strap. Preferably, both the height and width of the surface fastener 254 are approximately 2¾" (7 cm). Preferably the width of the base strap is approximately 2¾" (7 cm).

Referring to FIG. 13, shown is a top plan view of a double-sided holder strap 260, preferably with the top and bottom surface fasteners complementary to each other.

Referring to FIG. 14, shown is a method to attach the holder bottom HB according to this present invention to a horizontal member H, such as a chair arm. The base strap is wrapped around a horizontal member H with the surface fastener 252 facing upward to attach to the holder bottom HB. The holder is formed by attaching the double-sided holder strap 260 of FIG. 13 to two complementary strap surface fasteners 104 and 106 on the cylinder 120 of FIGS. 3 and 4. A middle portion of holder strap 260 forms a holder bottom HB when attached to the sleeve. The holder bottom HB of the cylinder is then attached to a complementary surface fastener 252 on the base strap shown in FIG. 12A. The base strap of FIG. 12A is secured tightly to the horizontal member H by attaching a surface fastener 244 at one end of the base strap to a complementary surface fastener 248 at the other end of the base strap.

Referring to FIG. 15, shown is the excess of a detachable strap 130 of FIG. 2 tucked into the inside of cylinder 120 of FIGS. 3 and 4.

Figure 16:
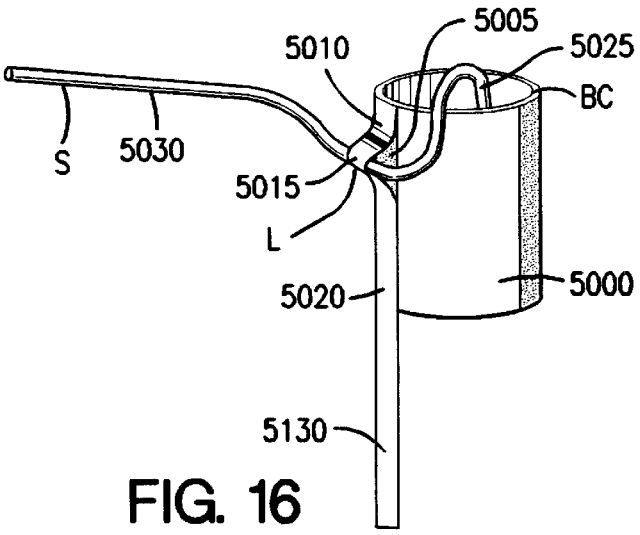
FIG. 16 illustrates a method by which the holder according to the present invention secures a sipping tube to the holder so that the end of the tube will not slip out of the beverage container. A loop through which the sipping tube passes, is formed by the holder strap as it attaches to a strap surface fastener on the holder. A middle portion of the holder strap is left unattached to the strap surface fastener and thus forms a small loop.

Referring to FIG. 16, one end 5010 of a holder strap 5130 attaches to a strap surface fastener 5005 on sleeve 5000. A portion 5015 of the holder strap forms a loop L by remaining unattached to the strap surface fastener 5005. A remaining portion 5020 of the holder strap which is adjacent to portion 5015 attaches back to the remaining portion of strap surface fastener 5005 to close the loop L. An end 5025 of a long sipping tube S extends from a beverage container BC contained by sleeve 5000. The sipping tube S then passes through and is secured in place by the loop L. The remaining length 5030 of the sipping tube S may pass to the person who will sip the beverage.

Figure 17:
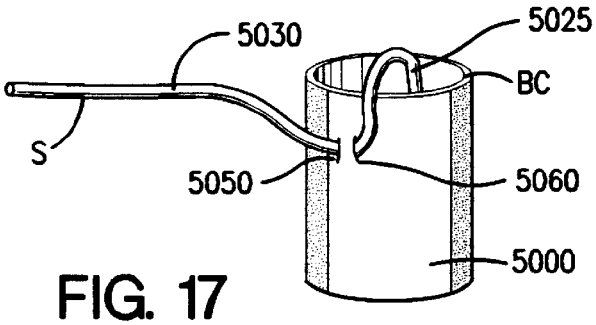
FIG. 17 illustrates a method by which the holder according to the present invention secures a sipping tube to the holder so that the end of the tube will not slip out of the beverage container. Two apertures, through which the sipping tube passes, hold the sipping tube in place.

Referring to FIG. 17, two apertures 5050 and 5060 are cut in the sleeve 5000. An end 5025 of a long sipping tube S extends from a beverage container BC contained by sleeve 5000. The sipping tube S then enters aperture 5060 from the outside surface of the sleeve 5000 and exits through aperture 5050 from the inside surface of the sleeve 5000. Passing through these two apertures secures the sipping tube S in place so that it will not slip out of the beverage container. The remaining length 5030 of the sipping tube S may pass to the person who will sip the beverage.

Figure 18:
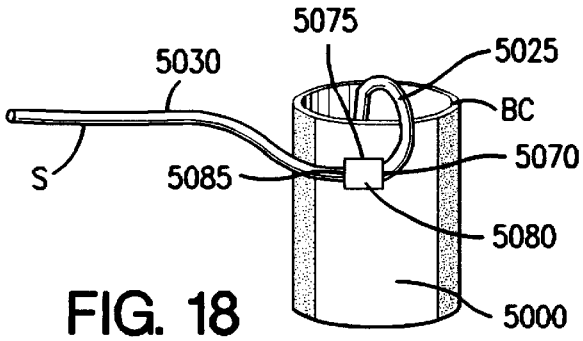
FIG. 18 illustrates a method by which the holder according to the present invention secures a sipping tube to the holder so that the end of the tube will not slip out of the beverage container. A piece of preferably flexible, stretchable material is joined to the holder (by sewing or with surface fasteners) with opening between the piece of material and the sleeve left through which the sipping tube passes.

Referring to FIG. 18, a piece 5070 of preferably flexible, stretchable material is joined (preferably by sewing or with surface fasteners) to the sleeve 5000 at two ends 5075 and 5080. An opening 5085 through which a sipping tube may pass is left between the piece 5070 and the sleeve 5000. An end 5025 of a long sipping tube S extends from a beverage container BC contained by sleeve 5000. The sipping tube S then passes through and is secured in place by the opening 5085. The remaining length 5030 of the sipping tube S may pass to the person who will sip the beverage.

Figure 19:
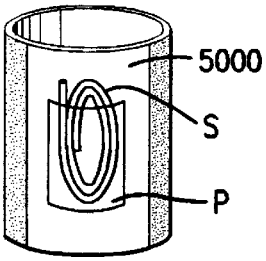
FIG. 19 illustrates a pouch formed on the sleeve to store a sipping tube. The pouch is formed by joining (by sewing or with surface fasteners) a piece of preferably flexible, stretchable material to the sleeve.

Referring to FIG. 19, a pouch P, preferably made of a flexible, stretchable material is joined(preferably by sewing or with surface fasteners) to the sleeve 5000. A sipping tube S is wrapped up and stored in the pouch P. Note that this pouch P may be joined to either the exterior or the interior of the sleeve 5000 and may be used to hold miscellaneous small items besides a sipping tube. Further, advertising, logos and other indicia may be displayed on the pouch.

Figure 20:
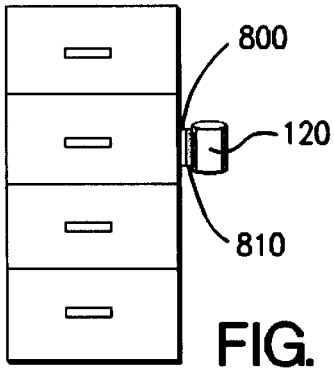
FIG. 20 illustrates the holder according to the present invention, attached to a filing cabinet using a mounting surface fastener joined to a magnet.
Figure 21:
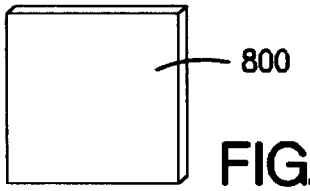
FIG. 21 is a top plan view of a blank made of a magnetic material.

Referring to FIG. 20, a cylinder 120 of FIGS. 3 and 4 is held to a filing cabinet by attaching to a complementary mounting surface fastener 810 joined to a magnet 800 of FIG. 21.

Referring to FIG. 21, shown is a top plan view of a blank 800 preferably made of a flexible, magnetic material.

Figure 22:
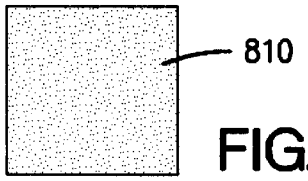
FIG. 22 is a top plan view of a mounting surface fastener before it is preferably permanently joined to the blank of FIG. 24A.

Referring to FIG. 22, shown is piece of surface fastener before it is preferably permanently joined to the blank 800 of FIG. 21.

Figure 23:
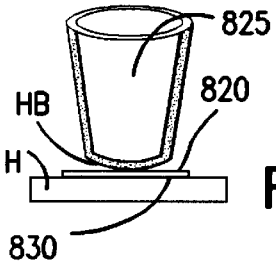
FIG. 23 illustrates the attachment of the holder bottom to a horizontal surface using a mounting surface fastener mounted with an adhesive on the horizontal surface.
Figure 24:
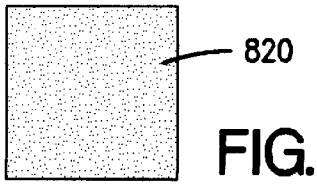
FIG. 24 is a top plan view of the mounting surface fastener of FIG. 23.
Figure 24A:
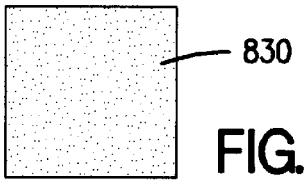
FIG. 24A is a bottom plan view of the mounting surface fastener of FIG. 23. An adhesive covers the bottom of the surface fastener.

Referring to FIG. 23, the holder bottom HB of a frusto-conical holder 825 is attached to a horizontal surface by attaching to a complementary mounting surface fastener 820 of FIG. 24 mounted on the horizontal surface using an adhesive 830 of FIG. 24A.

FIG. 24 is a top plan view of a mounting surface fastener 820.

FIG. 24A is a bottom plan view of the mounting surface fastener of FIG. 23. An adhesive 830 covers the bottom of the mounting surface fastener.

Figure 25:
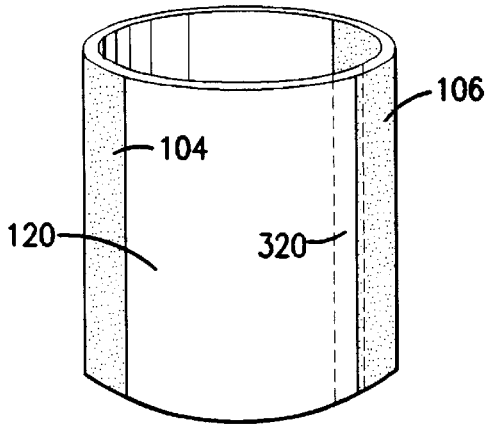
FIG. 25 is a side elevational view of the cylinder with a surface fastener joined to the interior of the cylinder and aligned with a strap surface fastener on the exterior, for use in FIG. 26.

Referring to FIG. 25, shown is a side elevational view of the cylinder with an interior surface fastener 320 preferably permanently joined to the interior of the cylinder and aligned with a strap surface fastener 106 of FIG. 1.

Figure 26:
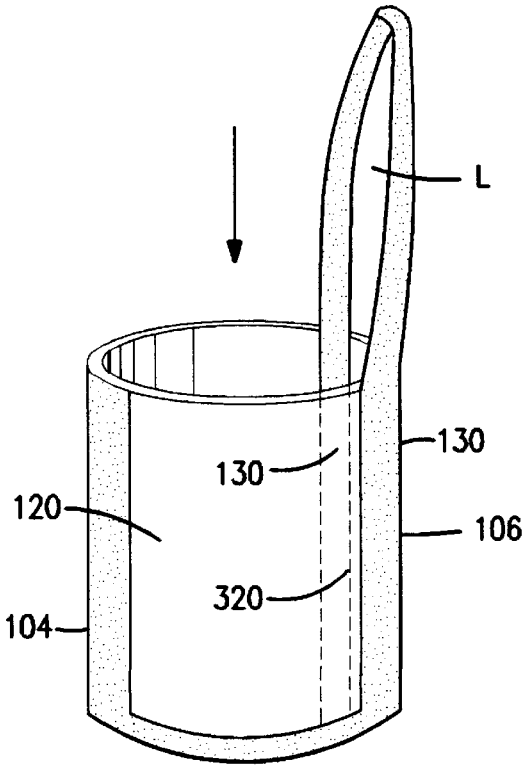
FIG. 26 is a side elevational view of the holder according to the invention, having a single loop formed by attaching the loose end of the holder strap of FIG. 2 to the fastener joined to the interior of the cylinder as shown in FIG. 25.

Referring to FIG. 26, a holder strap 130 of FIG. 2 attaches to complementary strap surface fasteners 104 and 106 on cylinder 120 of FIGS. 3 and 4 and forms a loop L by attaching one end to a complementary interior surface fastener 320 of FIG. 25.

Figure 27:
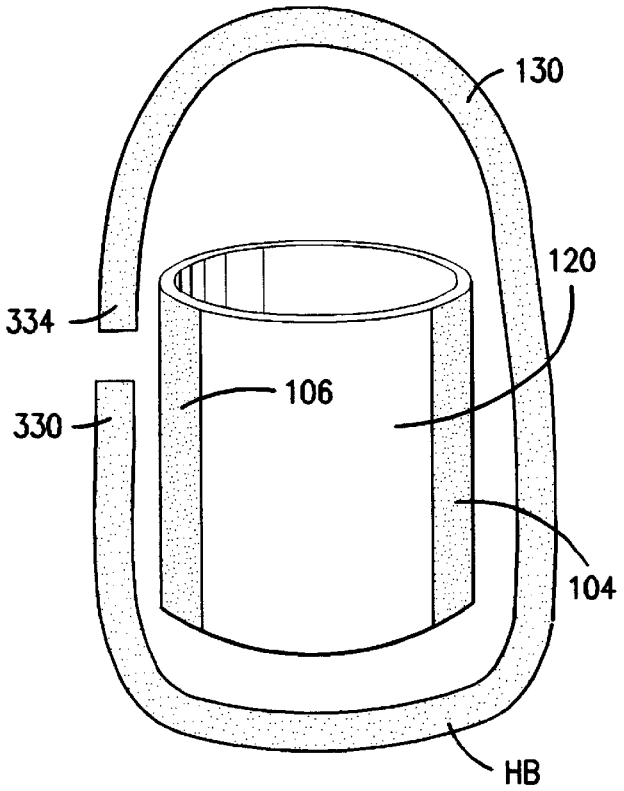
FIG. 27 shows the holder strap prior to attaching to a cylinder to form a loop for the holder as shown in FIG. 28.
Figure 28:
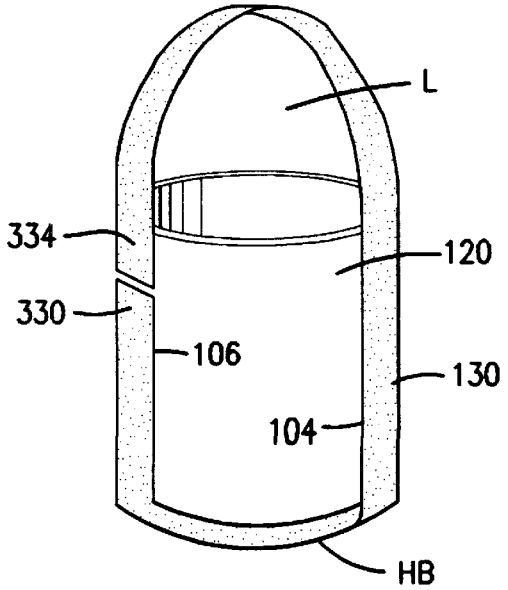
FIG. 28 shows the holder according to the present invention with a loop for hanging by the means depicted in FIG. 27.

Referring to FIG. 27, shown is a side elevational view of a cylinder 120 of FIGS. 3 and 4 and a holder strap 130 of FIG. 2 prior to attaching to complementary strap surface fasteners 104 and 106 of FIG. 1. A loop is formed by first attaching one end 330 of the holder strap 130 of FIG. 2 to a complementary strap surface fastener 106 on the cylinder. After looping under the cylinder to form a holder bottom HB, the holder strap 130 attaches to a complementary strap surface fastener 104 on the opposite side of the cylinder. The loose end 334 of the holder strap 130 then attaches to a complementary strap surface fastener 106 on the side where the holder strap 130 was first attached. This holder strap 130 may be a partially or entirely single-sided or double-sided surface fastener or it may be a flexible strip of material with surface fasteners at the ends. If the holder strap 130 is double-sided, the free end 334 may attach to a complementary fastener on the end 330 that was first attached to the cylinder instead of attaching to a complementary strap surface fastener 106 on the cylinder. The formed loop L is shown in FIG. 28. It should be noted that if the holder strap 130 is hung around a person's neck or from a person's shoulder, for comfort it is preferably a loop element surface fastener and the strap surface fasteners on the cylinder 120 are preferably hook elements.

Figure 29:
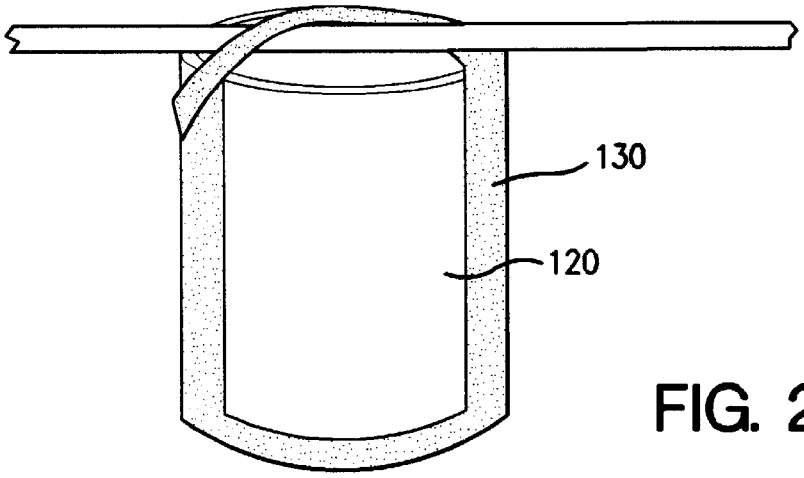
FIG. 29 shows the holder according to the present invention, securing a beverage container to the bottom surface of a horizontal member by means of a loop as illustrated in FIG. 28.

Referring to FIG. 29, shown is the cylinder 120 of FIGS. 3 and 4 secured to the bottom surface of a horizontal member by means of the loop formed in FIG. 28.

Figure 30:
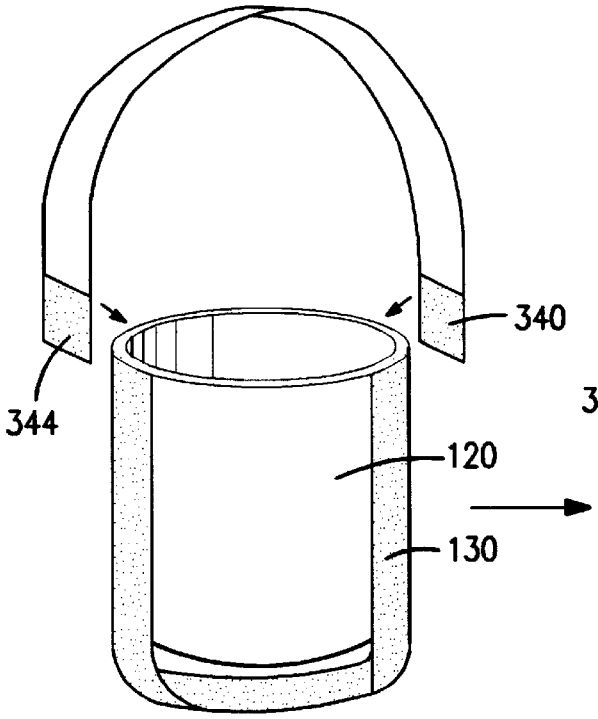
FIG. 30 shows a holder strap made of a flexible material with surface fasteners at each end before the holder is attached to the cylinder to form a loop for the holder according to the present invention.
Figure 31:
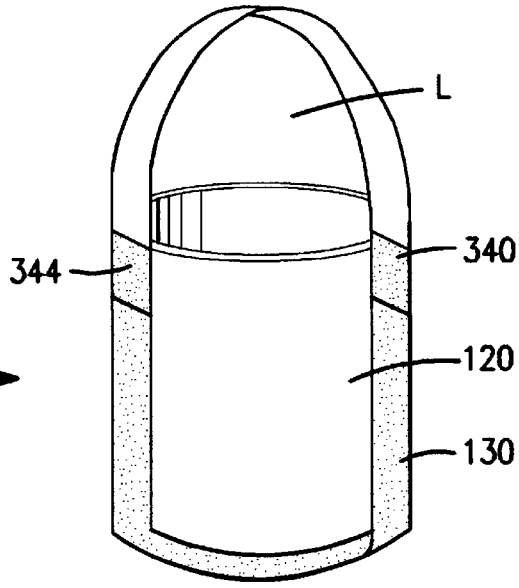
FIG. 31 shows the holder according to the present invention with a loop for hanging by the means depicted in FIG. 30.

Referring to FIG. 30, shown is a side elevational view of the embodiment of FIG. 8 and a preferably detachable holder strap with surface fasteners 340 and 344 at the ends. Referring to FIG. 31, a loop L is formed when surface fasteners 340 and 344 attach to complementary holder strap 130 on two opposing sides of the holder.

Figure 32:
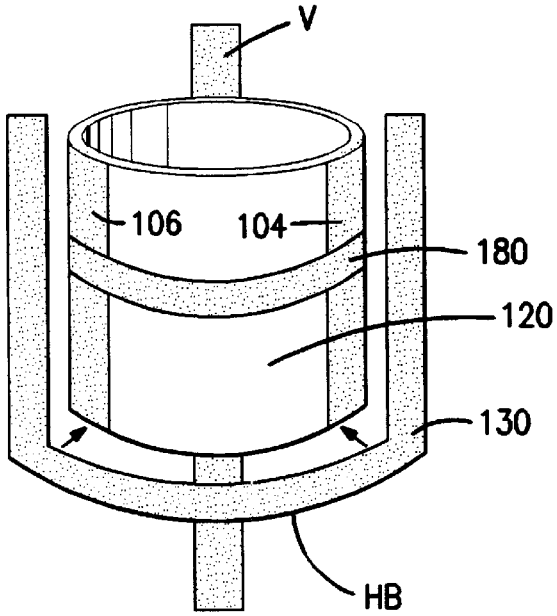
FIG. 32 shows a means by which the holder is attached to a vertical member by first attaching the cylinder to the vertical member and second, forming a holder bottom.
Figure 33:
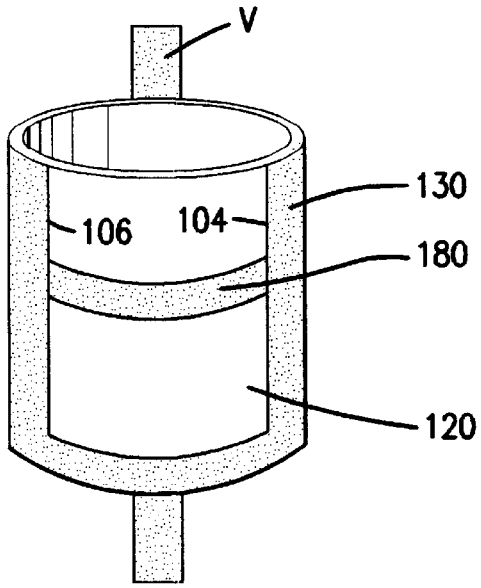
FIG. 33 shows the holder with a formed holder bottom, attached to a vertical member by the means depicted in FIG. 32.
Figure 33A:
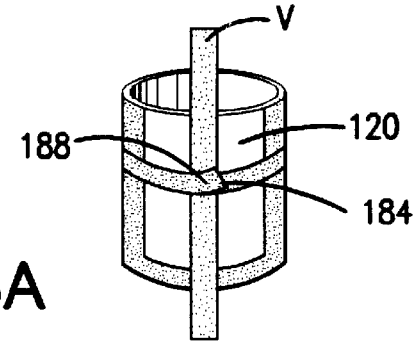
FIG. 33A shows the attachment of the ends of a holder strap that attaches a holder to a vertical member according to the present invention.

Referring to FIG. 32, shown is a side elevational view of a cylinder 120 of FIGS. 3 and 4, attached to a vertical member V by means of preferably double-sided first holder strap 180 of FIG. 9A. It is preferable that first holder strap 180 be double-sided so that one end 184 may attach to a complementary surface fastener on the other end 188 after wrapping around the vertical member V. The attachment of the two ends 184 and 188 is illustrated in FIG. 33A. A second holder strap 130 of FIG. 2 attaches to the complementary strap surface fasteners 104 and 106 on cylinder 120 of FIGS. 3 and 4 and first holder strap 180 to form a holder bottom HB for the cylinder 120 of FIGS. 3 and 4. The resulting embodiment is shown in FIG. 33.

Figure 34:
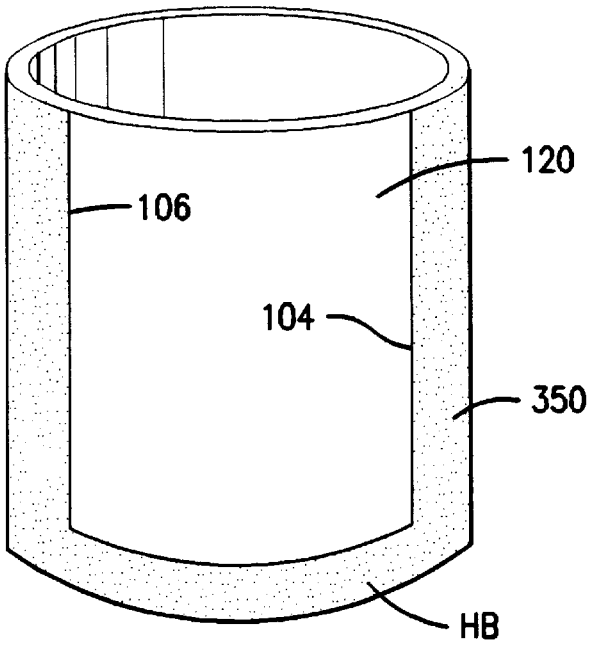
FIG. 34 is a side elevational view of the holder with a formed holder bottom according to the present invention.
Figure 34A:
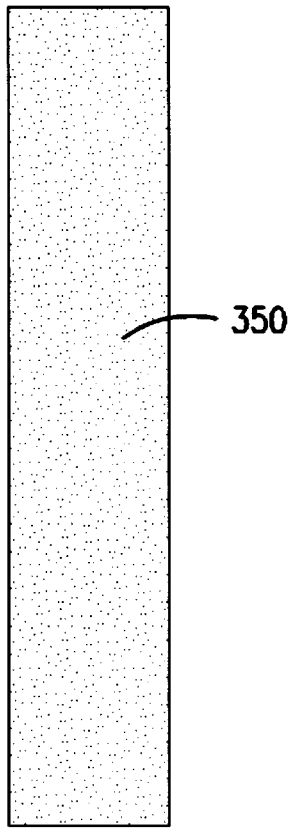
FIG. 34A is a top plan view of a holder strap used to attach the holder to a vertical member as shown in FIG. 35.

Referring to FIG. 34, a preferably double-sided first holder strap 350 of FIG. 34A, is attached to complementary strap surface fasteners 104 and 106 on cylinder 120 of FIGS. 3 and 4 and forms a holder bottom HB for a cylinder 120 of FIGS. 3 and 4.

Figure 35:
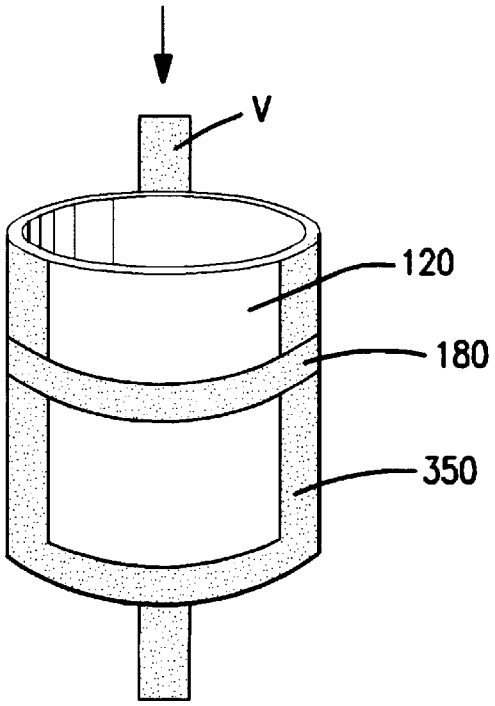
FIG. 35 is a side elevational view of the holder according to the present invention attached to a vertical member.

Referring to FIG. 35, a preferably double-sided second holder strap 180 of FIG. 9A attaches the embodiment shown in FIG. 34 to a vertical member V, by attaching to the complementary first holder strap 350 on the cylinder shown in FIG. 34.

Figure 36:
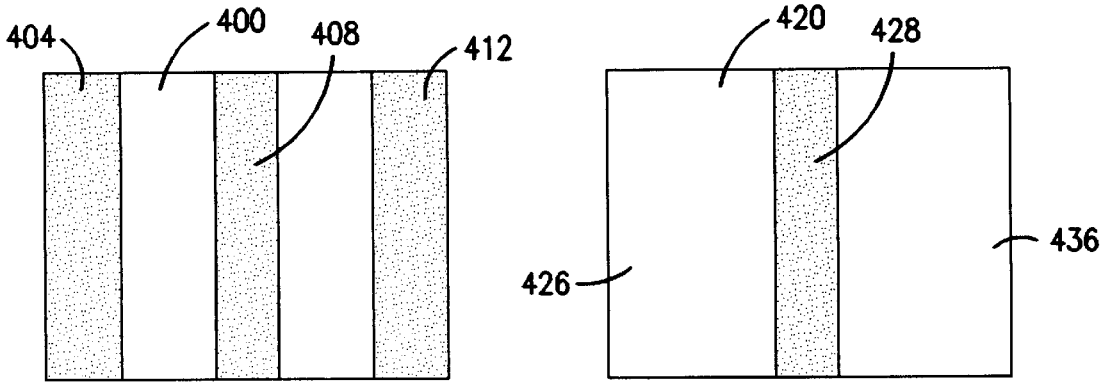
FIG. 36 top plan view of two blanks, with end surface fasteners and strap surface fasteners at the ends and center of the blank, before being joined together to form the cylinder in FIG. 36B.
Figure 36A:
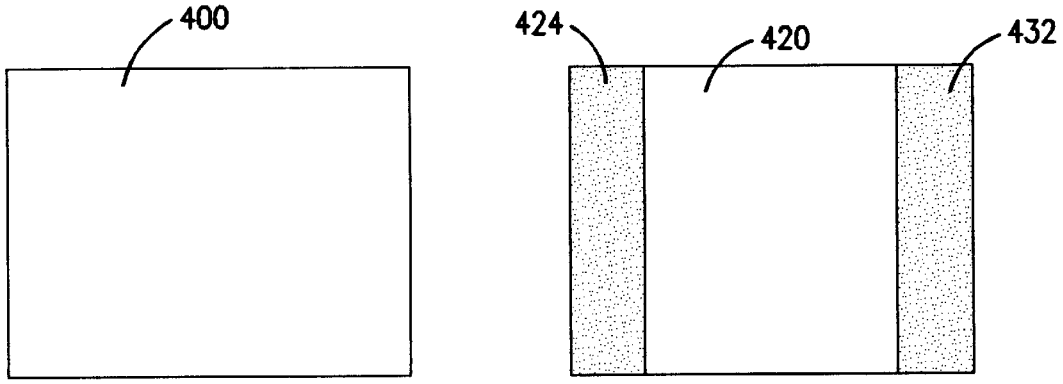
FIG. 36A shows bottom plan views of the blanks of FIG. 36.
Figure 36B:
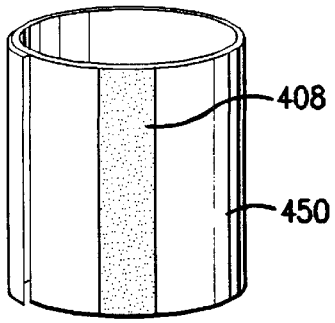
FIG. 36B is a front elevational view of the blanks of FIG. 36, after being joined together at the ends.

Referring to FIG. 36, shown are top plan views of two preferably identical sized blanks 400 and 420, preferably made of an insulating or non-insulating material, such as rubber, leather or neoprene. FIG. 36A shows bottom plan views of the blanks 400 and 420. The blanks 400 and 420 may be of contrasting colors or patterns. Two strap surface fasteners 408 and 428 are preferably permanently attached at the center and across the width of blanks 400 and 420, respectively. Two end surface fasteners 404 and 412 are preferably permanently attached across the width and at the ends of the blank 400. Likewise, two end surface fasteners 424 and 432 are preferably permanently attached across the width and at the ends of the blank 420. Preferably, the end surface fasteners 424 and 432 are attached to the bottom surface of the blank 420. The end surface fasteners 404 and 412 are preferably complementary to the end surface fasteners 424 and 432. Preferably, the blanks 400 and 420 have widths of approximately 4¼" (10.8 cm) and lengths of approximately 5½" (13.97 cm). Preferably, the end surface fasteners 404, 412, 424, and 432 and strap surface fasteners 408 and 428 have widths of approximately 1" (2.54 cm). The end surface fasteners 404 and 412 are preferably joined to the end surface fasteners 424 and 432 to form a cylinder 450 as shown in FIG. 36B. Alternatively, the blanks 400 and 420 could be permanently joined together and the end surface fasteners 404, 412, 424, and 432 can be eliminated. Further, two additional strap surface fasteners may be preferably permanently attached across the width and at the ends 426 and 436 of the top surface of the blank 420 so that the top surfaces of the blanks 400 and 420 both have the same configuration of surface fasteners. This would provide additional strap surface fasteners on the exterior of the blank to which the holder strap 130 of FIG. 2 may attach.

Figure 37:
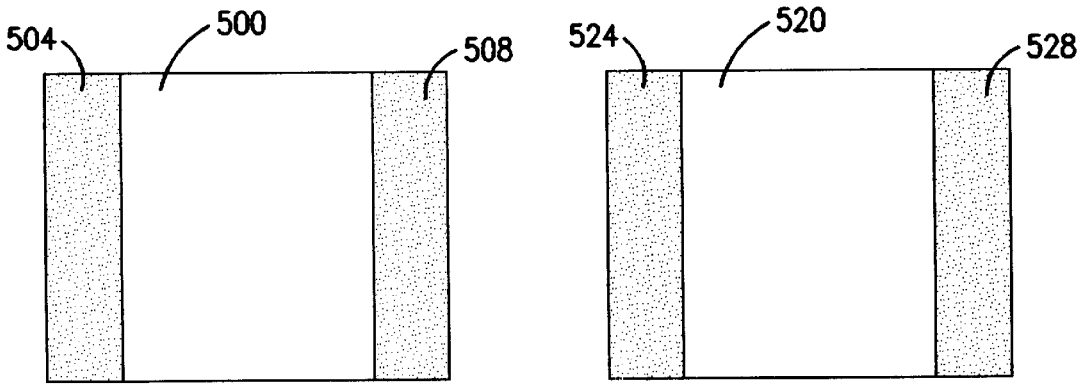
FIG. 37 is a top plan view of two blanks with end surface fasteners and strap surface fasteners at the ends before being joined together to form the cylinder in FIG. 37B.
Figure 37A:
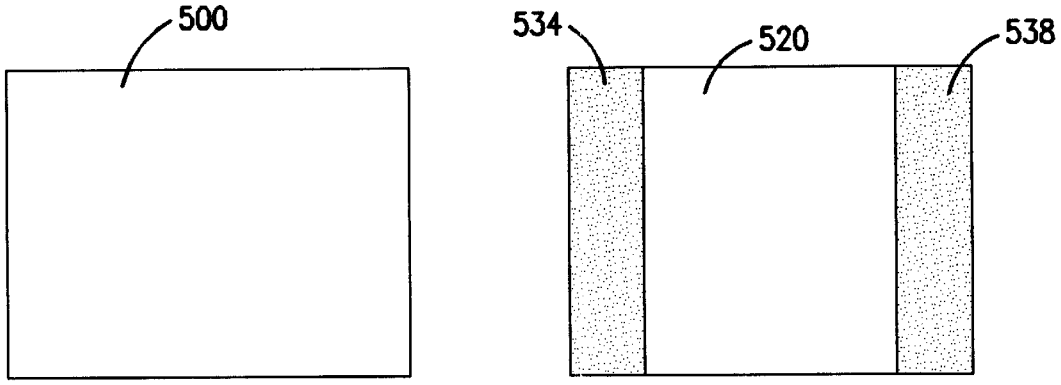
FIG. 37A shows bottom plan views of the blanks of FIG. 37.
Figure 37B:
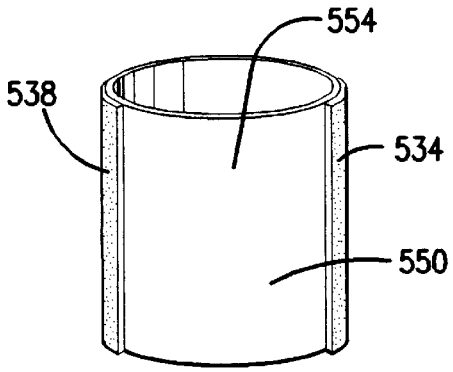
FIG. 37B is a front elevational view of the blanks of FIG. 37, after being joined together at the ends.
Figure 37C:
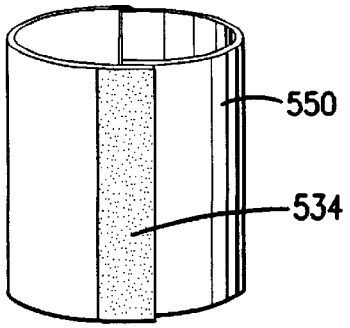
FIG. 37C is a side elevational view of the blanks of FIG. 37, after being joined together at the ends.

Referring to FIG. 37, shown are top plan views of two preferably identical blanks 500 and 520, preferably made of an insulating or non-insulating material, such as rubber, leather or neoprene. Two end surface fasteners 504 and 508 are preferably permanently attached across the width and at the ends of the blank 500. Two end surface fasteners 524 and 528 are preferably permanently attached across the width and at the ends of the blank 520. FIG. 37A shows bottom plan views of the blanks 500 and 520. Two strap surface fasteners 534 and 538 are preferably permanently attached across the width and at the ends of the blank 520 while the bottom surface of blank 500 is preferably without surface fasteners. The end surface fasteners 504 and 508 are complementary to the end surface fasteners 524 and 528. Preferably, the blanks 500 and 520 have widths of approximately 4¼" (10.8 cm) and lengths of approximately 5½" (13.97 cm). Preferably, the end surface fasteners 504, 508, 524, 528 have widths of approximately 1" (2.54 cm). The end surface fasteners 504 and 508 are joined to end surface fasteners 524 and 528 to form a cylinder 550 as shown in FIGS. 37B and 37C. FIGS. 37B and 37C show a side elevational view of a cylinder 550 and a front elevational view of cylinder 550, respectively. The strap surface fasteners 538 and 534 are shown exterior to the cylinder 550 in FIG. 37B. The strap surface fastener 534 is shown exterior to the cylinder 550 in FIG. 37C.

It should be noted that the embodiment formed from the blanks 500 and 520 of FIGS. 37 and 37A is preferable to the embodiment formed from the blanks 400 and 420 of FIGS. 36 and 36A because without the strap surface fasteners 408 and 428 of FIG. 36, a larger clear area 554 of FIG. 37B is available on which to place personalized markings, advertisements, logos and other indicia.

Figure 38:
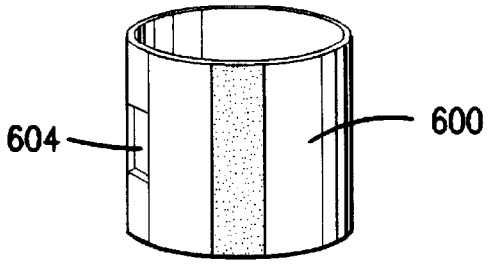
FIG. 38 is a front elevational view of the blank of FIG. 1 after being sewn together to leave a cutout in the seam to receive a mug handle.

Referring to FIG. 38, shown is a front elevational view of the blank 100 of FIG. 1 after being sewn together to form a cylinder 600. A cutout 604 is formed in the seam to receive a mug handle.

Figure 39:
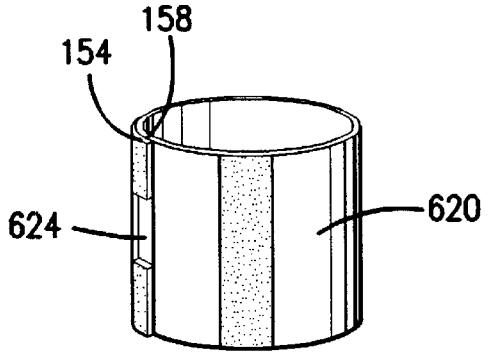
FIG. 39 is a front elevational view of the blank of FIG. 1A after being joined together with a cutout left to receive a mug handle.

Referring to FIG. 39, shown is a front elevational view of the blank 150 of FIG. 1A after being joined together to form a cylinder 620. A cutout 624 is formed where the end surface fasteners 154 and 158 are joined to receive a mug handle.

Figure 40:
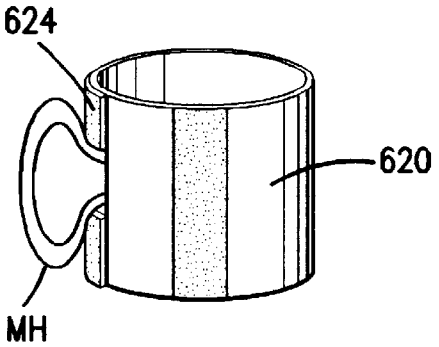
FIG. 40 is a front elevational view of a mug encased by the cylinder in FIG. 39.

Referring to FIG. 40, shown is a front elevational view of a mug handle MH protruding out of a cutout 624 in the cylinder 620 of FIG. 39.

Figure 41:
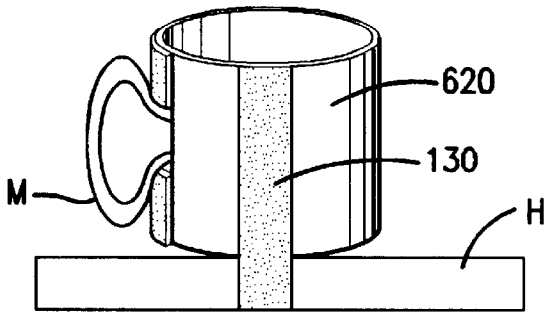
FIG. 41 illustrates the mug in the cylinder shown in FIG. 40 attaching to a horizontal member by means of the holder strap of FIG. 2.

Referring to FIG. 41, shown is a front elevational view of a mug M in a cylinder 620 of FIG. 39 attached to a horizontal member H by means of the holder strap 130 of FIG. 2.

Figure 42:
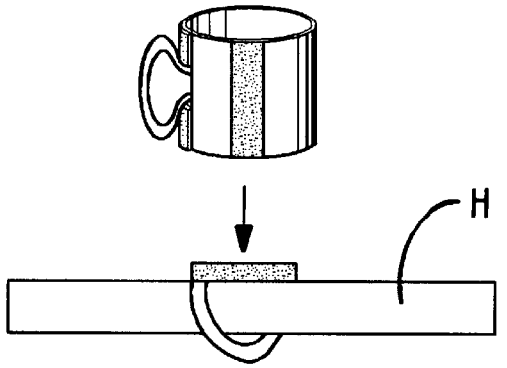
FIG. 42 illustrates the means by which a mug may be attached to a horizontal member by means of the base strap of FIG. 12A and the cylinder of FIG. 39.

FIG. 42 illustrates the means by which a mug may be attached to a horizontal member H by means of the base strap of FIG. 12A and the cylinder of FIG. 39.

Figure 43:
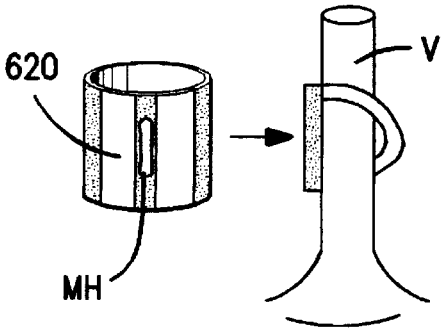
FIG. 43 illustrates the means by which a mug may be attached to a vertical member using the base strap of FIG. 12A and the cylinder of FIG. 39.

FIG. 43 illustrates the means by which a mug may be attached to a vertical member V using the base strap of FIG. 12A and the cylinder of FIG. 39.

FIG. 44 shows two holders attached to a horizontal member and joined together to hold a beverage and a pair of eyeglasses according to the present invention.

Referring to FIG. 45, shown is a front elevational view of a cylinder 120 of FIG. 3 with two additional strap surface fasteners 650 and 654 joined opposite each other at the sides of the cylinder 120. Two preferably double-sided holder straps 670 and 680 are provided as shown in FIG. 46. The holder straps 670 and 680 are complementary to the strap surface fasteners 654, 104, 650 and 106 on the exterior of the cylinder 120. Each holder strap attaches to complementary strap surface fasteners on opposite sides of the cylinder 120 to form a holder bottom for the cylinder. For example, one holder strap 670 of FIG. 46 attaches to the complementary strap surface fasteners 654 and 650 while the other holder strap 680 attaches to the complementary strap surface fasteners 104 and 106. A bottom plan view of the cylinder 120 after the two holder straps 670 and 680 are attached is shown in FIG. 47.

Referring to FIG. 48, shown is a side elevational view of a cylinder 120 of FIGS. 3 and 4 with surface fasteners 690 and 694 placed at the top of the interior of the cylinder.

Figure 49:
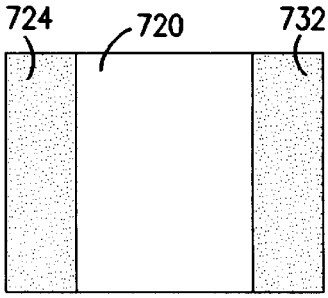
FIG. 49 is a bottom plan view of the blank 720 of FIG. 51.
Figure 50:
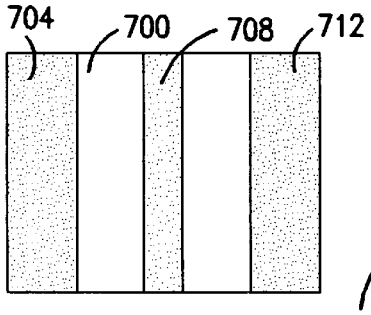
FIG. 50 is a top plan view of a blank with surface fasteners joined to the ends and center before being joined to the blank of FIG. 51 to form the frustoconical sleeve in FIG. 52, FIG. 53 and FIG. 54.
Figure 51:
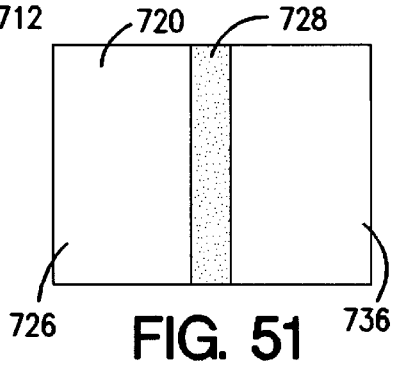
FIG. 51. is a top plan view of a blank with surface fasteners joined to the ends and center before being joined to the blank of FIG. 50 to form the frustoconical sleeve in FIG. 52, FIG. 53 and FIG. 54.
Figure 52:
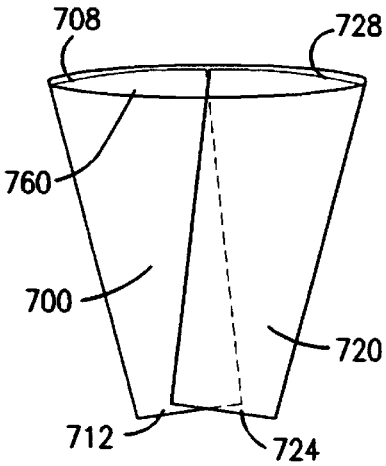
FIG. 52 is a side elevational view of the blanks of FIGS. 50 and 51 after being joined together at two ends to form a truncated cone (frustoconical) shape.
Figure 53:
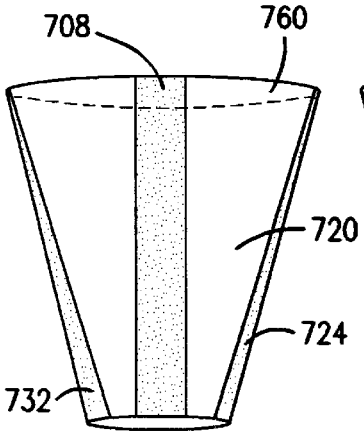
FIG. 53 is a front elevational view of the blanks of FIGS. 50 and 51 after being joined together at two ends to form truncated cone (frustoconical) shape.
Figure 54:
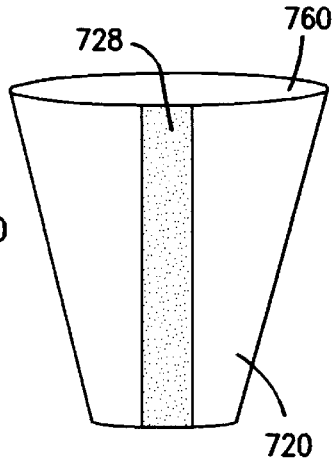
FIG. 54 is a rear elevational view of the blanks of FIGS. 50 and 51 after being joined together at two ends to form a truncated cone (frustoconical) shape.

Referring to FIGS. 50 and 51, shown are top plan views of two blanks 700 and 720 that are similar to the two blanks of FIG. 36. Referring to FIG. 49, shown is a bottom plan view of the blank 720 of FIG. 51. The blanks are preferably made of an insulating or non-insulating material, such as rubber, leather or neoprene. Two strap surface fasteners 708 and 728 are preferably permanently attached at the approximate center and across the width of blanks 700 and 720, respectively. Two end surface fasteners 704 and 712 are preferably permanently attached across the width and at the ends of the blank 700. Likewise, two end surface fasteners 724 and 732 are preferably permanently attached across the width and at the ends of the blank 720. Preferably, the end surface fasteners 724 and 732 are attached to the bottom surface of the blank 720. Preferably, the end surface fasteners 704 and 712 are complementary to the end surface fasteners 724 and 732. Preferably, the blanks 700 and 720 have widths of approximately 4¼" (10.8 cm) and lengths of approximately 5½" (13.97 cm). Preferably, the end surface fasteners 704, 712, 724, and 732 have widths of approximately 1½" (3.81 cm) and the strap surface fasteners 708 and 728 have widths of approximately 1" (2.54 cm). The end surface fasteners 704 and 712 are joined to the end surface fasteners 724 and 732 to form a frustoconical sleeve 760 as shown in FIGS. 52, 53, and 54 or a cylinder 750 as shown in FIG. 55A. Further, two additional strap surface fasteners may be preferably permanently attached across the width and at the ends 726 and 736 of the top surface of the blank 720 so that the top surfaces of the blanks 700 and 720 both have the same configuration of surface fasteners. This would provide additional surface fasteners on the exterior of the blank to which the holder strap 130 of FIG. 2 may attach.

Figure 55:
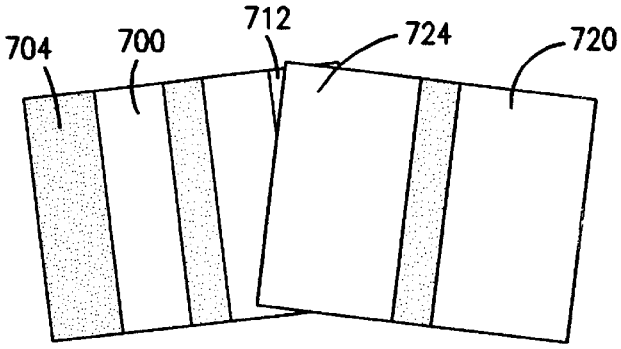
FIG. 55 is a top plan view of joining one end of the blank of FIG. 50 to one end of the blank of FIG. 51.
Figure 55A:
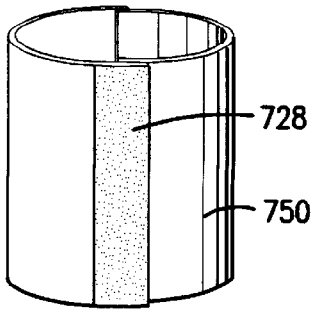
FIG. 55A is a front elevational view of the blanks of FIGS. 50 and 51 forming a cylinder after being joined together at two ends.

Referring to FIG. 55, shown is the method by which the two blanks 700 and 720 of FIGS. 52, 53, and 54 are joined with an angular displacement. An end surface fastener 712 of a blank 700 of FIG. 50 is joined to a complementary end surface fastener 724 of a blank 720 of FIG. 51.

Figure 56:
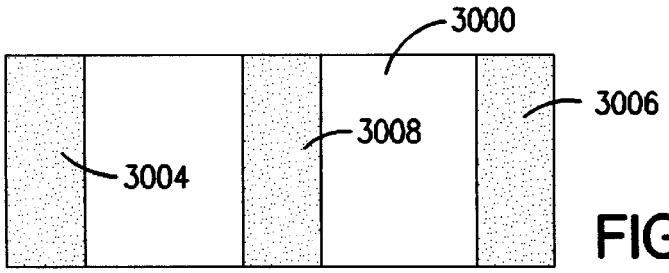
FIG. 56 is a top plan view of a blank according to the present invention before being joined at the ends to form a cylinder or a frustoconical sleeve.

Referring to FIG. 56, shown is a top plan view of a blank 3000, preferably made of an insulating or non-insulating material, such as rubber, leather or neoprene. A first end surface fastener 3004 is preferably permanently attached at the end and across the width of the blank 3000. A first strap surface fastener 3006 is preferably permanently attached at the opposite end and across the width of the blank 3000. A second strap surface fastener 3008 is preferably permanently attached at the center and across the width of the blank 3000.

Figure 57:
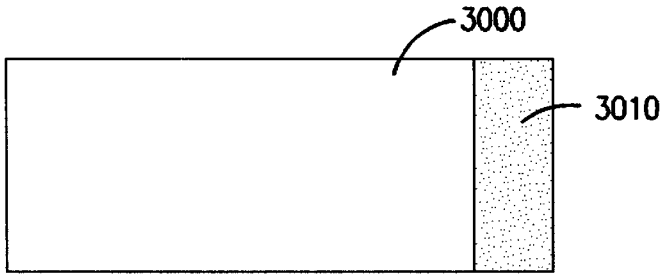
FIG. 57 is a bottom plan view of the blank of FIG. 56.
Figure 58:
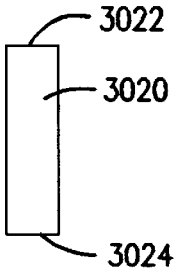
FIG. 58 is a bottom strip made of a flexible material before being joined to the blank of FIG. 56 to form a holder bottom according to the present invention.

Referring to FIG. 57, shown is a bottom plan view of the blank 3000 of FIG. 56. A second end surface fastener 3010 is placed across the width and at the same end but on the opposite surface from first strap surface fastener 3006. Preferably second end surface fastener 3010 is complementary to first end surface fastener 3004. Preferably, the blank has a width of approximately 4¼" (10.8 cm) and length of approximately 10½" (26.7 cm). Preferably, end surface fasteners 3010 and 3004 have widths of approximately 1½" (3.817 cm.) Referring to FIG. 58, shown is a bottom strip 3020 made of a flexible material before being joined to the blank of FIG. 56 to form a holder bottom according to the present invention.

Figure 59:
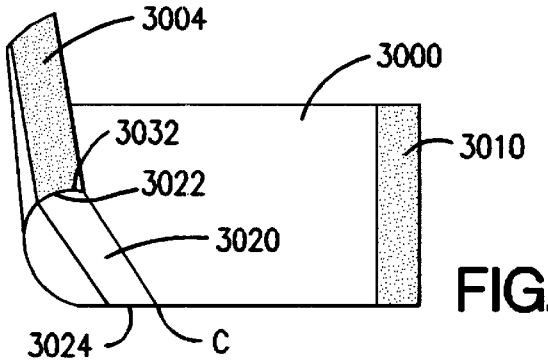
FIG. 59 is the blank of FIG. 56 after the bottom strip of FIG. 58 was joined to one end and to the approximate center.

Referring to FIG. 59, one end 3022 of the bottom strip 3020 is attached to an end 3032 of the blank 3000. The other end 3024 of the bottom strip 3020 is attached approximately at the center C of the blank and on the same edge of the blank where the first end 3022 was attached.

Figure 60:
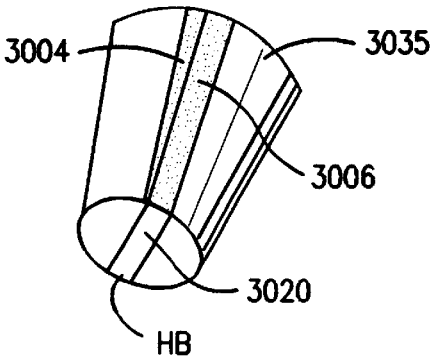
FIG. 60 is a side elevational view of the embodiment of FIG. 59 after the surface fasteners were joined together to form a frustoconical sleeve with a holder bottom formed by the bottom strip of FIG. 58.

Referring to FIG. 60, the end surface fasteners 3010 and 3004 of FIGS. 57 and 56 respectively are joined together at an angular displacement to form a truncated-conical (frustoconical) sleeve 3035 with a holder bottom HB. Note that end surface fastener 3010 is not shown in FIG. 60 because it is at the same end but on the opposite surface from strap surface fastener 3006.

Figure 61:
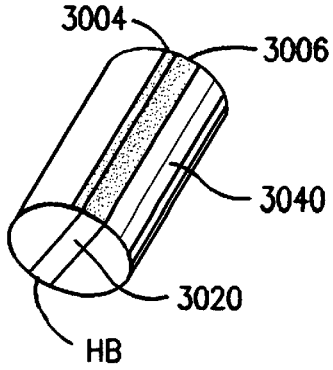
FIG. 61 is a side elevational view of the embodiment of FIG. 59 after the surface fasteners were joined together to form a cylindrical sleeve with a holder bottom formed by the bottom strip of FIG. 58.

Referring to FIG. 61, the end surface fasteners 3010 and 3004 of FIGS. 57 and 56, respectively, are joined together to form a cylinder 3040 with a holder bottom HB. Note that end surface fastener 3010 is not shown in FIG. 61 because it is at the same end but on the opposite surface from strap surface fastener 3006.

Figure 62:
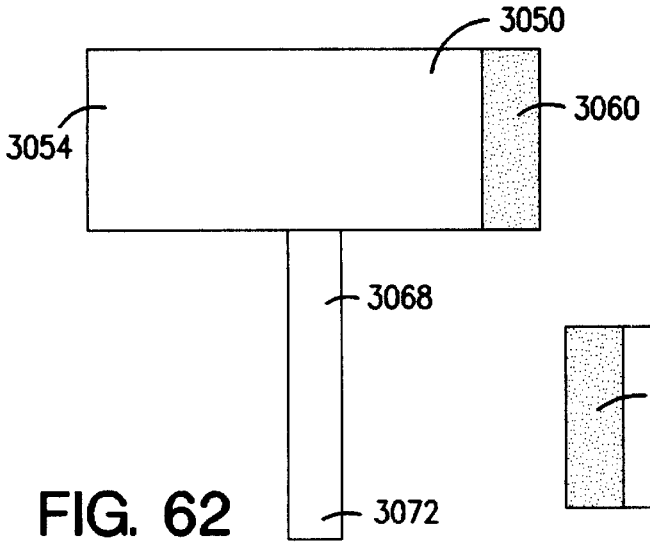
FIG. 62 is a bottom plan view of a blank according to the present invention before being joined at the ends to form a cylinder or a frustoconical sleeve. Extending out from the blank is a loose end of a strap surface fastener, which is joined preferably at the center of the blank.

Referring to FIG. 62, shown is a bottom plan view of a blank 3050, preferably made of an insulating or non-insulating material, such as rubber, leather or neoprene. A first end surface fastener 3060 is placed across the width and at the end of blank 3050.

Figure 63:
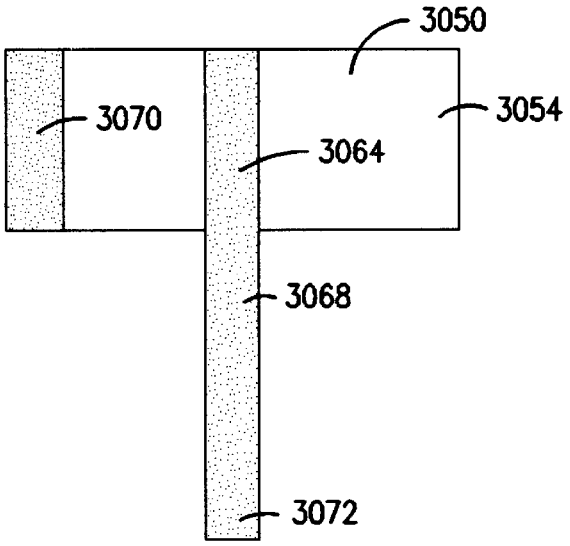
FIG. 63 is, a top plan view of the blank of FIG. 62.

Referring to FIG. 63, shown is a top plan view of a blank 3050 of FIG. 62. A first strap surface fastener 3064 is preferably permanently attached at the center and across the width of the blank 3050. The length of first strap surface fastener 3064 is greater than the width of the blank 3050 and therefore extends beyond the surface of the blank. A second strap surface fastener 3070 is placed at the same end but on the opposite surface from first end surface fastener 3060. Preferably, the blank 3050 has a width of approximately 4¼" (10.8 cm) and length of approximately 10½" (26.7 cm). Preferably, first strap surface fastener 3064 and first end surface fastener 3060 have widths of approximately 1½" (3.817 cm.). Preferably first strap surface fastener 3064 has an approximate length of 11½" (29.21 cm.)

Figure 64:
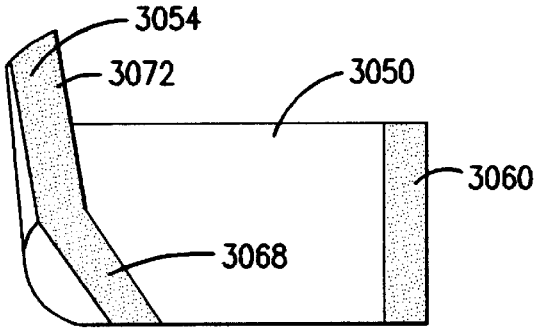
FIG. 64 is the blank of FIGS. 62 and 63 after the loose end of the strap surface fastener is joined to an end of the blank and becomes an end surface fastener on the blank. A middle portion of the strap surface fastener remains unattached to the blank and forms a holder bottom, which is formed when the end surface fasteners are joined.

Referring to FIG. 64, the loose end 3072 of the first strap surface fastener 3064 of FIG. 63 is joined, preferably by sewing, to the end 3054 of the blank 3050 of FIG. 63 and becomes a second end surface fastener 3072 on the blank 3050. A middle portion 3068 of first strap surface fastener 3064 forms a holder bottom.

Figure 65:
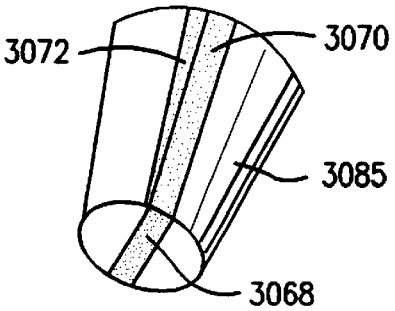
FIG. 65 is a side elevational view of the embodiment of FIG. 64 after the end surface fasteners were joined together to form a frustoconical sleeve with a preferably reversibly formed holder bottom.

Referring to FIG. 65, first and second end surface fasteners 3060 and 3072 are joined together at an angular displacement to form a truncated-conical (frustoconical) sleeve 3085 with a holder bottom 3068. Note that end surface fastener 3060 is not shown in FIG. 65 because it is at the same end but on the opposite surface from strap surface fastener 3070.

Figure 66:
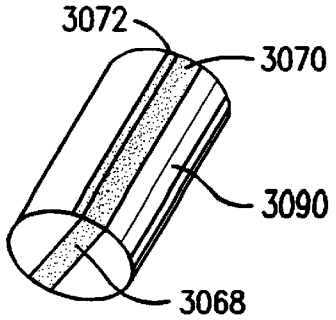
FIG. 66 is a side elevational view of the embodiment of FIG. 64 after the end surface fasteners were joined together to form a cylindrical sleeve with a preferably reversibly formed holder bottom.

Referring to FIG. 66, first and second end surface fasteners 3060 and 3072 are joined together to form a cylinder 3035 with a holder bottom 3068. Note that end surface fastener 3060 is not shown in FIG. 66 because it is at the same end but on the opposite surface from strap surface fastener 3070.

Figure 67:
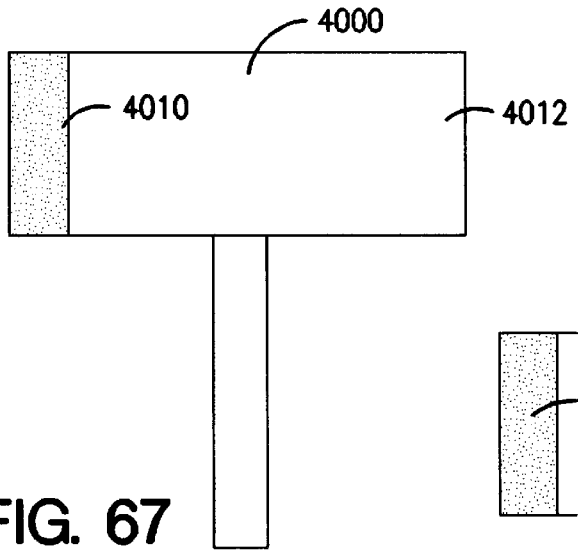
FIG. 67 is a bottom plan view of a blank according to the present invention before being joined at the ends to form a cylinder or a frustoconical sleeve. Extending out from the blank is a loose end of a strap surface fastener, which is joined preferably at the center of the blank.

Referring to FIG. 67, shown is a bottom plan view of a blank 4000, preferably made of an insulating or non-insulating material, such as rubber, leather or neoprene. A first end surface fastener 4010 is placed across the width and at the end of blank 4000.

Figure 68:
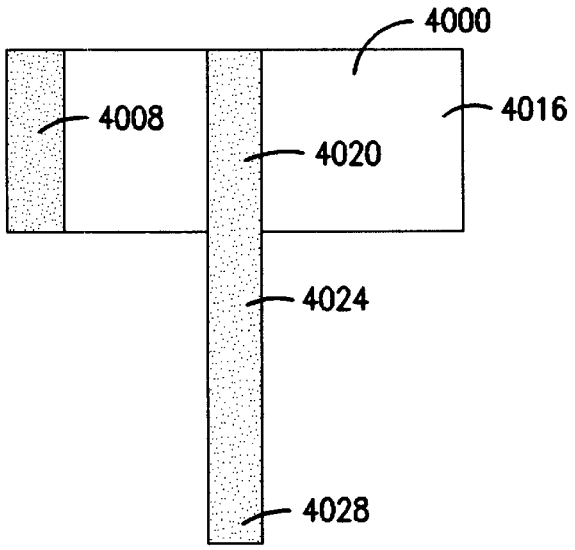
FIG. 68 is a top plan view of the blank of FIG. 67.

Referring to FIG. 68, shown is a top plan view of the blank 4000 of FIG. 67. A first strap surface fastener 4020 is preferably permanently attached at the center and across the width of the blank 4000. The length of first strap surface fastener 4020 is greater than the width of the blank 4000 and therefore extends beyond the surface of the blank. A second end surface fastener 4008 is placed at the opposite end and on the opposite surface from first end surface fastener 4010. Note that second end surface fastener 4008 is at the same end as end 4012 of the blank 4000 and that first end surface fastener 4010 is at the same end as end 4016 of the blank 4000. Preferably the blank 4000 has a width of approximately 4¼" (10.8 cm) and length of approximately 10½" (26.7 cm). Preferably, the first and second end surface fasteners 4010 and 4008 have widths of approximately 1½" (3.817 cm.). Preferably, the surface fastener 4020 has a length of 11½" (29.21 cm.)

Figure 69:
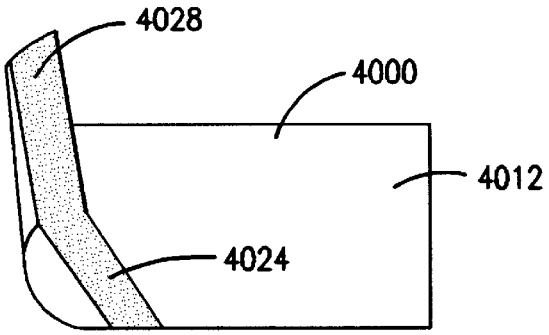
FIG. 69 is the blank of FIG. 67 and 68 after the loose end of the strap surface fastener is joined to an end of the blank and becomes a second strap surface fastener on the blank. Essentially two strap surface fasteners on the blank are formed from the same strip of surface fastener. A middle portion of this strap surface fastener remains unattached to the blank and forms a holder bottom, which is formed when the end surface fasteners are joined.

Referring to FIG. 69, the loose end 4028 of the first strap surface fastener 4020 of FIG. 68 is joined, preferably by sewing, to the same end but on the opposite surface where first end surface fastener 4010 of FIG. 67 is placed and becomes a second strap surface fastener on the blank 4000. A middle portion 4024 of first strap surface fastener 4020 forms a holder bottom.

Figure 70:
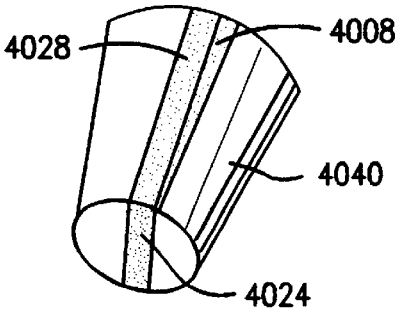
FIG. 70 is a side elevational view of the embodiment of FIG. 69 after the end surface fasteners were joined together to form a frustoconical sleeve with a preferably reversibly formed holder bottom.

Referring to FIG. 70, first and second end surface fasteners 4010 and 4008 are joined together at an angular displacement to form a truncated-conical (frustoconical) sleeve 4040 with a holder bottom 4024. Note that end surface fastener 4010 is not shown in FIG. 70 because it is at the same end but on the opposite surface from strap surface fastener 4028.

Figure 71:
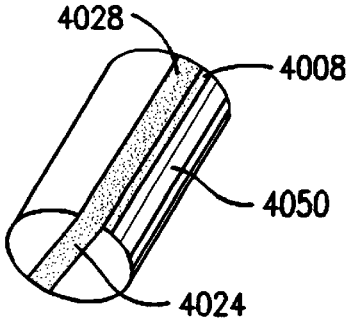
FIG. 71 is a side elevational view of the embodiment of FIG. 69 after the surface fasteners were joined together to form a cylindrical sleeve with a preferably reversibly formed holder bottom.

Referring to FIG. 71, first and second end surface fasteners 4010 and 4008 are joined together to form a cylinder 4050 with a holder bottom 4024. Note that end surface fastener 4010 is not shown in FIG. 71 because it is at the same end but on the opposite surface from strap surface fastener 4028.

Figure 72:
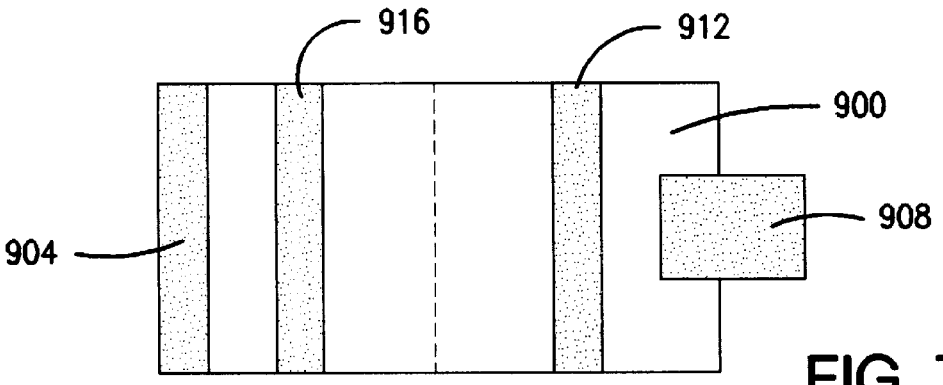
FIG. 72 is a top plan view of a blank for a holder to accommodate a mug handle according to the present invention.

Referring to FIG. 72, shown is a top plan view of a blank 900, preferably made of an insulating or non-insulating material, such as rubber, leather or neoprene. One end surface fastener 904 is preferably permanently attached at the end and across the width of the blank 900. A complementary piece of surface fastener 908 is preferably permanently attached at the other end. This piece of surface fastener is sized to fit through the mug handle before attaching to the complementary end surface fastener 904 and forming the cylindrical sleeve 920 of FIG. 72A. Two complementary strap surface fasteners 916 and 912 are preferably permanently attached to the same surface of the blank across the width of the blank 900 and spaced apart by approximately half the length of the blank. Preferably, the strap surface fasteners 916 and 912 have widths of approximately 1" (2.54 cm).

Figure 72A:
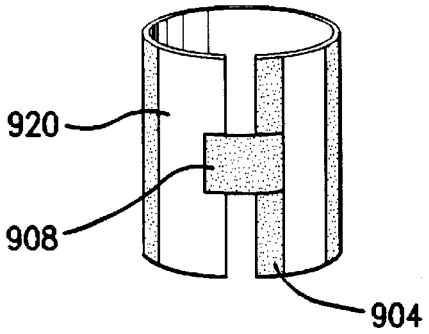
FIG. 72A is a side elevational view of the blank of FIG. 72 after two surface fasteners are joined together to fit through a mug handle.

Referring to FIG. 72A, shown is a side elevational view of the cylindrical sleeve 920.

Figure 72B:
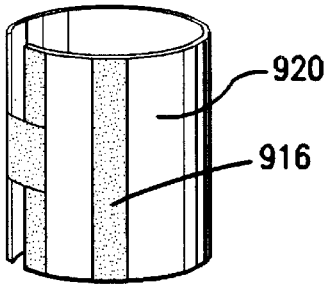
FIG. 72B is a front elevational view of the blank of FIG. 72 after two surface fasteners are joined together to through a mug handle.

Referring to FIG. 72B, shown is a front elevational view of the cylindrical sleeve 920.

Figure 72C:
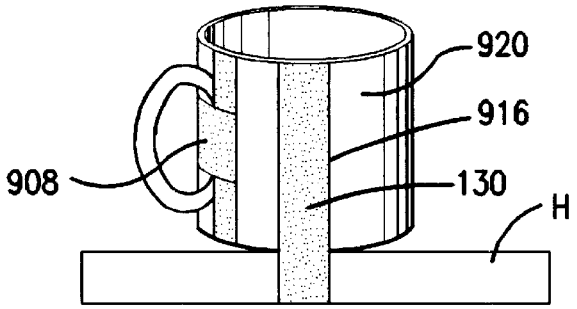
FIG. 72C illustrates the mug in the cylindrical sleeve shown in FIGS. 72A and 72B attaching to a horizontal by means of the holder strap of FIG. 2.

Referring to FIG. 72C, shown is a mug encased by the cylinder 920 and attached to a horizontal member by means of a holder strap 130 of FIG. 2.

Figure 73:
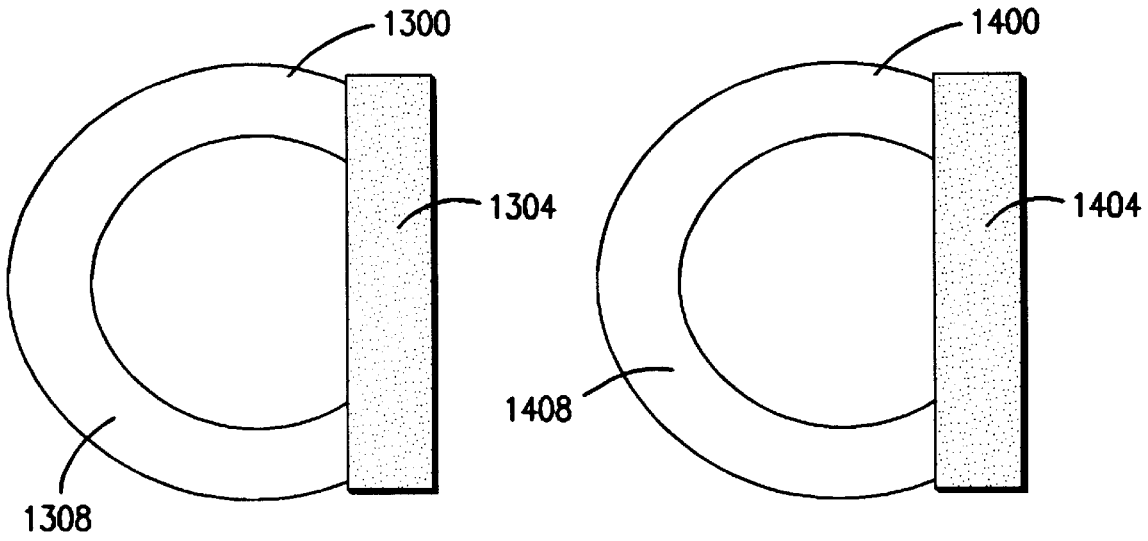
FIG. 73 is a top plan view of two blanks cut to form the letter "C" before being sewn together to form the cylinder of FIG. 74.
Figure 74:
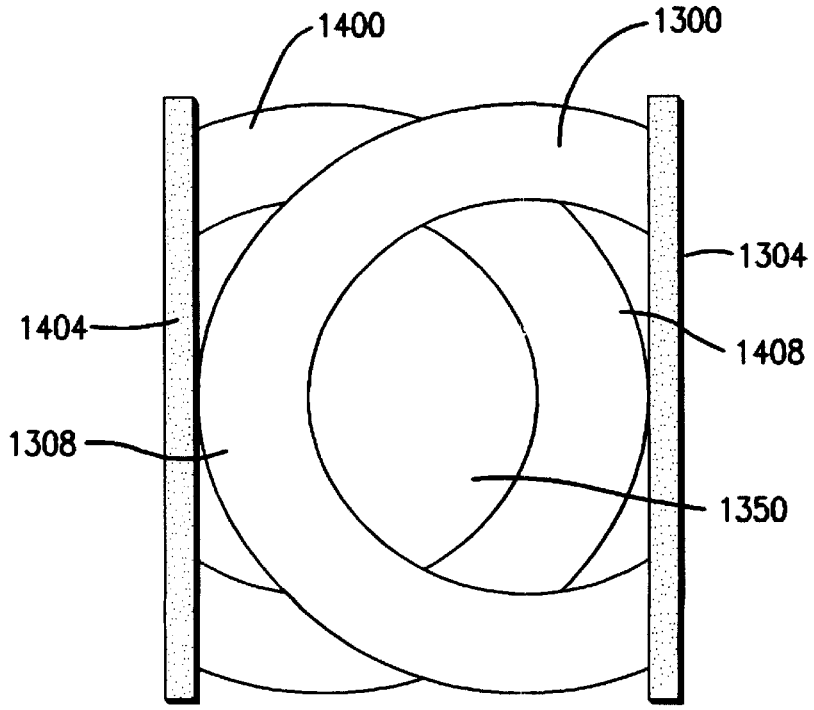
FIG. 74 is a front elevational view of a cylinder formed by sewing together the ends of the two blanks of FIG. 73.

Referring to FIG. 73, shown are top plan views of two blanks 1300 and 1400, preferably made of an insulating or non-insulating material, such as rubber, leather or neoprene. The blanks 1300 and 1400 may be of contrasting colors or patterns. A strap surface fastener 1304 is preferably permanently attached across the width and at one end of the blank 1300. Likewise, a strap surface fastener 1404 is preferably permanently attached across the width and at one end of the blank 1400. Preferably, the blanks 1300 and 1400 have widths of approximately 4¼" (10.8 cm) and lengths of approximately 5½" (13.97 cm). Preferably, the strap surface fasteners 1304 and 1404 have widths of approximately 1" (2.54 cm). The end 1308 of blank 1300 is preferably permanently joined to the strap surface fastener 1404 of blank 1400 and the end 1408 of blank 1400 is preferably permanently joined to the strap surface fastener 1304 of blank 1300 to form a cylinder 1350 as shown in FIG. 74.

Figure 75:
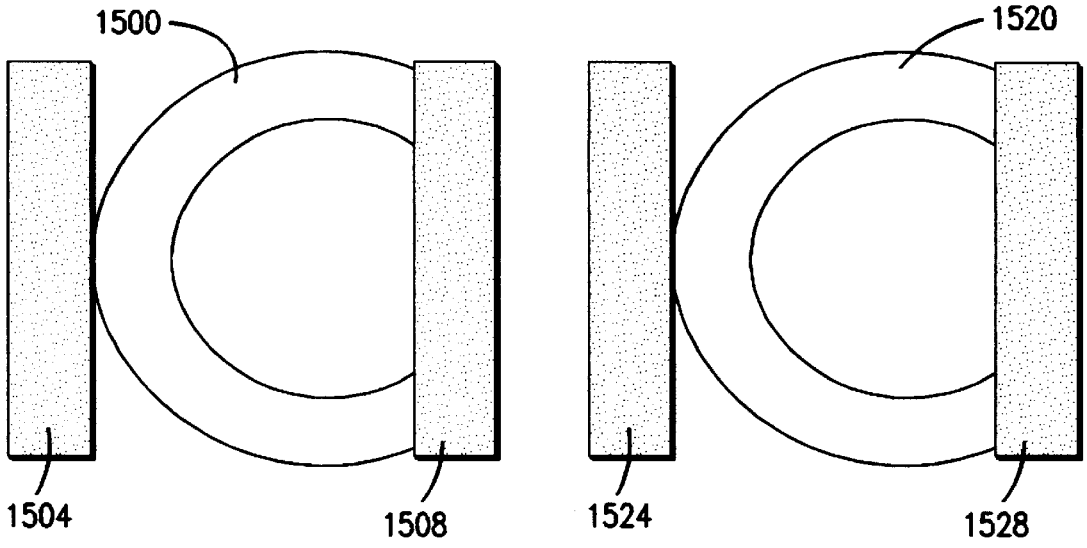
FIG. 75 is a top plan view of the two blanks of FIG. 37 with cutouts to form the letter "C".
Figure 75A:
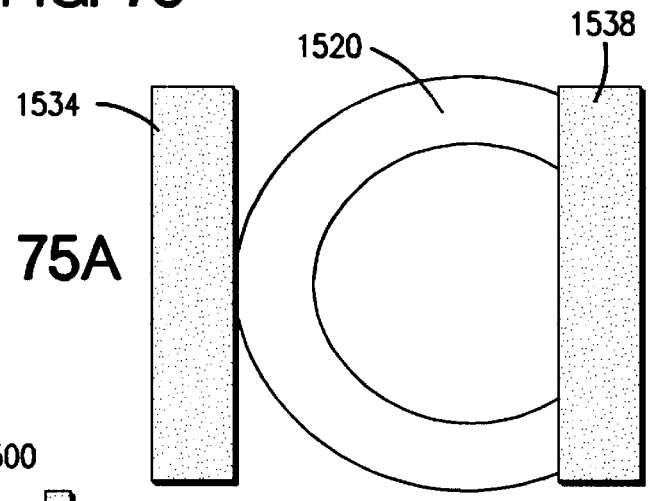
FIG. 75A is a bottom plan view of one blank of FIG. 75.
Figure 76:
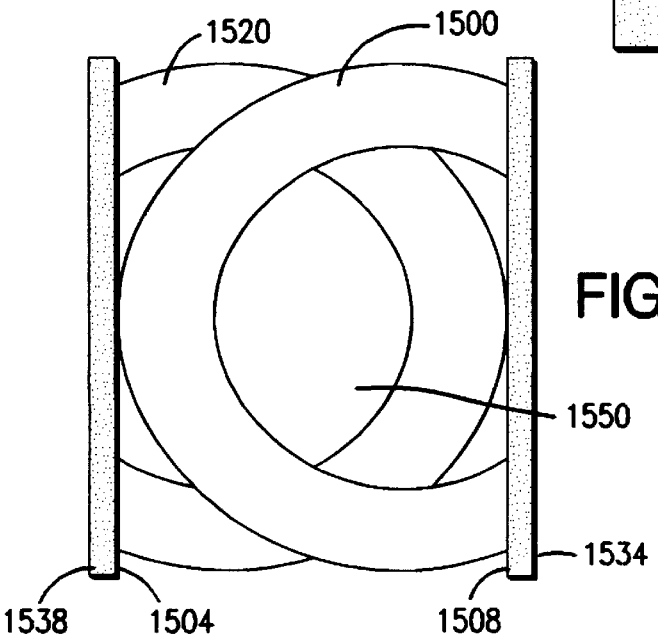
FIG. 76 is a front elevational view of the cylinder formed by detachably attaching the ends of the two blanks of FIG. 75.

Referring to FIG. 75, shown are top plan views of two preferably identical blanks 1500 and 1520, with cutouts to form the initial "C" and preferably made of an insulating or non-insulating material, such as rubber, leather or neoprene. Two end surface fasteners 1504 and 1508 are preferably permanently attached across the width and at the ends of the blank 1500. Likewise, two end surface fasteners 1524 and 1528 are preferably permanently attached across the width and at the ends of the blank 1520. FIG. 75A shows a bottom plan view of the blank 1520. Two strap surface fasteners 1534 and 1538 are preferably permanently attached across the width and at the ends of the blank 1520. The end surface fasteners 1504 and 1508 are complementary to the end surface fasteners 1524 and 1528. Preferably, the blanks 1500 and 1520 have widths of approximately 4¼" (10.8 cm) and lengths of approximately 5½" (13.97 cm). Preferably, the end surface fasteners 1504, 1508, 1524, and 1528 have widths of approximately 1" (2.54 cm). The end surface fasteners 1504 and 1508 are joined to the end surface fasteners 1528 and 1524, respectively, to form a cylinder 1550 as shown in FIG. 76. The strap surface fasteners 1534 and 1538 are shown exterior to the cylinder 1550 in FIG. 76.

Figure 77:
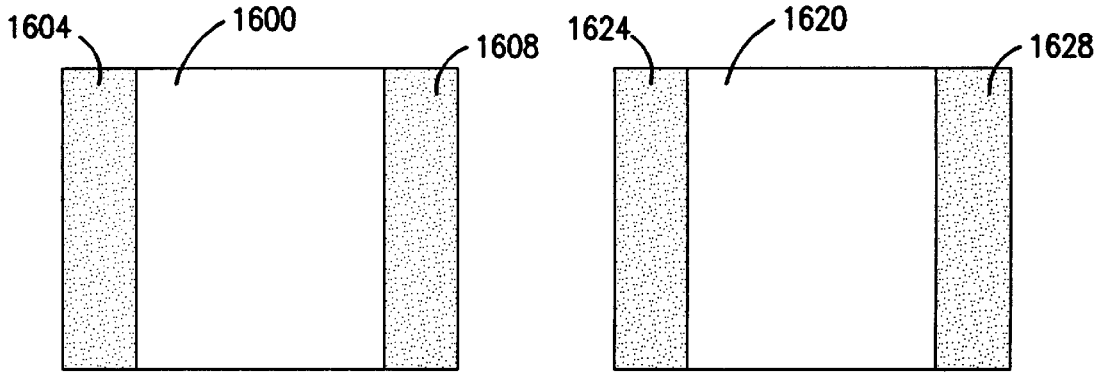
FIG. 77 is a top plan view of two blanks with end surface fasteners and strap surface fasteners at the ends before being joined together to form the frustoconical sleeve in FIGS. 78 and 79 or the cylinder of FIG. 80.
Figure 77A:
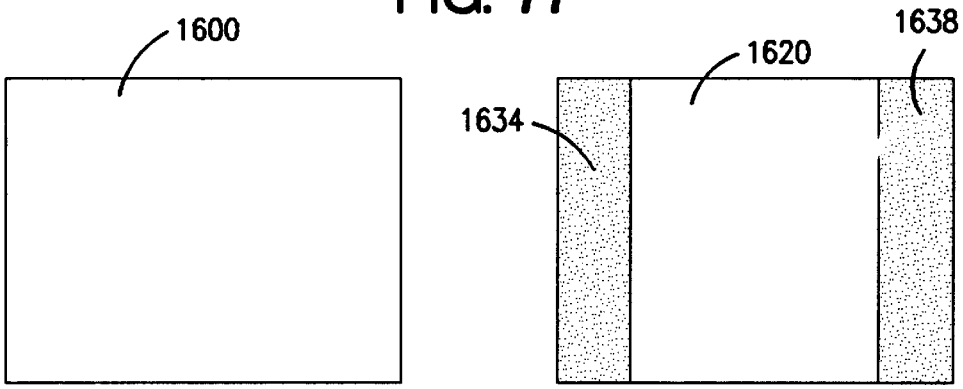
FIG. 77A shows bottom plan views of the blanks of FIG. 77.
Figure 78:
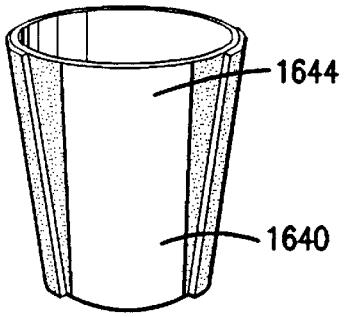
FIG. 78 is a front elevational view of the blanks of FIG. 77, after being joined together at the ends to form a frustoconical sleeve.
Figure 79:
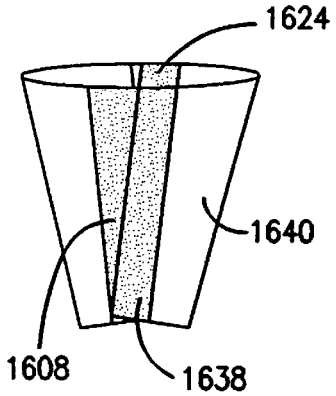
FIG. 79 is a side elevational view of the blanks of FIG. 77, after being joined together at the ends to form a frustoconical sleeve.
Figure 80:
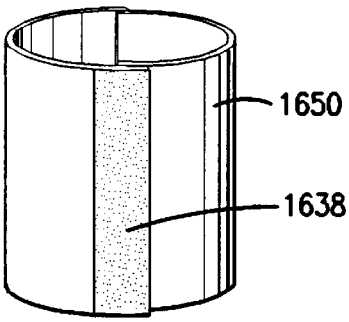
FIG. 80 is a side elevational view of the blanks of FIG. 77, after being joined together at the ends to form a cylinder.

Referring to FIG. 77, shown are top plan views of two preferably identical blanks 1600 and 1620, preferably made of an insulating or non-insulating material, such as rubber, leather or neoprene. Two end surface fasteners 1604 and 1608 are preferably permanently attached across the width and at the ends of the blank 1600. Likewise, two end surface fasteners 1624 and 1628 are preferably permanently attached across the width and at the ends of the blank 1620. FIG. 77A shows bottom plan views of the blanks 1600 and 1620. Two strap surface fasteners 1634 and 1638 are preferably permanently attached across the width and at the ends of the blank 1620 while the bottom surface of blank 1600 is preferably without surface fasteners. The end surface fasteners 1604 and 1608 are complementary to the end surface fasteners 1624 and 1628. Preferably, the blanks 1600 and 1620 have widths of approximately 4¼" (10.8 cm) and lengths of approximately 5½" (13.97 cm). Preferably, the end surface fasteners 1604, 1608, 1624, 1628 and strap surface fasteners 1634 and 1638 have widths of approximately 1½" (3.81 cm). The end surface fasteners 1604 and 1608 are joined to the end surface fasteners 1624 and 1628 with the blanks 1600 and 1620 angularly displaced to form a frustoconical sleeve 1640 as shown in FIGS. 78 (front plan view) and 79 (side plan view), or with the blanks 1600 and 1620 joined without angular displacement to form a cylinder 1650 as shown in FIG. 80. The blanks 1600 and 1620 may be of contrasting colors or patterns. Additionally, two end surface fasteners may be preferably permanently attached across the width and at the ends of the bottom surface of the blank 1600, thus making all ends of the blanks 1600 and 1620 double-sided. Providing blanks of varied colors and patterns with double-sided ends makes endless the possibilities of creating embodiments to suit different personal tastes.

It should be noted that the embodiment formed from the blanks 1600 and 1620 of FIGS. 77 and 77A is preferable to the embodiment formed from the blanks 700 and 720 of FIGS. 50 and 51 because, without the strap surface fasteners 708 and 728 of FIGS. 50 and 51, a larger clear area 1644 of FIG. 78 is available on which to place personalized markings, advertisements, logos and other indicia.

It should also be noted that the embodiment of FIG. 77 is preferable to the embodiment of FIG. 37 because the wider end surface fasteners 1604, 1608, 1624 and 1628 provide a more secure attachment of the ends of the blanks 1600 and 1620. Also, the wider strap surface fasteners 1634 and 1638 create a more attractive frustoconical sleeve.

Figure 81:
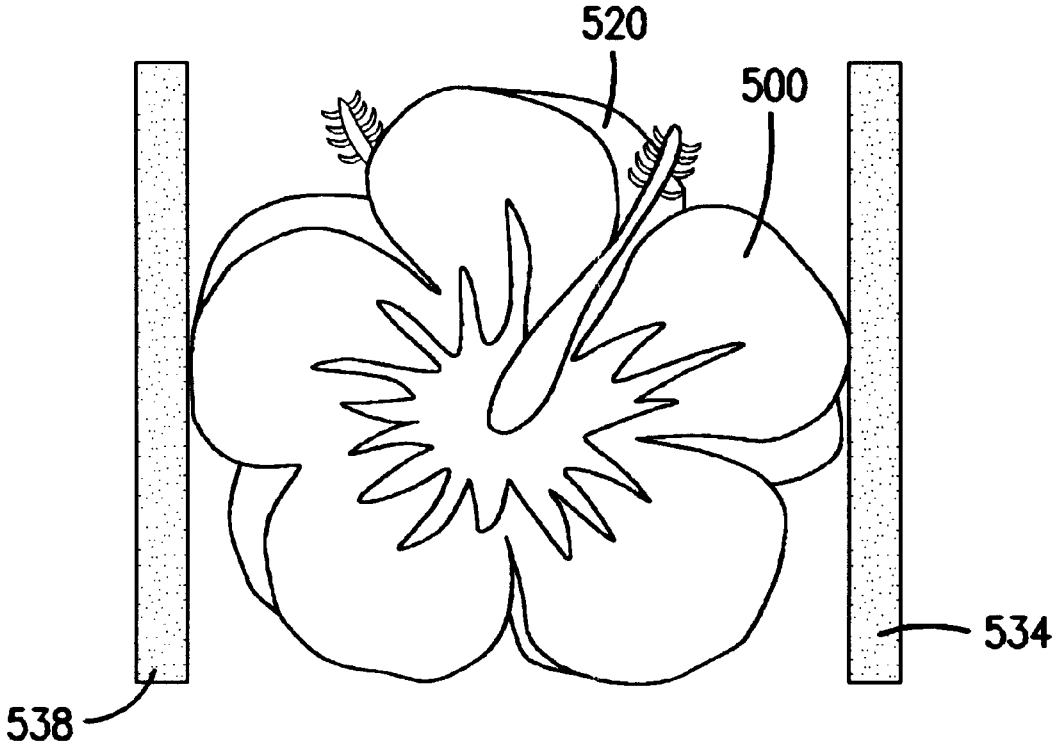
FIG. 81 shows a cylinder displaying a hibiscus flower that can be formed from cutouts of the blanks of FIG. 37.

FIG. 81 shows a cylinder displaying a hibiscus flower that can be formed from cutouts of the blanks of FIG. 37. This embodiment would be a particularly commercially viable embodiment to target the tourist industry in Hawaii.

Figure 82:
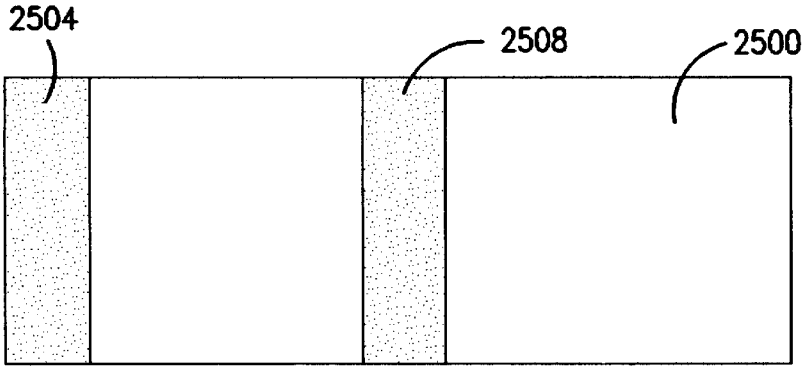
FIG. 82 is a top plan view of a blank according to the present invention before being joined at the ends to form cylinder or a frustoconical sleeve. An strap surface fastener is approximately centered between the ends of the blank.

Referring to FIG. 82, shown is a top plan view of a blank 2500, preferably made of an insulating or non-insulating material, such as rubber, leather or neoprene. A first end surface fastener 2504 is preferably permanently attached at an end and across the width of the blank 2500. A strap surface fastener 2508 is preferably permanently attached at approximately the center and across the width of the blank 2500.

Figure 82A:
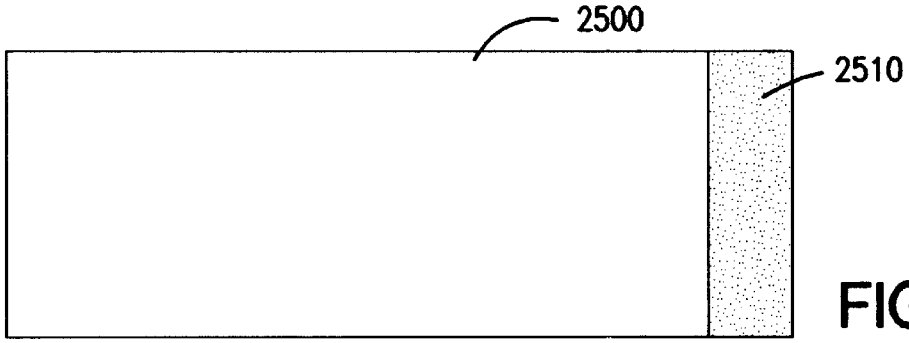
FIG. 82A is a bottom plan view of the blank of FIG. 82.

FIG. 82A shows a bottom plan view of the blank 2500. A second end surface fastener 2510 is placed at the opposite end and on the opposite surface from first end surface fastener 2504. Preferably second end surface fastener 2510 is complementary to first end surface fastener 2504. Preferably, the blank has a width of approximately 4¼" (10.8 cm) and length of approximately 10½" (26.7 cm). Preferably, the end surface fasteners 2510 and 2504 have widths of approximately 1½" (3.817 cm.)

Figure 82B:
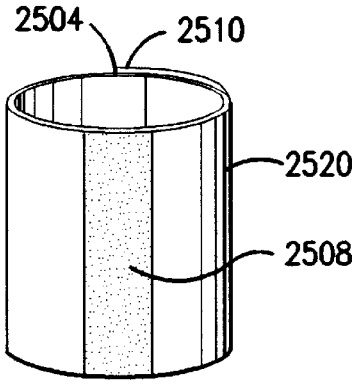
FIG. 82B is a side elevational view of FIG. 82 after the end surface fasteners were joined together to form a cylindrical sleeve.

Referring to FIG. 82B, the end surface fasteners 2504 and 2510 of FIGS. 82 and 82A respectively, are joined together to form a cylinder 2520.

Figure 82C:
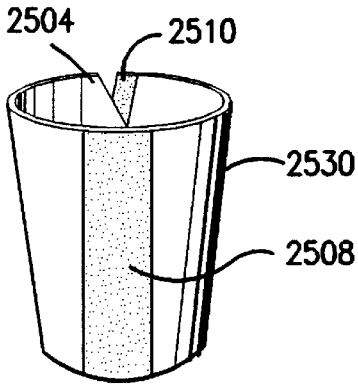
FIG. 82C is a side elevational view of the blank of FIG. 82 after the end surface fasteners were joined together form a frustoconical sleeve.

Referring to FIG. 82C, the end surface fasteners 2504 and 2510 of FIGS. 82 and 82A respectively, are joined together at an angular displacement to form a truncated-conical (frustoconical) sleeve 2530.

Figure 83:
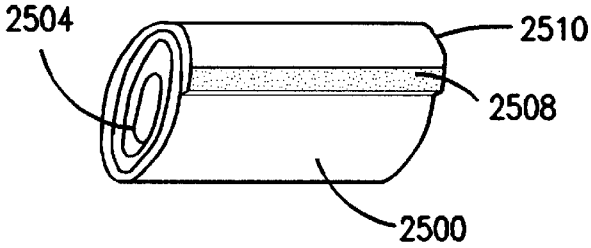
FIG. 83 illustrates the holder according to this present invention rolled and compacted in a jellyroll-like fashion. As this embodiment of the invention does not include a holder strap, there is no holder strap in the middle of the "roll." The holder is compacted and maintained in its compacted state by attaching one end surface fastener to a strap surface fastener placed between the ends of the blank. Note that the end surface fastener and the strap surface fastener that attaches to it are on opposite surfaces of the blank.

Referring to FIG. 83, after the blank 2500 of FIG. 82 is rolled and compacted, end surface fastener 2510 of FIG. 82A on the bottom surface of blank 2500 attaches to a complementary strap surface fastener 2508 of FIG. 82 on the top surface of blank 2500 to retain the holder in a compacted state.

FIGS. 82–83 illustrate how a strap surface fastener approximately centered between the ends of the blank provides a means to retain the holder in a compacted state.

When the blank 2500 is rolled up, the strap surface fastener attaches to an end surface fastener to compact the holder and maintain the 30 compacted state.

Figure 84:
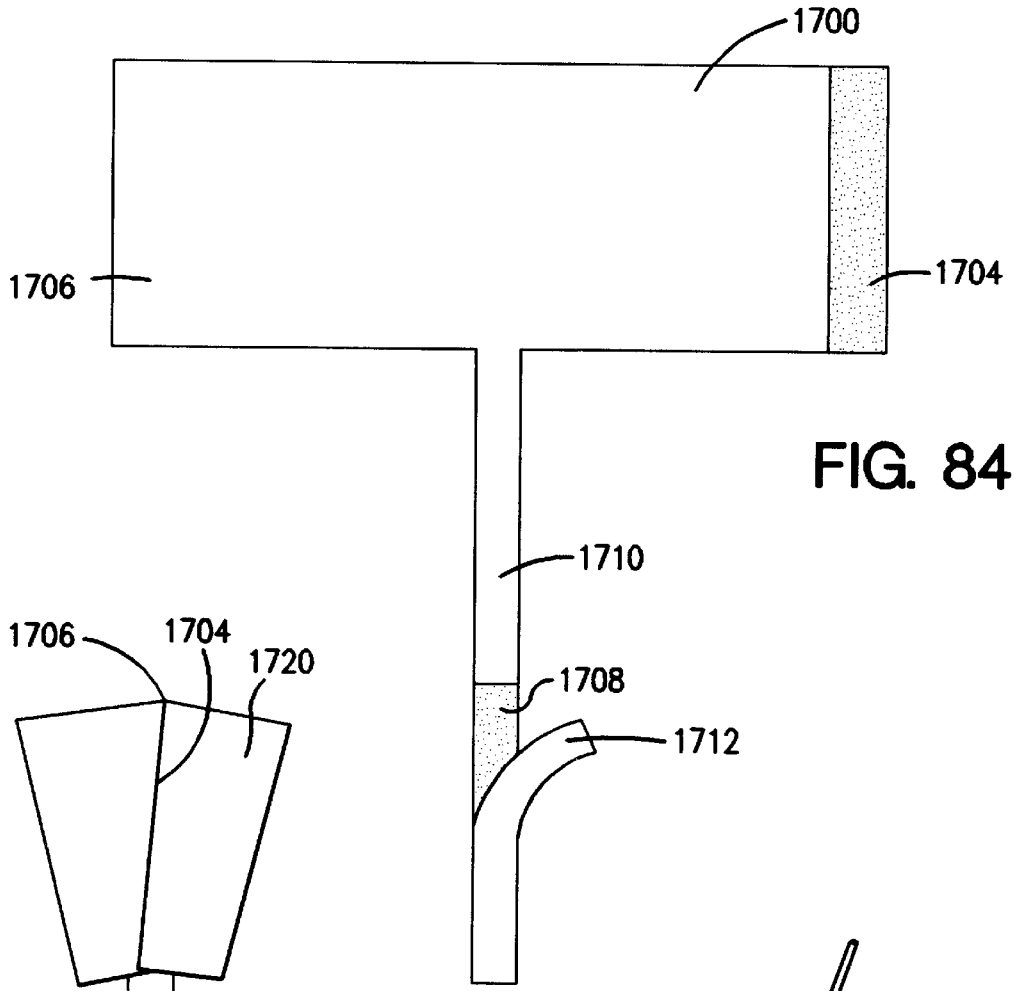
FIG. 84 is a top plan view of a blank of a preferably disposable material, having an extension preferably integrally formed. At the end of the extension is a preferably adhesive surface fastener, preferably removable plastic covering.

FIG. 84 is a top plan view of a blank 1700 of a preferably disposable material, having an extension 1710 preferably integrally formed. At the end of the extension is a surface fastener 1708, preferably a contact adhesive and preferably with a removable covering1712. An end surface fastener, preferably a contact adhesive, is placed at one end 1704 of the blank.

Figure 85:
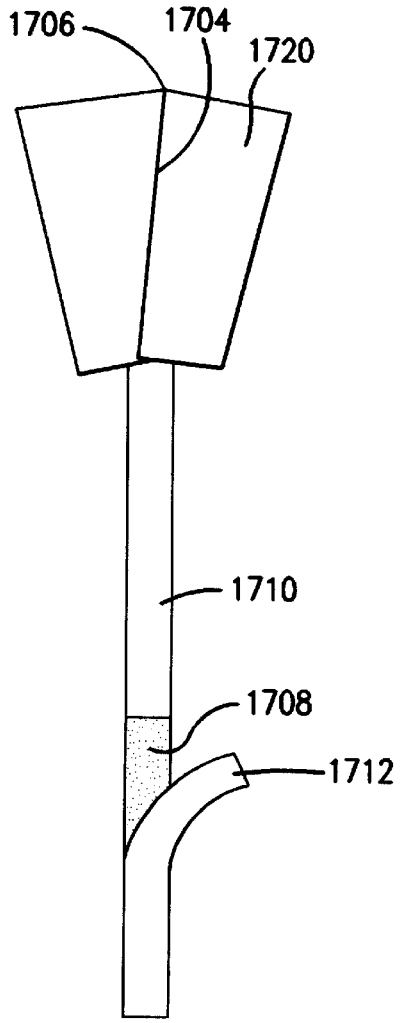
FIG. 85 is a front elevational view of the blank of FIG. 84 after joining the ends together to form a frustoconical sleeve with an extension.

FIG. 85 is a front elevational view of the blank of FIG. 84 after joining the ends 1704 and 1706 together to form a frustoconical sleeve 1720 with an extension 1710.

Figure 86:
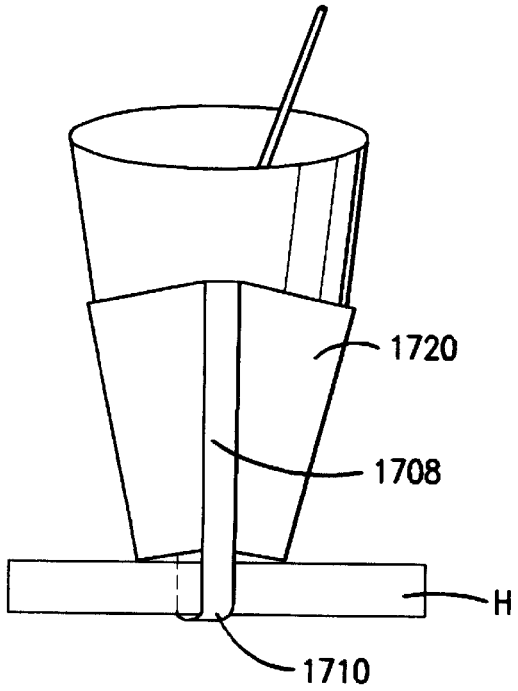
FIG. 86 is a front elevational view of a beverage secured to a horizontal member using the embodiment of FIG. 85. After the holder is placed on the horizontal member, the extension is looped under and around the horizontal member and then preferably adhesively joined to the sleeve of the holder.

FIG. 86 is a front elevational view of a beverage secured to a horizontal member H using the embodiment of FIG. 85. After the sleeve 1720 of the holder is placed on the horizontal member, the extension 1710 is looped under the horizontal member after which, the end of the extension 1708 is joined to the holder opposite the side where the extension began.

Figure 87:
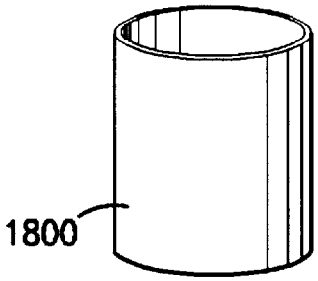
FIG. 87 is a front elevational view of a cylindrical sleeve according to the present invention. The sleeve is preferably made of a disposable material such as cardboard or plastic.

FIG. 87 is a front elevational view of a cylindrical sleeve according to the present invention. The sleeve is preferably made of a disposable material such as cardboard or plastic.

Figure 88:
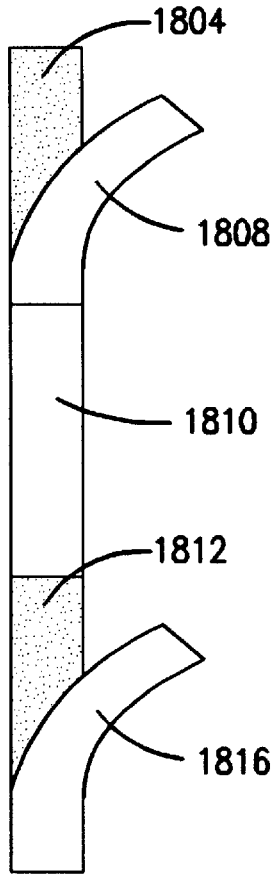
FIG. 88 is a holder strap, preferably made of a disposable material. At each end of the strap is a contact adhesive preferably with a removable plastic covering.

FIG. 88 shows a holder strap 1810, preferably made of a disposable material. At each end 1804 and 1812 of the holder strap is a contact adhesive preferably with a removable covering 1808 and 1816.

Figure 89:
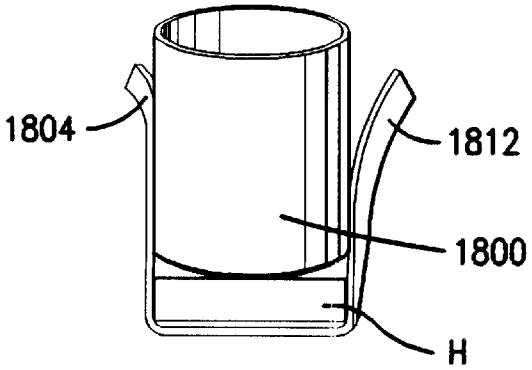
FIG. 89 is a front elevational view of the holder according to the present invention attached to a horizontal member using the cylinder of FIG. 87 and the holder strap of FIG. 88 after the plastic coverings are removed and the ends are joined to the sleeve.

FIG. 89 is a front elevational view of the holder according to the present invention attached to a horizontal member H. After placing the cylinder 1800 of FIG. 87 on the horizontal member, one end 1804 of the holder strap 1810 of FIG. 88 is joined to one side of the cylinder after the plastic covering is removed. The holder strap 1810 then loops under the horizontal member and the remaining end 1812 of the holder strap 1810 attaches to the side opposite from where the holder strap was initially attached.

Figure 90:
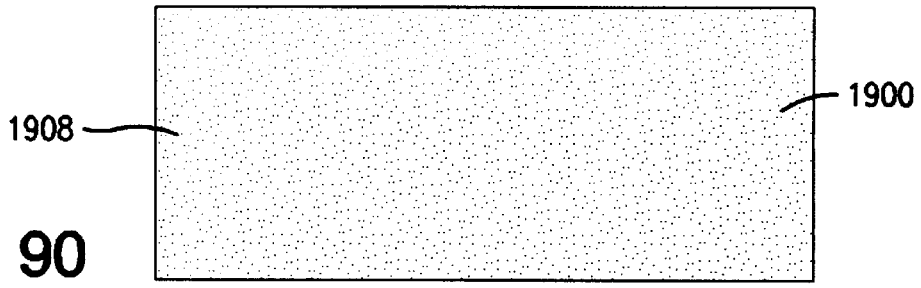
FIG. 90 is a top plan view of a blank according to the present invention before being joined at the ends to form a cylinder or a frustoconical sleeve. The entire surface of the blank consists of a surface fastener such as a loop element surface fastener.

Referring to FIG. 90, shown is a top plan view of a blank 1900 before being joined at the sides to form a cylinder or a frustoconical sleeve. The entire surface of the blank consists of a surface fastener (such as a loop element surface fastener) and functions as a strap surface fastener.

Figure 91:
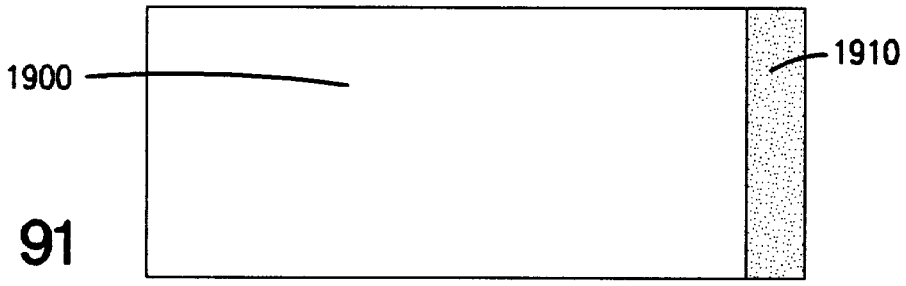
FIG. 91 is a bottom plan view of the blank of FIG. 90.

Referring to FIG. 91, shown is a bottom plan view of the blank 1900 of FIG. 90. An end surface fastener 1910, which is complementary to the surface fastener on the top surface, is placed across the width and at one end of blank 1900. Preferably, the blank has a width of approximately 4¼" (10.8 cm) and length of approximately 10½" (26.7 cm). Preferably, the end surface fastener 1910 has a width of approximately 1½" (3.817 cm.)

Figure 92:
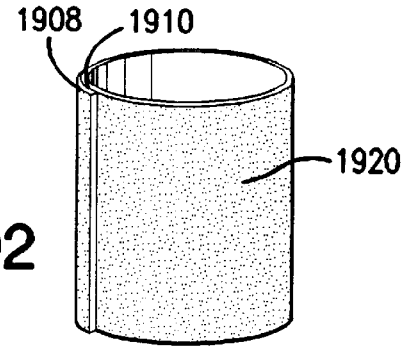
FIG. 92 is a front elevational view of the blank of FIG. 90 after the ends were joined together to form a cylindrical sleeve.

Referring to FIG. 92, the ends 1910 and 1908 are joined together to form a cylinder 1920.

Figure 93:
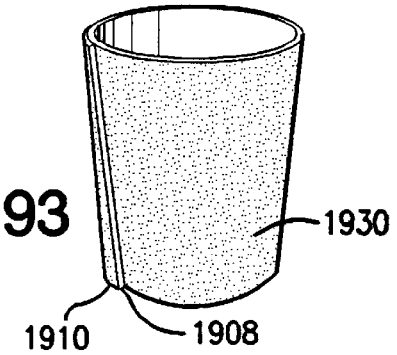

Referring to FIG. 93, the ends 1910 and 1908 are joined together at an angular displacement to form the frustoconical sleeve 1930 of FIG. 93.

Figure 94:
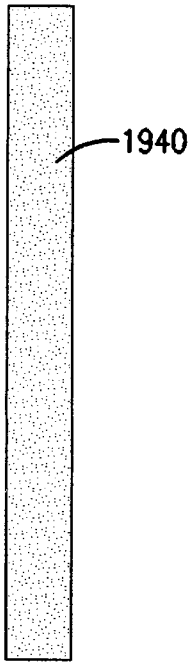

FIG. 94 is a holder strap 1940 that is complementary to the surface fastener on the blank 1900 of FIG. 90.

Figure 95:
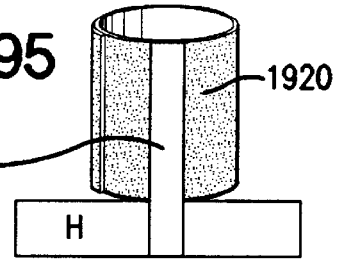

FIG. 95 is an elevational view of the cylinder 1920 of FIG. 92 attached to a horizontal member H by means of the holder strap 1940 of FIG. 94. It should be noted that the holder strap may attach anywhere to the exterior surface of the holder.

Figure 96:
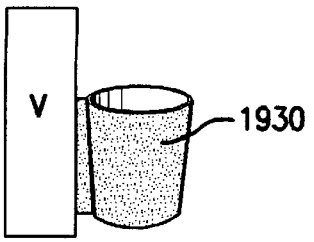

FIG. 96 is an elevational view of the frustoconical sleeve 1930 of FIG. 93 attached to a vertical member V by means of a complementary mounting surface fastener mounted to the vertical member. It should be noted that the complementary mounting surface fastener may attach anywhere to the exterior surface of the holder.

Figure 97:
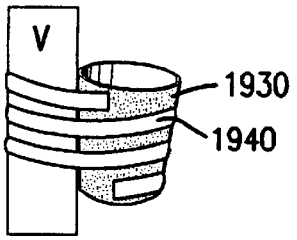

FIG. 97 is an elevational view of the frustoconical sleeve 1930 of FIG. 93 attached to a vertical member V by means of the holder strap 1940 of FIG. 94. It should be noted that the holder strap may attach anywhere to the exterior surface of the holder.

Figure 98:
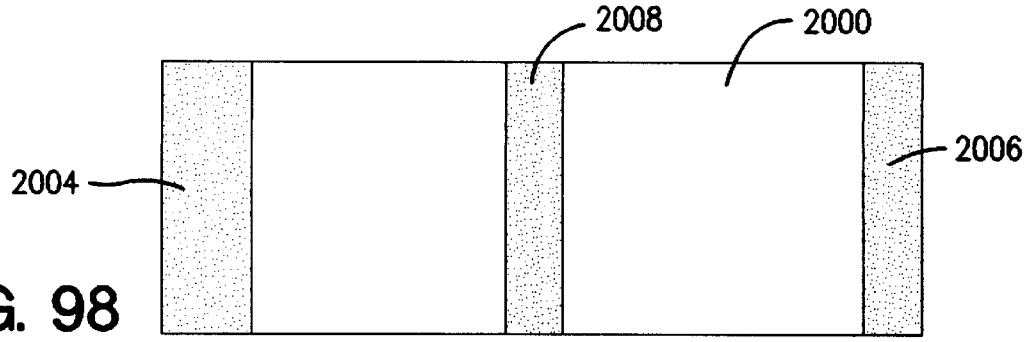

Referring to FIG. 98, shown is a top plan view of a blank 2000, preferably made of an insulating or non-insulating material, such as rubber, leather or neoprene. A first end surface fastener 2004 is preferably permanently attached at an end and across the width of the blank 2000. A first strap surface fastener 2006 is preferably permanently attached at the opposite end and across the width of the blank 2000. A second strap surface fastener 2008 is preferably permanently attached at approximately the center and across the width of the blank 2000. Preferably end surface fastener 2004 has a width of 2" (5.08 cm). This preferred width of 2" (5.08 cm) allows the holder to accommodate a wide range of circumferences including the larger circumferences of popular frustoconical beverage cups and soda cans to the smaller circumferences of 16 ounce (473 ml) water bottles. It should be noted that smaller circumferences may be accommodated by increasing the width of the end surface fastener 2004 or decreasing the size of the blank 2000. Of course, beverage containers with very large circumferences may be accommodated by increasing the size of the blank 2000.

Figure 99:
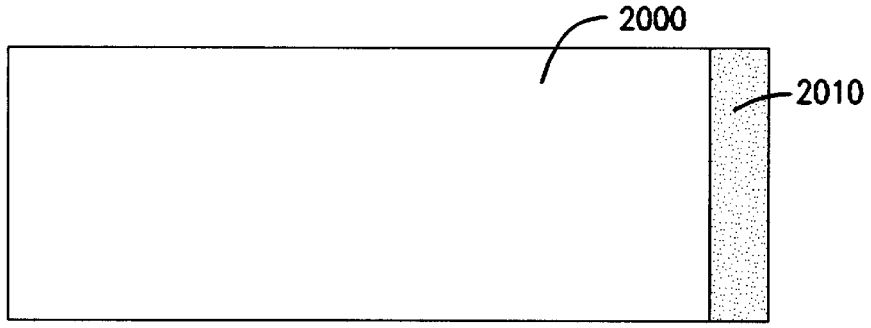

FIG. 99 shows a bottom plan view of the blank 2000 of FIG. 98. A second end surface fastener 2010 is placed at the same end but on the opposite surface from first strap surface fastener 2006. Preferably second end surface fastener 2010 is complementary to first end surface fastener 2004. Preferably, the blank has a width of approximately 4¼" (10.8 cm) and length of approximately 10½" (26.7 cm). Preferably, end surface fastener 2010 has a width of approximately 1½" (3.817 cm.).

Figure 100:
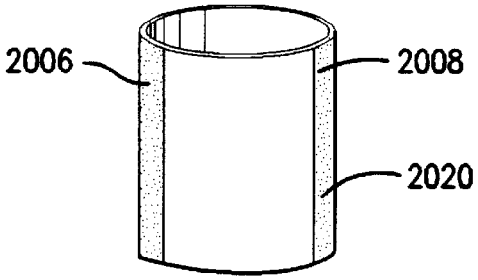

Referring to FIG. 100, the end surface fasteners 2010 and 2004 of FIGS. 98 and 99 are joined together to form a cylinder 2020.

Figure 101:
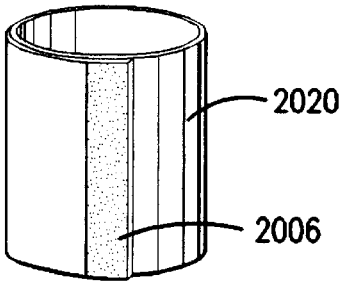

FIG. 101 is a side elevational view of the cylinder 2020 of FIG. 100.

Figure 102:
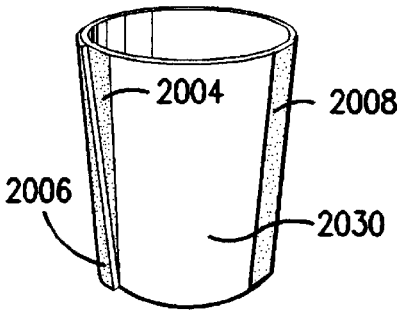

Referring to FIG. 102 the end surface fasteners 2010 and 2004 of FIGS. 98 and 99 are joined together at an angular displacement to form a truncated-conical (frustoconical) sleeve 2030.

Figure 103:
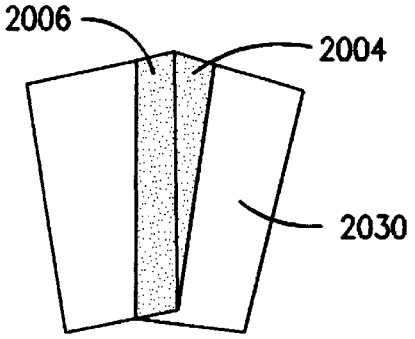

FIG. 103 is a side elevational view of the truncated-conical (frustoconical) sleeve 2030 of FIG. 102.

Referring to FIG. 104, shown is a top plan view of a blank 2050, preferably made of an insulating or non-insulating material, such as rubber, leather or neoprene. A first end surface fastener 2054 is preferably permanently attached at the end and across the width of the blank 2050. A first strap surface fastener 2056 is preferably permanently attached at the opposite end and across the width of the blank 2050. A second strap surface fastener 2058 is preferably permanently attached at the center and across the width of the blank 2050.

Referring to FIG. 105, shown is a bottom plan view of the blank 2050. A second end surface fastener 2060 is placed at the same end but on the opposite surface from first strap surface fastener 2056. Preferably second end surface fastener 2060 is complementary to first end surface fastener 2054. A third end surface fastener 2064 is preferably permanently attached at the opposite end from second end surface fastener 2060 and across the width of the blank 2050. A third strap surface fastener 2068 is preferably permanently attached at the center and across the width of the blank 2050.

Referring to FIG. 106, the end surface fasteners 2060 and 2054 of FIGS. 105 and 104, respectively, are joined together to form a cylinder 2070. Alternatively, the end surface fasteners 2060 and 2054 may be joined together with an angular displacement to form a truncated-conical (frustoconical) sleeve 2080 as shown in FIG. 107. Note that the top surface of the blank 2050, which is shown in FIG. 104 and is labeled with indicia X, is on the exterior.

Referring to FIG. 108, the first strap surface fastener 2056 of FIG. 104 functions as an end surface fastener to join with third end surface fastener 2064 of FIG. 105 to form a cylinder 2090 with the surface of the blank shown in FIG. 105 on the exterior. Alternatively, the end surface fasteners 2056 and 2064 may be joined together with an angular displacement to form a truncated-conical (frustoconical) sleeve 2095 as shown in FIG. 109. Note that the bottom surface of the blank 2050, which is shown in FIG. 105 and is labeled with indicia Z, is on the exterior.

FIGS. 104–109 together illustrate an embodiment in which end surface fasteners may be joined to form a cylinder or frustoconical sleeve with either the top or bottom surface on the exterior of the sleeve. Thus two different exterior surfaces may be formed from the same blank. This may be desirable if a person desires to vary the look of the holder by printing different colors, indicia, or designs on the two surfaces of a blank.

FIG. 110 illustrates the holder according to this present invention using the blank 2000 of FIG. 98 rolled and compacted with strap 130 of FIG. 2 and end surface fastener 2004 on the blank 2000 in the center of the "roll". End surface fastener 2010 of FIG. 99 attaches to a complementary strap surface fastener 2008 of FIG. 98 to retain the holder in a compacted state. Note that the attachment of end surface fastener 2010 of FIG. 99 on the bottom surface of blank 2000 to strap surface fastener 2008 of FIG. 98 on the top surface of blank 2000 is what allows the holder to be maintained in its compacted state. Note also that end surface fastener 2010 is not shown in FIG. 110 because it is at the same end but on the opposite surface of strap surface fastener 2006. Also note that the holder may also be rolled and compacted without the strap in the center of the roll.

Referring to FIG. 111, shown is a top plan view of a blank 5000, preferably made of an insulating or non-insulating material, such as rubber, leather or neoprene. A first end surface fastener 5004 is preferably permanently attached at an end and across the width of the blank 5000. A first end 5006 of a holder strap 5005 is preferably permanently attached at the opposite end and across the width of the blank 5000. A strap surface fastener 5008 is preferably permanently attached at approximately the center and across the width of the blank 5000. Preferably second end 5012 of holder strap 5005 is complementary to strap surface fastener 5008. Preferably, blank 5000 has a width of approximately 4¼" (10.8 cm) and length of approximately 10½" (26.67 cm). Preferably, first end surface fastener 5004 has a width of 2" (5.08 cm). Preferably strap surface fastener 5008 has a width of 1½" (3.82 cm) and holder strap 5005 has a width of 1" (2.54 cm).

FIG. 112 shows a bottom plan view of the blank 5000 of FIG. 111. A second end surface fastener 5010 is placed at the same end but on the opposite surface from first end 5006 of holder strap 5005. Preferably second end surface fastener 5010 is complementary to first end surface fastener 5004. Preferably, second end surface fastener 5010 has a width of approximately 1½" (3.82 cm.)

Referring to FIG. 113, the end surface fasteners 5010 (not shown) and 5004 are joined together to form a cylinder 5020. When cylinder 5020 is formed, strap surface fastener 5008 is approximately diametrically opposite to first end 5006 of holder strap 5005. The cylinder 5020 is secured to a horizontal member H by extending holder strap 5005 around the horizontal member and attaching second end 5012 of holder strap 5005 to strap surface fastener 5008.

Referring to FIG. 114 the end surface fasteners 5010 (not shown) and 5004 are joined together at an angular displacement to form a truncated-conical (frustoconical) sleeve 5030. When sleeve 5030 is formed, strap surface fastener 5008 (not shown) is approximately diametrically opposite to first end 5006 of holder strap 5005. A holder bottom HB is formed by extending the holder strap 5005 across the bottom of the sleeve 5030 and afterwards attaching the holder strap to strap surface fastener 5008. Next, a loop L is formed by attaching second end 5012 of holder strap 5005 to first end surface fastener 5004 at the top of sleeve 5030.

FIG. 115 illustrates the holder according to this present invention using the blank 5000 of FIG. 111 rolled and compacted. Second end surface fastener 5010 attaches to a complementary strap surface fastener 5008 to retain the holder in a compacted state. Note that the attachment of second end surface fastener 5010 on the bottom surface of blank 5000 to strap surface fastener 5008 on the to surface of blank 5000 maintains the holder in its compacted state. Note that holder strap 5005 may be neatly compacted with the rolled up blank 5000 by threading second end 5012 of the holder strap through the center of the roll and thereafter attaching it to strap surface fastener 5008.

Industrial Applicability

This invention can be used anywhere it is desired to hold a beverage container.

What is claimed is:

1. The holder for a beverage container, said container having a minimum circumference, comprising:

a blank made of a flexible material having a width and first and second ends;

a first end surface fastener attached near said first end of said blank;

a second end surface fastener, complementary to said first end surface fastener, attached near said second end of said blank;

at least two strap surface fasteners attached to said blank spaced apart from each other by approximately half of said circumference, wherein said strap surface fasteners comprise fasteners in which two complementary surfaces may be detachably fastened when brought in contact with each other, regardless of orientation;

whereby joining said first and second end surface fasteners detachably attaches said ends of said blank together, whereby said blank forms a hollow shape having a substantially circular cross section with a circumference adapted to be approximately at least as large as said minimum circumference of said beverage container, said shape being configured to receive said beverage container, and said strap surface fasteners being approximately diametrically opposite each other;

whereby said ends of said blank can be detached from each other, said blank can be collapsed to a compacted configuration, and one of said end surface fasteners can attach to one of said strap surface fasteners to retain said blank in said compacted configuration.

2. A holder for a beverage container according to claim 1, wherein said blank is arc shaped whereby said blank forms a hollow substantially frustoconical shape.

3. The holder for a beverage container according to claim 1, wherein said blank is substantially rectangular and whereby said blank forms a cylinder having a substantially circular cross section with a circumference adapted to be approximately at least as large as said minimum circumference of said beverage container, said cylinder being configured to receive said beverage container, and said strap surface fasteners being approximately diametrically opposite each other.

4. A holder for a beverage container, said container having a minimum circumference, comprising:

a substantially rectangular blank made of a flexible material having cutouts, said blank having a length, first and second ends, and inner and outer surfaces, said length being approximately at least as great as said minimum circumference of said container;

a first end surface fastener attached to said inner surface near said first end of said blank;

a second end surface fastener, complementary to said first end surface fastener, attached to said outer surface near said second end of said blank;

at least two strap surface fasteners attached to said outer surface, spaced apart by approximately half of said minimum circumference, wherein said strap surface fasteners comprise fasteners in which two complementary surfaces may be detachably fastened when brought in contact with each other, regardless of orientation;

whereby joining said first and second end surface fasteners detachably attaches said ends of said blank together, whereby said blank forms a hollow shape having cutouts with said strap surface fasteners on said outer surface approximately diametrically opposite each other, said shape having a substantially circular cross section with a circumference adapted to be approximately at least as large as said minimum circumference of said container and said shape being configured to receive said container.

5. A holder for a beverage container, said container having a minimum circumference, comprising:

an integrally formed hollow shape having an outer surface and a circumference adapted to be approximately at least as great as said minimum circumference of said container, said shape being configured to receive said container;

at least two strap surface fasteners attached to said outer surface, approximately diametrically opposite each other, wherein said strap surface fasteners comprise fasteners in which two complementary surfaces may be detachably fastened when brought in contact with each other, regardless of orientation;

a separate flexible holder strap having first and second ends;

a first holder surface fastener attached near said first end of said strap;

a second holder surface fastener attached near said second end of said strap;

wherein said holder surface fasteners are complementary to said strap surface fasteners;

whereby said first holder surface fastener on said strap can be detachably attached to a first strap surface fastener to secure said first end of said strap to said shape, said strap can extend around a member adjacent to said shape, and said second holder surface fastener on said strap can be detachably attached to a second strap surface fastener to secure said shape to said member; and whereby at least one of said holder surface fasteners can be detached from said hollow shape, said shape can be collapsed to a compacted configuration, said strap can be wrapped around said shape, and at least one of said holder surface fasteners detachably attaches to at least one of said strap surface fasteners to retain said shape in said compacted configuration.

6. A holder for a beverage container comprising:

a first piece made of a flexible material having a height and two sides defining a first width;

a first sleeve surface fastener attached to each side of said first piece;

a second piece made of a flexible material having a height approximately equal to said height of said first piece and two sides defining a second width;

a second sleeve surface fastener complementary to said first sleeve surface fastener attached to each side of said second piece;

whereby attaching said first sleeve surface fasteners to corresponding ones of said second sleeve surface fasteners at an angular offset joins said pieces to form a substantially frustoconical sleeve, whereby a substantially frustoconical beverage container can be received in said sleeve;

whereby attaching said first sleeve surface fasteners to corresponding ones of said second sleeve surface fasteners approximately parallel to said sides joins said pieces to form an approximately cylindrical sleeve, whereby a substantially cylindrical beverage container can be received in said sleeve;

at least two strap surface fasteners, wherein said strap surface fasteners comprise fasteners in which two complementary surfaces may be detachably fastened when brought in contact with each other, regardless of orientation, at least one of which is attached to at least one of said pieces, spaced apart by approximately half the sum of said first width and said second width when said pieces are joined together, whereby said strap surface fasteners can be used to carry away said beverage container for portability purposes.

7. A holder for a beverage container, said container having a minimum circumference, comprising:

a blank made of a flexible material having a width and first and second ends;

at least two strap surface fasteners attached to said blank spaced apart from each other by approximately half of said circumference, wherein said strap surface fasteners comprise fasteners in which two complementary surfaces may be detachably fastened when brought in contact with each other, regardless of orientation;

wherein said ends of said blank are permanently attached together to form a hollow shape having a substantially circular cross section with a circumference adapted to be approximately at least as large as said minimum circumference of said container, said shape being configured to receive said container, and said strap surface fasteners being approximately diametrically opposite each other;

a separate flexible holder strap having first and second ends;

a first holder surface fastener attached near said first end of said strap;

a second holder surface fastener attached near said second end of said strap ;

wherein said holder surface fasteners are complementary to said strap surface fasteners;

whereby said first holder surface fastener on said holder strap can be detachably attached to a first of said strap surface fasteners to secure said first end of said strap to said hollow shape, said strap can extend around a member adjacent to said hollow shape, and said second holder surface fastener on said strap can be detachably attached to a second of said strap surface fasteners to secure said hollow shape to said member;

whereby at least one of said holder surface fasteners can be detached from said hollow shape, said blank can be collapsed to a compacted configuration, said strap can be wrapped around said blank, and at least one of said holder surface fasteners detachably attaches to at least one of said strap surface fasteners to retain said blank in said compacted configuration.

8. A holder for a beverage container, said container having a minimum circumference, comprising:

a blank made of a flexible material having a width and first and second ends;

a first end surface fastener attached near said first end of said blank;

a second end surface fastener, complementary to said first end surface fastener, attached near said second end of said blank;

a strap surface fastener attached to said blank intermediate between said end surface fasteners, wherein said strap surface fastener comprises a fastener in which two complementary surfaces may be detachably fastened when brought in contact with each other, regardless of orientation;

whereby joining said first and second end surface fasteners detachably attaches said ends of said blank together, whereby said blank forms a hollow shape having a substantially circular cross section with a circumference adapted to be approximately at least as large as the minimum circumference of said beverage container, said shape being configured to receive said beverage container;

whereby said hollow shape can be configured to receive beverage containers having varying diameters and to receive both frustoconical and cylindrical beverage containers, by attaching said end surface fasteners to each other at different positions and by attaching said end surface fasteners to each other at an angular offset; and whereby said ends of said blank can be detached from each other, said blank can be rolled into a jellyroll configuration, and said strap surface fastener can detachably attach to one of said end surface fasteners to retain said blank in said jellyroll configuration.

9. A holder for a beverage container, said container having a minimum circumference, comprising:

a blank made of a flexible material having cutouts, said blank having a width and first and second ends;

a first end surface fastener attached near said first end of said blank;

a second end surface fastener, complementary to said first end surface fastener, attached near said second end of said blank;

at least two strap surface fasteners attached to said blank spaced apart from each other by approximately half of said circumference, wherein said strap surface fasteners comprise fasteners in which two complementary surfaces may be detachably fastened when brought in contact with each other, regardless of orientation;

whereby joining said first and second end surface fasteners detachably attaches said ends of said blank together, whereby said blank forms a hollow shape having a substantially circular cross section with a circumference adapted to be approximately at least as large as said minimum circumference of said beverage container, said shape being configured to receive said beverage container, and said strap surface fasteners being approximately diametrically opposite each other;

whereby said ends of said blank can be detached from each other, said blank can be collapsed to a compacted configuration, and one of said end surface fasteners can attach to one of said strap surface fasteners to retain said blank in said compacted configuration.

10. A holder for a beverage container, said container having a minimum circumference, comprising:

a substantially rectangular blank made of a flexible material, said blank having a length, first and second ends, and inner and outer surfaces, said length being approximately at least as great as said minimum circumference of said container;

a first end surface fastener attached to said inner surface near said first end of said blank;

a second end surface fastener, complementary to said first end surface fastener, attached to said outer surface near said second end of said blank;

at least two strap surface fasteners attached to said outer surface, spaced apart by approximately half of said minimum circumference, wherein said strap surface fasteners comprise fasteners in which two complementary surfaces may be detachably fastened when brought in contact with each other, regardless of orientation;

whereby joining said first and second end surface fasteners detachably attaches said ends of said blank together, whereby said blank forms a hollow shape with said strap surface fasteners on said outer surface approximately diametrically opposite each other, said hollow shape having a substantially circular cross section with a circumference adapted to be approximately at least as large as said minimum circumference of said container and said shape being configured to receive said container.

11. A holder for a beverage container, said container having a minimum circumference, comprising:

a blank made of a flexible material having a width and first and second ends;

a first end surface fastener attached near said first end of said blank;

a second end surface fastener, complementary to said first end surface fastener, attached near said second end of said blank;

a strap surface fastener attached to said blank, wherein said strap surface fastener comprises a fastener in which two complementary surfaces may be detachably fastened when brought in contact with each other, regardless of orientation;

a flexible holder strap having first and second ends;

a first end of said strap attached to said blank;

a holder surface fastener attached near said second end of said strap;

whereby joining said first and second end surface fasteners detachably attaches said ends of said blank together, whereby said blank forms a hollow shape having a substantially circular cross section with a circumference adapted to be approximately at least as large as said minimum circumference of said beverage container, said shape being configured to receive said beverage container, and said first end of said holder strap being approximately diametrically opposite said strap surface fastener;

whereby said bolder strap can extend around a member adjacent to said shape, and said holder surface fastener can be detachably attached to said strap surface fastener to secure said hollow shape to said member;

whereby said holder surface fastener can be detached from said hollow shape, said blank can be collapsed to a compacted configuration, said strap can be wrapped around said blank, and said holder surface fastener can detachably attach to said strap surface fastener to retain said blank in said compacted configuration.

12. A holder for a beverage container, said container having a minimum circumference, comprising:

a blank made of a flexible material having a width and first and second ends;

a strap surface fastener attached to said blank, wherein said strap surface fastener comprises a fastener in which two complementary surfaces may be detachably fastened when brought in contact with each other, regardless of orientation;

a separate flexible holder strap with first and second ends;

a holder surface fastener attached near said first end of said strap;

wherein said second end of said strap is attached to said blank;

wherein said ends of said blank are permanently attached to form a hollow shape having a substantially circular cross section with a circumference adapted to be approximately at least as large as said minimum circumference of said container, said shape being configured to receive said container, and said second end of said strap being approximately diametrically opposite said strap surface fastener;

whereby said holder strap can extend around a member adjacent to said shape, and said holder surface fastener can be detachably attached to said strap surface fastener to secure said hollow shape to said member;

whereby said holder surface fastener can be detached from said hollow shape, said blank can be collapsed to a compacted configuration, said strap can be wrapped around said blank, and said holder surface fastener can detachably attach to said strap surface fastener to retain said blank in said compacted configuration.

13. The holder for a beverage container, according to any one of claims 5 to 7, or 9 to 12, wherein said strap surface fasteners comprise a single contiguous strap surface fastener extending over substantially an entire surface of said blank.

14. The holder for a beverage container according to any one of claims 5 to 7, or 8 to 12 wherein said surface fasteners comprise hook and loop fasteners.

15. The holder for a beverage container according to any one of claims 1, 4, 9, or 10, further comprising:

a separate flexible holder strap having first and second ends;

a first holder surface fastener attached near said first end of said strap;

a second holder surface fastener attached near said second end of said strap;

wherein said holder surface fasteners are complementary to said strap surface fasteners;

whereby said first holder surface fastener on said holder strap can be detachably attached to a first of said strap surface fasteners to secure said first end of said strap to said hollow shape, said strap can extend around a member adjacent to said hollow shape, and said second holder surface fastener on said strap can be detachably attached to a second of said strap surface fasteners to secure said hollow shape to said member;

whereby at least one of said holder surface fasteners can be detached from said hollow shape, said blank can be collapsed to a compacted configuration, said strap can be wrapped around said blank, and at least one of said holder surface fasteners detachably attaches to at least one of said strap surface fasteners to retain said blank in said compacted configuration.

16. A process for using a beverage container holder for a beverage container that has a minimum circumference large enough to receive a cellular phone comprising:

inserting said cellular phone inside said beverage container holder;

wherein said inserting step is performed with a beverage container holder comprising a blank made of a flexible material having a width and first and second ends;

a first end surface fastener attached near said first end of said blank;

a second end surface fastener, complementary to said first end surface fastener, attached near said second end of said blank;

at least two strap surface fasteners attached to said blank spaced apart from each other by approximately half of said circumfercnce, wherein said strap surface fasteners comprise fasteners in which two complementary surfaces may be detachably fastened when brought in contact with each other, regardless of orientation;

whereby joining said first and second end surface fasteners detachably attaches said ends of said blank together, whereby said blank forms a hollow shape having a substantially circular cross section with a circumference adapted to be approximately at least as large as said minimum circumference said shape being configured to receive said cellular share, and said strap surface fasteners being approximately diametrically opposite each other;

whereby said ends of said blank can be detached from each other, said blank can be collapsed to a compacted configuration, and one of said end surface fasteners can attach to one of said strap surface fasteners to retain said blank in said compacted configuration.

17. A holder for a cellular phone having a circumference, comprising:

a blank made of a flexible material having a width and first and second ends;

a first end surface fastener attached near said first end of said blank;

a second end surface fastener, complementary to said first end surface fastener, attached near said second end of said blank;

at least two strap surface fasteners attached to said blank spaced apart from each other by approximately half of said circumference, wherein said strap surface fasteners comprise fasteners in which two complementary surfaces may be detachably fastened when brought in contact with each other, regardless of orientation;

whereby joining said first and second end surface fasteners detachably attaches said ends of said blank together, whereby said blank forms a hollow shape having a cross section with a circumference adapted to be approximately at least as large as said minimum circumference of said cellular phone, said shape being configured to receive said cellular phone, and said strap surface fasteners being approximately diametrically opposite each other;

whereby said ends of said blank can be detached from each other, said blank can be collapsed to a compacted configuration, and one of said end surface fasteners can attach to one of said strap surface fasteners to retain said blank in said compacted configuration.

18. A holder for a cellular phone, said cellular phone having a minimum circumference, comprising:

a blank made of a flexible material having cutouts, said blank having a width and first and second ends;

a first end surface fastener attached near said first end of said blank;

a second end surface fastener, complementary to said first end surface fastener, attached near said second end of said blank;

at least two strap surface fasteners attached to said blank spaced apart from each other by approximately half of said circumference, wherein said strap surface fasteners comprise fasteners in which two complementary surfaces may be detachably fastened when brought in contact with each other, regardless of orientation;

whereby joining said first and second end surface fasteners detachably attaches said ends of said blank together, whereby said blank forms a hollow shape with a circumference adapted to be approximately at least as large as said minimum circumference of said cellular phone, said shape being configured to receive said cellular phone;

whereby said ends of said blank can be detached from each other, said blank can be collapsed to a compacted configuration, and one of said end surface fasteners can attach to one of said strap surface fasteners to retain said blank in said compacted configuration.

19. A holder for miscellaneous items, comprising:

a blank made of a flexible material having a width and first and second ends defining a length;

a first end surface fastener attached near said first end of said blank;

a second end surface fastener, complementary to said first end surface fastener, attached near said second end of said blank;

at least two strap surface fasteners attached to said blank spaced apart from each other by approximately half of said length, wherein said strap surface fasteners comprise fasteners in which two complementary surfaces may be detachably fastened when brought in contact with each other, regardless of orientation;

whereby joining said first and second end surface fasteners detachably attaches said ends of said blank together, whereby said blank forms a hollow shape configured to receive said miscellaneous items, and said strap surface fasteners being approximately diametrically opposite each other;

whereby said ends of said blank can be detached from each other, said blank can be collapsed to a compacted configuration, and one of said end surface fasteners can attach to one of said strap surface fasteners to retain said blank in said compacted configuration.

20. A holder for miscellaneous items, comprising:

a blank made of a flexible material having cutouts, said blank having a width and first and second ends defining a length;

a first end surface fastener attached near said first end of said blank;

a second end surface fastener, complementary to said first end surface fastener, attached near said second end of said blank;

at least two strap surface fasteners attached to said blank spaced apart from each other by approximately half of said length, wherein said strap surface fasteners comprise fasteners in which two complementary surfaces may be detachably fastened when brought in contact with each other, regardless of orientation;

whereby joining said first and second end surface fasteners detachably attaches said ends of said blank together, whereby said blank forms a hollow shape with a circumference adapted to be approximately at least as large as a desired minimum circumference to hold said miscellaneous items, said shape being configured to receive said miscellaneous items;

whereby said ends of said blank can be detached from each other, said blank can be collapsed to a compacted configuration, and one of said end surface fasteners can attach to one of said strap surface fasteners to retain said blank in said compacted configuration.

21. The holder according to any one of claims 17 to 20, further comprising:

a separate flexible holder strap having first and second ends;

a first holder surface fastener attached near said first end of said strap;

a second holder surface fastener attached near said second end of said strap;

wherein said holder surface fasteners are complementary to said strap surface fasteners;

whereby said first holder surface fastener on said holder strap can be detachably attached to one of said strap surface fasteners to secure said first end of said strap to said hollow shape, said strap can extend around a member adjacent to said hollow shape, and said second holder surface fastener on said strap can be detachably attached to another of said strap surface fasteners to secure said hollow shape to said member;

whereby at least one of said holder surface fasteners can be detached from said hollow shape, said blank can be collapsed to a compacted configuration, said strap can be wrapped around said blank, and at least one of said holder surface fasteners detachably attaches to at least one of said strap surface fasteners to retain said blank in said compacted configuration.

22. A holder according to any one of claims 17 to 20, wherein said strap surface fasteners comprise a single contiguous strap surface fastener extending over substantially an entire surface of said blank.

23. The holder according to any one of claims 1, 4, 6, 9, 10, or 17 to 20, further comprising:

a separate flexible holder strap having first and second ends;

at least a first holder surface fastener attached to said strap;

at least a second holder surface fastener attached to said strap;

wherein said holder surface fasteners are complementary to said strap surface fasteners;

whereby said first holder surface fastener on said holder strap can be detachably attached to one of said strap surface fasteners to secure said first end of said strap to said hollow shape and said second holder surface fastener on said strap can be detachably attached to another of said strap surface fasteners to form a loop to create a bottom for said hollow shape;

whereby at least one of said holder surface fasteners can be detached from said hollow shape, said blank can be collapsed to a compacted configuration, said strap can be wrapped around said blank, and at least one of said holder surface fasteners detachably attaches to at least one of said strap surface fasteners to retain said blank in said compacted configuration.

24. A holder for a beverage container, comprising:

a first piece made of a flexible material having a height and two sides defining a first width;

a first sleeve surface fastener attached to each side of said first piece;

a second piece made of a flexible material having a height approximately equal to said height of said first piece and two sides defining a second width;

a second sleeve surface fastener complementary to said first sleeve surface fastener attached to each side of said second piece;

whereby attaching said first sleeve surface fasteners to corresponding ones of said second sleeve surface fasteners at an angular offset joins said pieces to form a substantially frustoconical sleeve, whereby a substantially frustoconical beverage container can be received in said sleeve;

whereby attaching said first sleeve surface fasteners to corresponding ones of said second sleeve surface fasteners approximately parallel to said sides joins said pieces to form an approximately cylindrical sleeve, whereby a substantially cylindrical beverage container can be received in said sleeve;

at least two strap surface fasteners, wherein said strap surface fasteners comprise fasteners in which two complementary surfaces may be detachably fastened when brought in contact with each other, regardless of orientation, at least one of which is attached to at least one of said pieces, spaced apart by approximately half the sum of said first width and said second width when said pieces are joined together, whereby said strap surface fasteners can be used to carry away said beverage container for portability purposes;

a separate flexible holder strap having first and second ends;

a first holder surface fastener attached near said first end of said strap;

a second holder surface fastener attached near said second end of said strap;

wherein said holder surface fasteners are complementary to said strap surface fasteners;

whereby said first holder surface fastener on said holder strap can be detachably attached to a first of said strap surface fasteners to secure said first end of said strap to said sleeve, said strap can extend around a member adjacent to said sleeve, and said second holder surface fastener on said strap can be detachably attached to a second of said strap surface fasteners to secure said sleeve to said member.

25. The holder for a beverage container according to claim 24, whereby at least one of said holder surface fasteners can be detached from said sleeve, said sleeve can be collapsed to a compacted configuration, said strap can be wrapped around said sleeve, and at least one of said holder surface fasteners detachably attaches to at least one of said strap surface fasteners to retain said sleeve in said compacted configuration.

26. The holder for a beverage container, according to any one of claims 24 or 25, wherein said strap surface fasteners comprise a single contiguous strap surface fastener extending over substantially an entire surface of at least one of said pieces.

27. The holder for a beverage container, according to any one of claims 24 or 25, wherein said surface fasteners comprise hook and loop fasteners.

28. A holder for a beverage container, said container having a minimum circumference, comprising:

a blank made of a flexible material having cutouts, said blank having a width and first and second ends;

a first end surface fastener attached near said first end of said blank;

a second end surface fastener, complementary to said first end surface fastener, attached near said second end of said blank;

a strap surface fastener attached to said blank intermediate between said end surface fasteners, wherein said strap surface fastener comprises a fastener in which two complementary surfaces may be detachably fastened when brought in contact with each other, regardless of orientation;

whereby joining said first and second end surface fasteners detachably attaches said ends of said blank together, whereby said blank forms a hollow shape having a substantially circular cross section with a circumference adapted to be approximately at least as large as the minimum circumference of said beverage container, said shape being configured to receive said beverage container;

whereby said hollow shape can be configured to receive beverage containers having varying diameters and to receive both frustoconical and cylindrical beverage containers, by attaching said end surface fasteners to each other at different positions and by attaching said end surface fasteners to each other at an angular offset; and whereby said ends of said blank can be detached from each other, said blank can be rolled into a jellyroll configuration, and said strap surface fastener can detachably attach to one of said end surface fasteners to retain said blank in said jellyroll configuration.

29. A holder for a beverage container, said container having a minimum circumference, comprising:

a blank having inner and outer surfaces made of a flexible material having a width and first and second ends;

a first end surface fastener attached to said inner surface near said second end of said blank;

a first strap surface fastener attached to said blank, wherein a loose end extends beyond said blank, said loose end and said blank defining a middle portion of said first strap fastener therebetween, wherein said strap surface fastener comprises a fastener in which two complementary surfaces may be detachably fastened when brought in contact with each other, regardless of orientation;

a second strap surface fastener attached near said second end of said blank on said outer surface;

wherein said loose end is attached near said first end of said blank, whereby said middle portion of said strap surface fastener forms a holder bottom and said loose end forms a second end surface fastener;

whereby joining said first and second end surface fasteners detachably attaches said ends of said blank together, whereby said blank forms a hollow shape having a substantially circular cross section with a circumference adapted to be approximately at least as large as the minimum circumference of said beverage container, said shape being configured to receive said beverage container; and whereby said hollow shape can be configured to receive beverage containers having varying diameters and to receive both frustoconical and cylindrical beverage containers, by attaching said end surface fasteners to each other at different positions and by attaching said end surface fasteners to each other at an angular offset.

30. A holder for a beverage container, said container having a minimum circumference, comprising:

a blank having inner and outer surfaces made of a flexible material having a width and first and second ends;

a first end surface fastener attached to said inner surface near said first end of said blank;

a first strap surface fastener attached to said blank, wherein a loose end extends beyond said blank, said loose end and said blank defining a middle portion of said first strap fastener therebetween, wherein said strap surface fastener comprises a fastener in which two complementary surfaces may be detachably fastened when brought in contact with each other, regardless of orientation;

a second end surface fastener attached near said second end of said blank on said outer surface;

wherein said loose end is attached near said first end of said blank, whereby said middle portion of said strap surface fastener forms a holder bottom and said loose end forms a second strap surface fastener;

whereby joining said first and second end surface fasteners detachably attaches said ends of said blank together, whereby said blank forms a hollow shape having a substantially circular cross section with a circumference adapted to be approximately at least as large as the minimum circumference of said beverage container, said shape being configured to receive said beverage container; and whereby said hollow shape can be configured to receive beverage containers having varying diameters and to receive both frustoconical and cylindrical beverage containers, by attaching said end surface fasteners to each other at different positions and by attaching said end surface fasteners to each other at an angular offset.

31. A holder for a beverage container, said container having a minimum circumference, comprising:

an integrally formed hollow shape having an outer surface and a circumference adapted to be approximately at least as great as said minimum circumference of said container, said shape being configured to receive said container;

a strap surface fastener attached to said outer surface, wherein said strap surface fastener comprises a fastener in which two complementary surfaces may be detachably fastened when brought in contact with each other, regardless of orientation;

a separate flexible holder strap having first and second ends;

a holder surface fastener attached near said first end of said strap;

wherein said second end of said strap is attached to said shape;

wherein said holder surface fastener is complementary to said strap surface fastener;

whereby said strap can extend around a member adjacent to said shape, and said holder surface fastener on said strap can be detachably attached to said strap surface fastener to secure said shape to said member; and whereby said holder surface fastener on said strap can be detached from said strap surface fastener, said shape can be collapsed to a compacted configuration, said strap can be wrapped around said shape, and said holder surface fastener can detachably attach to said strap surface fastener to retain said shape in said compacted configuration.

32. The holder for a beverage container, according to claim 7, wherein said blank is arc shaped whereby said blank forms a hollow substantially frustoconical shape.

33. The holder for a beverage container, according to claim 7 or 32, wherein said ends of said blank are permanently attached together by said blank being integrally formed.

* * * * *